US006065633A

United States Patent [19]

Abbey

[11] Patent Number: 6,065,633

[45] Date of Patent: May 23, 2000

[54] MULTI-PURPOSE RECEPTACLE

[75] Inventor: Bert H. Abbey, Guilford, Conn.

[73] Assignee: Roller Coater, Inc., Guilford, Conn.

[21] Appl. No.: 09/019,588

[22] Filed: Feb. 6, 1998

Related U.S. Application Data

[63] Continuation-in-part of application No. 08/882,574, Jun. 25, 1997.

[51] Int. Cl.[7] ..... B65D 1/36

[52] U.S. Cl. ..... 220/501; 220/702; 220/736; 220/695; 220/697

[58] Field of Search ..... 220/501, 695, 220/697, 702, 736

[56] References Cited

U.S. PATENT DOCUMENTS

| | | | |
|---|---|---|---|
| D. 28,095 | 12/1897 | Mills . | |
| D. 186,195 | 9/1959 | Cole | D58/17 |
| D. 202,134 | 8/1965 | Bryan | D58/17 |
| D. 212,563 | 10/1968 | Tidwell | D64/18 |
| D. 212,831 | 11/1968 | Koch | D49/29 |
| D. 248,335 | 6/1978 | Cooke et al. | D64/18 |
| D. 293,144 | 12/1987 | Papke et al. | D32/53.1 |
| D. 303,304 | 9/1989 | Sabatino | D32/53 |
| D. 352,143 | 11/1994 | Arshinoff | 15/260 |
| D. 364,017 | 11/1995 | Moffitt | D32/53.1 |
| 775,526 | 11/1904 | Dunbar . | |
| 1,848,331 | 3/1932 | Esslinger . | |
| 2,287,156 | 6/1942 | White | 65/28 |
| 2,614,399 | 10/1952 | Roethel | 220/23.88 |
| 2,661,858 | 12/1953 | Howell | 220/1 |
| 2,705,334 | 4/1955 | Farrow | 15/121.2 |
| 2,712,668 | 7/1955 | Thiele | 15/264 |
| 2,738,915 | 3/1956 | Clair | 220/575 |
| 2,827,648 | 3/1958 | Geisz | 15/121.2 |
| 2,849,158 | 8/1958 | Hopla | 222/189 |
| 2,893,030 | 7/1959 | Averna | 15/121.2 |
| 2,896,809 | 7/1959 | Metzger | 220/20 |
| 3,292,815 | 12/1966 | Smith et al. | 220/94 |
| 3,351,970 | 11/1967 | Engh | 15/257.06 |
| 3,493,988 | 2/1970 | Tidwell | 15/257.06 |
| 3,514,012 | 5/1970 | Martin | 220/63 |
| 3,553,762 | 1/1971 | Padgett, Jr. et al. | 15/257.06 |
| 3,828,389 | 8/1974 | Heisler | 15/257.06 |
| 4,094,431 | 6/1978 | Wheeler | 220/23.4 |
| 4,145,789 | 3/1979 | Morgan, Sr. | 15/257.06 |
| 4,164,229 | 8/1979 | Fuhr | 220/20 |
| 4,164,299 | 8/1979 | Fuhr | 220/20 |
| 4,297,762 | 11/1981 | Crysdale | 15/257.06 |
| 4,509,226 | 4/1985 | Allison et al. | 15/257.06 |
| 4,706,918 | 11/1987 | Wilson | 248/210 |
| 4,756,046 | 7/1988 | Surface et al. | 15/257.06 |
| 4,800,845 | 1/1989 | Budd | 220/498.02 |
| 4,927,046 | 5/1990 | Armstrong | 220/90 |
| 5,046,749 | 9/1991 | Owens | 280/79.5 |
| 5,054,661 | 10/1991 | Hollje | 222/465.1 |
| 5,072,868 | 12/1991 | Dickie et al. | 224/252 |
| 5,207,348 | 5/1993 | Fischer et al. | 220/697 |
| 5,322,183 | 6/1994 | Strachan | 220/697 |
| 5,341,969 | 8/1994 | Acccardo et al. | 222/465.1 |
| 5,400,916 | 3/1995 | Weber | 220/404 |
| 5,511,279 | 4/1996 | Ippolito | 15/257.06 |
| 5,549,216 | 8/1996 | Scholl | 220/695 |
| 5,727,878 | 3/1998 | Sullivan, Jr. | 366/247 |

*Primary Examiner*—Joseph M. Moy
*Attorney, Agent, or Firm*—Fleshner & Kim, LLP

[57] ABSTRACT

A multi-compartment receptacle includes a first compartment and a second compartment. Structural provisions allow for the convenient transfer of relatively small quantities of a substance from the first compartment to the second compartment. The second compartment is preferably suitable for holding a paint brush, as well as a relatively small volume of liquid. The receptacle of the present invention can be inexpensively and rapidly produced by a molding process from plastic materials, such as polyethylene. A disposable multi-compartment liner is also provided that includes a liner first compartment, a liner second compartment, and a liner flange. Methods of making such a receptacle and liner are also disclosed, as well as methods for transferring liquids between the receptacle first compartment and the receptacle second compartment.

33 Claims, 41 Drawing Sheets

FRONT VIEW OF MAIN WALL
SHOWING POSITION OF
TANGENTIAL WALLS AND CUP

SIDE VIEW OF
TANGENTIAL WALL 51/61
WITH CHANNEL 71/81

METHOD OF MAKING A PLASTIC BUCKET I

METHOD OF MAKING A PLASTIC BUCKET II

MULTI-PURPOSE RECEPTACLE

This application is a continuation-in-part of application Ser. No. 08/882,574 filed Jun. 25, 1997 still pending.

BACKGROUND OF THE INVENTION

1. Field of the Invention

This invention relates to a receptacle. In particular, this invention relates to a multi-purpose bucket, pail, can, or receptacle.

2. Background of the Related Art

Paint, other coatings, adhesives, other liquid emulsions, suspensions, solutions, and the like, may be applied to a surface with a roller, a brush, or as a spray, etc. One of the most convenient and efficient means for applying such materials is with a roller. However, when working (e.g. painting) with a roller, there is still a need for a brush for painting trim, corners, etc., where a roller will not fit or is otherwise unsuitable. There is a need for a receptacle having at least two compartments: a larger main compartment and a smaller compartment or cup, wherein the main compartment is suitable for containing paint to be applied to a roller, and the cup is suitable for applying paint to a brush, and furthermore, wherein paint can be readily transferred from the main compartment to the cup, even when the paint in the main compartment is at a relatively low level. There is also a need for disposable liner for insertion within a multi-compartment paint receptacle, whereby the cleanup process for the receptacle is facilitated, and the longevity of the receptacle is extended.

Paint roller equipment, including trays and buckets of various shapes and designs, with or without partitions or inserts of various types, are old in the art. For example, U.S. Pat. No. 1,848,331 to Esslinger discloses a multiple compartment pail. In one Esslinger embodiment, compartments of equal height are formed by a partition which extends over the full height of the pail from base to rim. In another Esslinger embodiment, the pail serves as a holder for inserts, and the inserts form the compartments. U.S. Pat. No. 2,705,334 to Farrow discloses a paint roller wiping device, including a plate for mounting within a paint bucket, and a shelf which can accommodate a paint brush. No provision is made in the Farrow patent for the shelf to contain paint, nor for the transfer of paint from the paint bucket to the shelf.

U.S. Pat. No. 2,712,668 to Thiele discloses a scrub bucket having a central, vertical partition therein, thereby providing a bucket having two compartments of equal depth, surface area, and volume. The partition disclosed in the Thiele patent is intended to prevent exchange of liquid between the two compartments.

U.S. Pat. No. 2,896,809 to Metzger et al. discloses a partitioned pail, wherein the partition extends diametrically across the middle of the pail to provide two substantially semi-circular bottom sections. Thus, the two partitions are substantially of equal depth, surface area, and volume. The partition terminates at a height below the top edge or rim of the pail or receptacle. The partition is open on the bottom and sides so that multiple pails can be stacked or nested.

U.S. Pat. No. 4,145,789 to Morgan discloses a paint distributing plate, and a paint retaining and distributing apparatus, including a planar sheet for insertion into an open-mouth receptacle or bucket. The planar sheet contacts the base of the bucket/receptacle, thus providing two "compartments" of equal height. The planar sheet has a plurality of holes therein which permit the passage of paint therethrough. Consequently, the two compartments together comprise an open system.

U.S. Pat. No. 4,927,046 to Armstrong discloses a pentagonal-shaped bucket which includes a ledge for supporting a paint brush. The Armstrong patent does not disclose any internal walls, partitions or separate compartments within the bucket for containing any type of liquids. Further, no structural elements are disclosed in the Armstrong patent for transferring a liquid to the ledge or for retaining a volume of liquid on the ledge. Thus, with respect to containing liquids, the bucket disclosed in the Armstrong patent has only a single compartment with the bucket in the normal upright position.

U.S. Pat. No. 5,641,087 to Moffitt discloses a paint bucket having a pair of integral rolling surfaces which extend upwards from the bottom of the bucket and meet at a peak below the level of the rim of the bucket. The bucket structure is symmetrical, and each rolling surface is suitable for a mini-roller. The rolling surfaces preferably do not contact the side walls of the bucket, so that a single compartment exists within the bucket. Or, in an alternative embodiment, when the rolling surfaces do contact the side walls, the bucket has two compartments of equal depth.

The above references are incorporated by reference herein where appropriate for appropriate teachings of additional or alternative details, features, and/or technical background.

SUMMARY OF THE INVENTION

An object, therefore, of the invention is to provide a receptacle having two separate compartments, wherein the two compartments are separated such that a substance contained in one compartment can be transferred to the other compartment by tilting the receptacle.

Another object of the invention is to provide a bucket receptacle having two separate compartments, wherein the two compartments are separated such that a substance contained in one compartment can be transferred to the other compartment by tilting the receptacle.

Another object of the invention is to provide a method for making a multi-compartment receptacle.

Another object of the invention is to provide a method for making a multi-compartment liner.

Another object of the invention is to provide a method for transferring liquid from a first compartment of a receptacle to a second compartment of the receptacle.

One advantage of the invention is that it provides a multi-compartment receptacle having a first compartment and a second compartment, wherein a substance can be conveniently transferred from the first compartment to the second compartment by tilting the receptacle.

Another advantage of the invention is that it provides a multi-compartment receptacle suitable for containing paint, the receptacle including a first compartment, a divider main wall, and a second compartment integral with the receptacle, wherein the first compartment is suitable for holding a relatively large volume of paint, the divider is suitable for applying and distributing paint over a roller, and the second compartment is suitable for containing a relatively small volume of paint and/or a paint brush.

Another advantage of the invention is that it provides a disposable rigid or flexible multi-purpose plastic liner for use in combination with a paint receptacle, wherein cleanup of the paint receptacle is facilitated.

Another advantage of the invention is that it provides a multi-compartment receptacle and receptacle liner combination for containing a substance, the receptacle having a first compartment and a second compartment integral with the receptacle, the receptacle liner for inserting within the receptacle and lining the inner surfaces of the receptacle, the receptacle liner having substantially the same size and shape as the receptacle, wherein a substance can be conveniently transferred from a liner first compartment to a liner cup compartment by tilting the receptacle.

Another advantage of the invention is that it provides a disposable multi-compartment liner for lining a multi-compartment paint receptacle thereby greatly facilitating cleanup of the multi-compartment paint receptacle.

Another advantage of the invention is that it provides a method of making a multi-compartment receptacle by a molding process from plastic materials.

Another advantage of the invention is that it provides a method for conveniently transferring a substance from a first compartment of a multi-compartment receptacle to a second compartment of the multi-compartment receptacle.

Another advantage of the invention is that it provides a method for making a disposable multi-compartment liner for lining a multi-compartment receptacle.

One feature of the invention is that it provides a receptacle including a first compartment of relatively large capacity and a second compartment of relatively small capacity, wherein the two compartments are separated such that a substance contained in the first compartment can be transferred to the second compartment by tilting the receptacle Another feature of the invention is that it provides a multi-compartment receptacle which includes a first compartment, and a second compartment integral with the receptacle, wherein the receptacle has a body including compartment divider section having a surface suitable for applying and distributing paint to a paint roller.

Another feature of the invention is that it provides a disposable plastic, or plastic-containing liner for insertion within a multi-compartment receptacle.

Another feature of the invention is that it provides a receptacle and receptacle liner combination for containing a liquid, wherein the receptacle liner is disposable.

These and other objects, advantages and features are accomplished by the provision of a receptacle comprising, a receptacle body and a divider that divides an interior of the receptacle body into a first compartment and a second compartment, wherein the divider is adapted to allow a substance contained in the first compartment to be transferred to the second compartment when the receptacle body is tilted by a predetermined amount.

These and other objects, advantages and features are accomplished by the provision of a receptacle and receptacle liner combination, comprising: a receptacle body, a divider that divides an interior of the receptacle into a first compartment and a second compartment, wherein the divider is adapted to allow a substance contained in the first compartment to be transferred to the second compartment then the receptacle body is tilted by a predetermined amount; and a receptacle liner having substantially the same size and shaped as the receptacle body positioned to line interior surfaces of the receptacle body.

These and other objects, advantages and features are accomplished by the provision of a multi-compartment liner, comprising a liner body and a divider that divided an interior of the liner body into the first compartment and a second compartment, wherein the divider is adapted to allow a substance contained in the first compartment to be transferred to the second compartment when the liner body is tilted by a predetermined amount.

These and other objects, advantages and features are accomplished by the provision of receptacle and receptacle liner combination, comprising a receptacle body having a base, a rim and an exterior surface that extends between the base and the rim, and a multi-compartment liner positioned inside the receptacle body, the multi-compartment liner comprising: a liner body having a base, a flange, and an exterior surface that extends between the base and the flange; and a divider that divides an interior of the liner body into a first compartment and a second compartment, wherein the divider is adapted to allow a substance contained in the first compartment to be transferred to the second compartment when the liner body is tilted by at least a predetermined amount.

These and other objects, advantages and features are accomplished by the provision of a method for making a liner for a multi-compartment receptacle, comprising the steps of: providing a liner mold for the liner, wherein the liner mold comprises a liner body portion having a base portion, a rim portion and an exterior surface portion that extends between the base portion and the rim portion, and a divider portion that divides the liner body portion into a first compartment portion and a second compartment portion, wherein the liner mold is adapted to form a liner with a first compartment, a second compartment and a divider that allows a substance contained in the first compartment of the liner to be transferred to the second compartment of the liner when the liner is tilted by at least a predetermined amount; providing liner material for the liner; placing the liner material in the liner mold; forming the liner from the liner material; and removing the liner from the liner mold.

These and other objects, advantages and features are accomplished by the provision of a method for making a receptacle for containing a substance, comprising the steps of: providing a receptacle mold for the receptacle, wherein the receptacle mold comprises a receptacle body portion having a base portion, a rim portion and an exterior surface portion that extends between the base portion and the rim portion, and a divider portion that divides the receptacle body portion into a first compartment portion and a second compartment portion, wherein the receptacle mold is adapted to form a receptacle with a first compartment, a second compartment and a divider that allows a substance contained in the first compartment of the receptacle to be transferred to the second compartment of the receptacle when the receptacle is tilted by at least a predetermined amount; providing receptacle material for the receptacle; placing the receptacle material in the receptacle mold; forming the receptacle from the receptacle material; and removing the receptacle from the receptacle mold.

These and other objects, advantages and features are accomplished by the provision of a method of transferring a substance between a first compartment of a receptacle liner and a second compartment of the receptacle liner, comprising the steps of: inserting the receptacle liner in a receptacle to provide a receptacle and receptacle liner combination, wherein the receptacle liner comprises a liner body having a base, a rim and an exterior surface that extends between the base and the rim, and a divider that divides an interior of the liner body into the first compartment and the second compartment, wherein the divider is adapted to allow a substance contained in the first compartment to be transferred to the second compartment when the liner body is tilted by at least a predetermined amount in a direction generally towards the second compartment; providing a liquid in the first compartment of the receptacle liner while the receptacle and receptacle liner combination is in a substantially level position; tilting the receptacle and receptacle liner combination from the substantially level position in the direction generally towards the second compartment until a desired amount of the substance has been transferred from the first compartment to the second compartment; and returning the receptacle and receptacle liner combination to the substantially level position.

These and other objects, advantages and features will become more apparent from the following description of embodiments thereof taken in conjunction with the accompanying drawings.

Additional advantages, objects, and features of the invention will be set forth in part in the description which follows and in part will become apparent to those having ordinary skill in the art upon examination of the following or may be learned from practice of the invention. The objects and advantages of the invention may be realized and attained as particularly pointed out in the appended claims.

BRIEF DESCRIPTION OF THE DRAWINGS

The invention will be described in detail with reference to the following drawings in which like reference numerals refer to like elements wherein.

DETAILED DESCRIPTION OF PREFERRED EMBODIMENTS

The instant invention provides a multi-compartment bucket or bucket-like receptacle suitable for containing a paint substance such as, the bucket including a bucket main compartment of relatively large capacity, and a bucket cup compartment of relatively small capacity, wherein the bucket cup compartment is integral with the bucket. In situations where the substance contained in the bucket is paint, the main compartment of the bucket is suitable for holding a relatively large volume of paint for applying to a roller, and the cup compartment of the bucket is suitable for containing a relatively small volume of paint and/or a paint brush. The cup compartment may be internal or external to the bucket outer side. In both cases, the cup compartment is integral with the bucket.

Figure 1A:
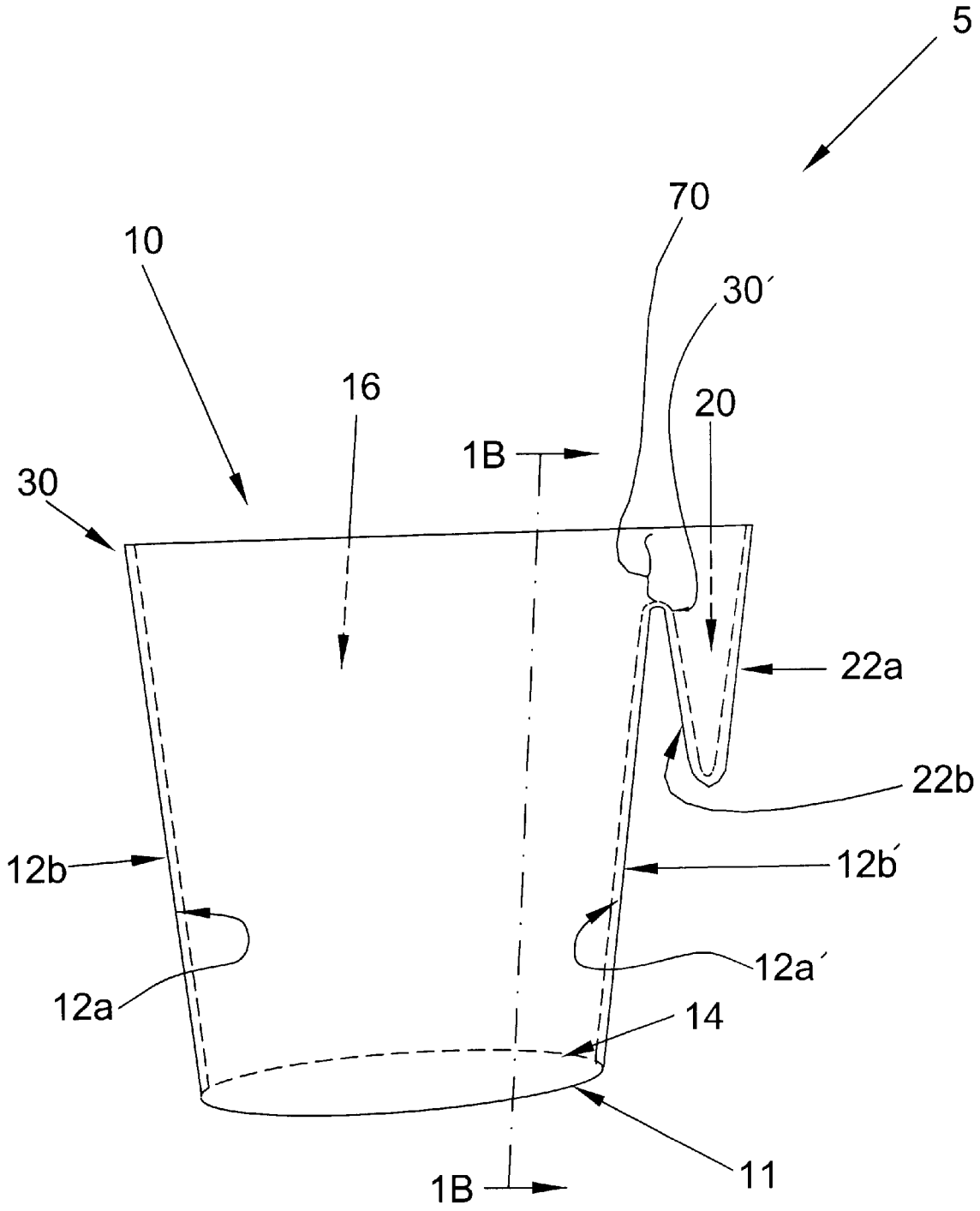
FIG. 1A shows a sectional view of a bucket according to one embodiment of the invention, in which the bucket has no internal walls, the cup compartment is external to the bucket outer side, and a channel is formed by the straight section rim.

FIG. 1A is a sectional view of a bucket, pail, or bucket-like receptacle 5 according to one embodiment of the invention. Hereinafter the terms "pail" and "bucket" will be used interchangeably. The bucket 5 of the instant invention has a bucket body 10, including a bucket first or main compartment 16, a bucket second or cup compartment 20, a bucket base 11, a bucket rim 30, a bucket inner side 12*a*, a bucket outer side 12*b*, and a bucket inner basal edge 14. A bucket inner side section 12*a*' and outer side section 12*b*' function as a divider to divide the body 10 into the main compartment 16 and the cup compartment 20. Preferably, the bucket body 10 and the bucket base 11 each has a thickness ranging from about 1 to about 4 mm, and more preferably from-about 1.5 to about 2 mm. The bucket main compartment 16 includes bucket main compartment base 17 which, according to certain embodiments of the invention, may correspond to the interior part of bucket base 11. According to the embodiment illustrated in FIGS. 1A–1F, the cup compartment 20 is external to the bucket outer side 12*b*, and the bucket 5 lacks an internal wall.

The body 10 may be more or less cylindrical or frusto-conical in shape. The bucket inner side section 12*a*' and corresponding bucket outer side section 12*b*, are preferably straight. The bucket inner side straight section 12*a*' includes a straight section rim 30'. The straight section rim 30' is straight or substantially straight and preferably has a length ranging from approximately 0.3 to approximately 0.99 times the diameter of bucket rim 30. The straight section rim 30' is lower than the bucket rim 30, thereby forming a channel 70 for the flow or passage of liquids from the main compartment 16 to the cup compartment 20. The cup compartment 20 is located adjacent to the bucket outer side straight section 12*b*'. The channel 70 permits the facile and convenient transfer of liquids from the main compartment 16 to the cup compartment 20.

According to one embodiment of the invention, the channel 70 may extend the entire length of the straight section rim 30'. Alternatively, the bucket inner side straight section 12*a*' may include at least one channel positioned at one or more specific locations of the straight section rim 30'. According to a currently preferred embodiment, left and right channels 71 and 81 are located at left and right edges 30'*a* and 30'*b*, respectively, of the straight section rim 30', as shown in FIGS. 1C and 1D. The depth of the left and right channels 71 and 81 may vary over a fairly broad range. However, the depth of the left and right channels 71 and 81 should be less than the height of the straight section rim 30' as measured from the main compartment base 17.

Figure 2A:
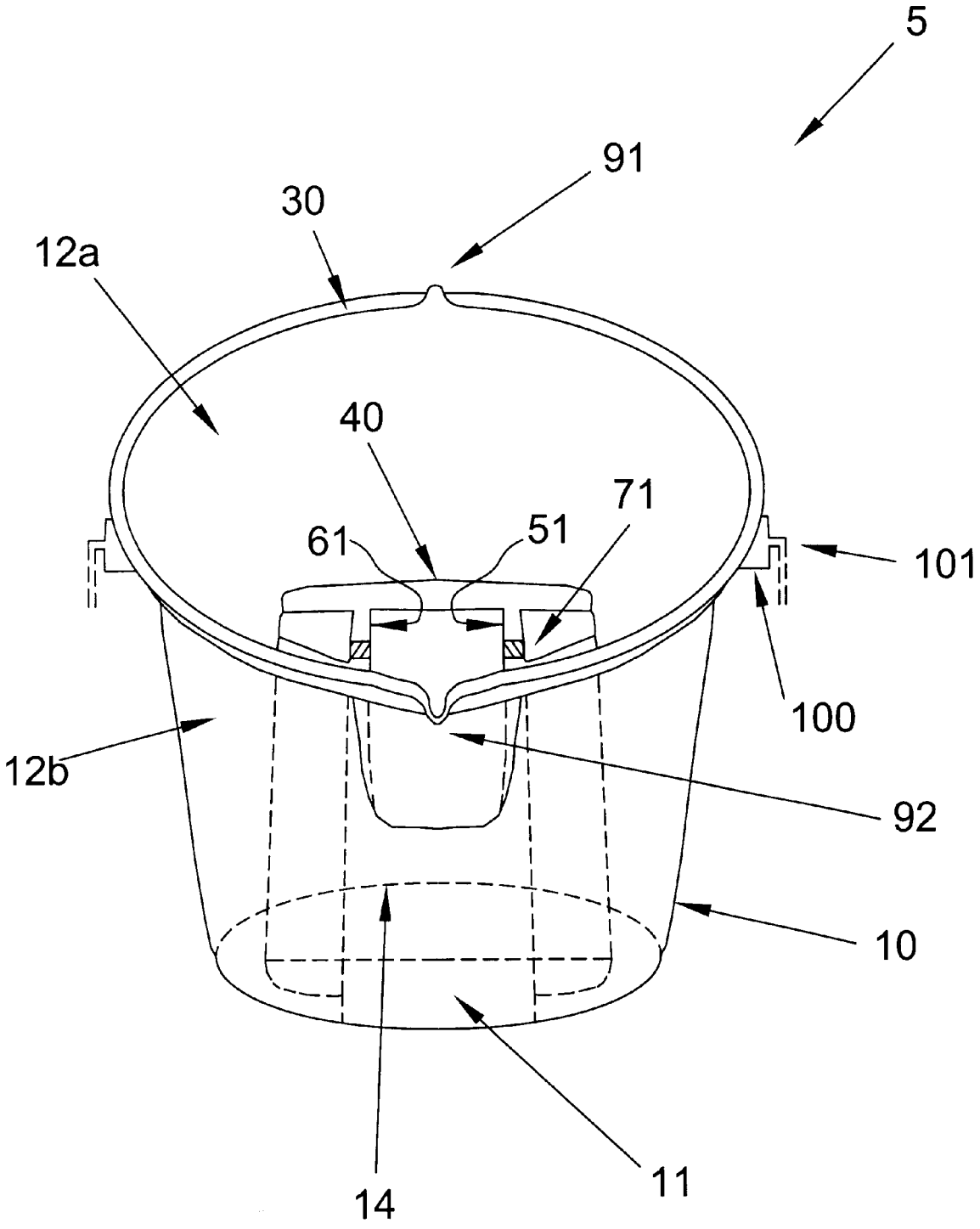
FIG. 2A is a perspective view of a bucket according to another embodiment of the invention.
Figure 2B:
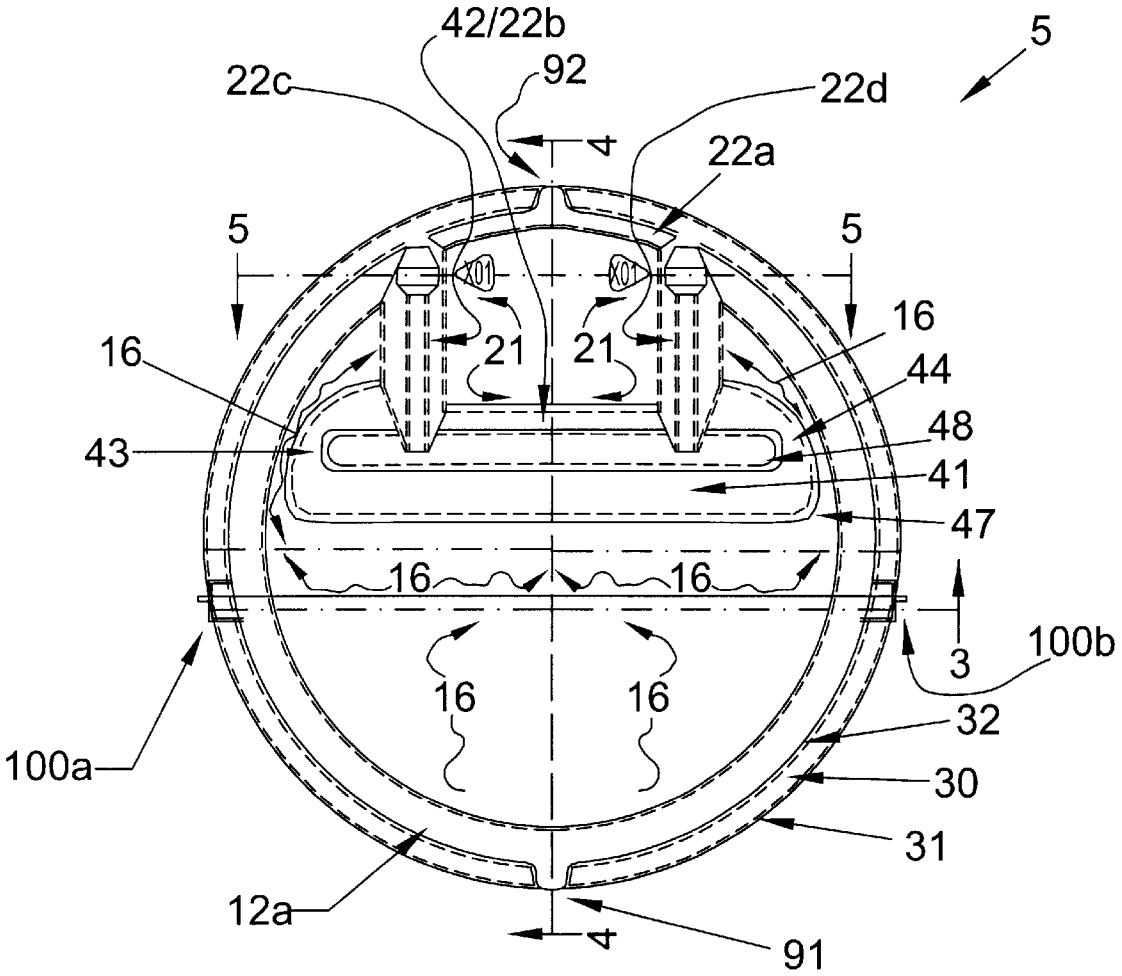
FIG. 2B is a first plan view of the bucket shown in FIG. 2A.
Figure 12:
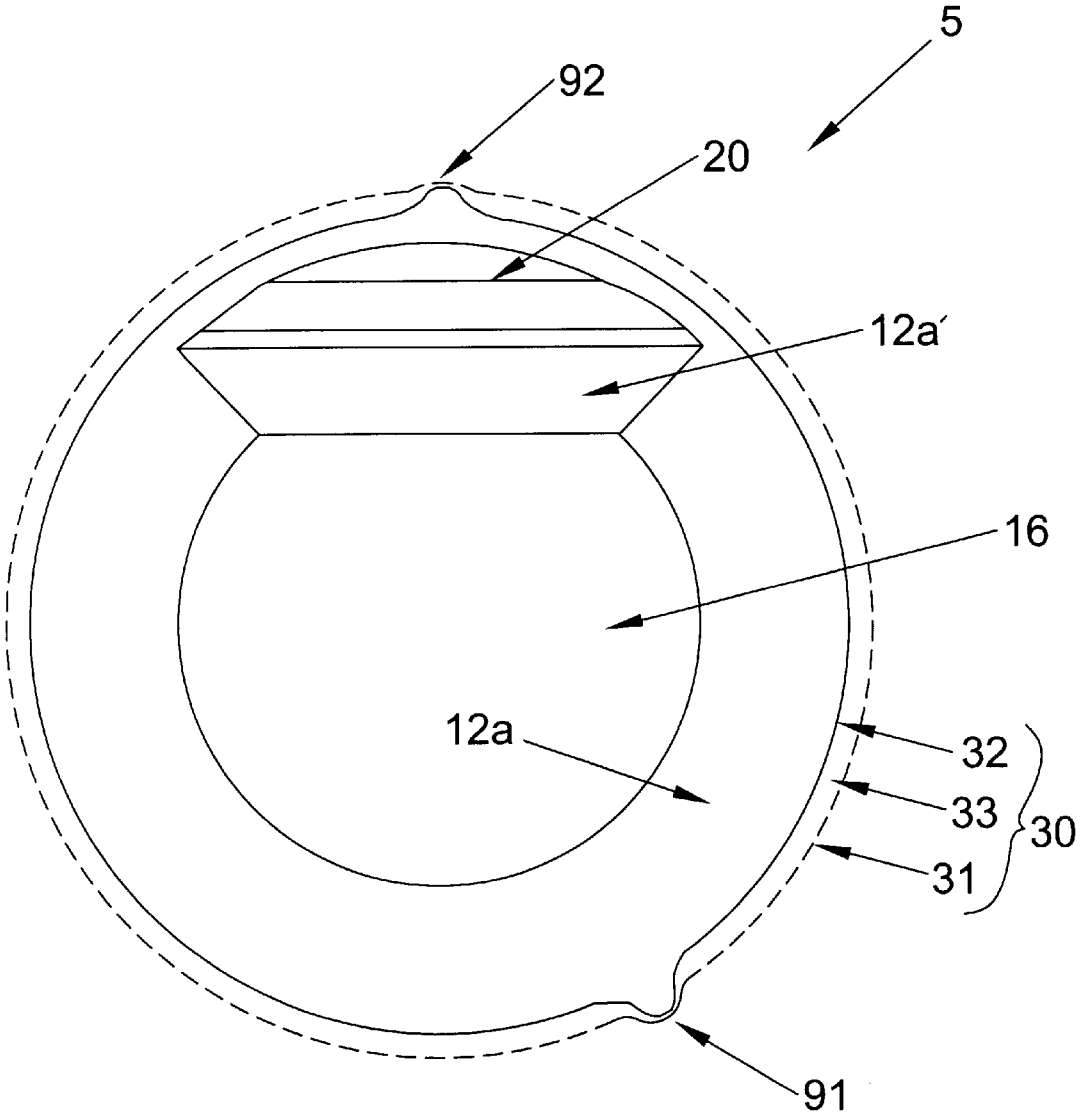
FIG. 12 shows a plan view of a bucket, according to another embodiment of the invention.

The bucket 5 may include a bucket rim 30 having an outer rim 31 and an inner rim 32, with bucket flange 33 located therebetween, as shown in FIGS. 2B and 12. The overall height of the bucket 5 from the bucket base 11 to the bucket rim 30 is preferably from approximately 6 inches to approximately 36 inches. The overall height of the bucket 5 preferably ranges from approximately 8 inches to approximately 16 inches, and more preferably from approximately 10 inches to approximately 12 inches. The diameter or width of the bucket base 11 may range from approximately 6 inches to approximately 36 inches. Preferably, the diameter or width of the bucket base 11 ranges from approximately 7 inches to approximately 14 inches, and more preferably from approximately 10 inches to approximately 12 inches.

According to the embodiments shown in FIGS. 1A–1F, the cup compartment 20 has a smaller capacity, is narrower, and is shallower than the main compartment 16. The cup compartment 20 preferably has dimensions suitable for holding a paint brush in an upright position or at an angle of at least approximately 45 degrees from the horizontal or the base 21 FIG. 1C) of the cup 20. The cup 20 preferably has a width ranging from approximately 3 inches to approximately 9 inches. More preferably, the cup 20 has a width of approximately 5 inches. The cup 20 preferably has a height of from approximately 3 inches to approximately 7 inches.

Figure 1B:
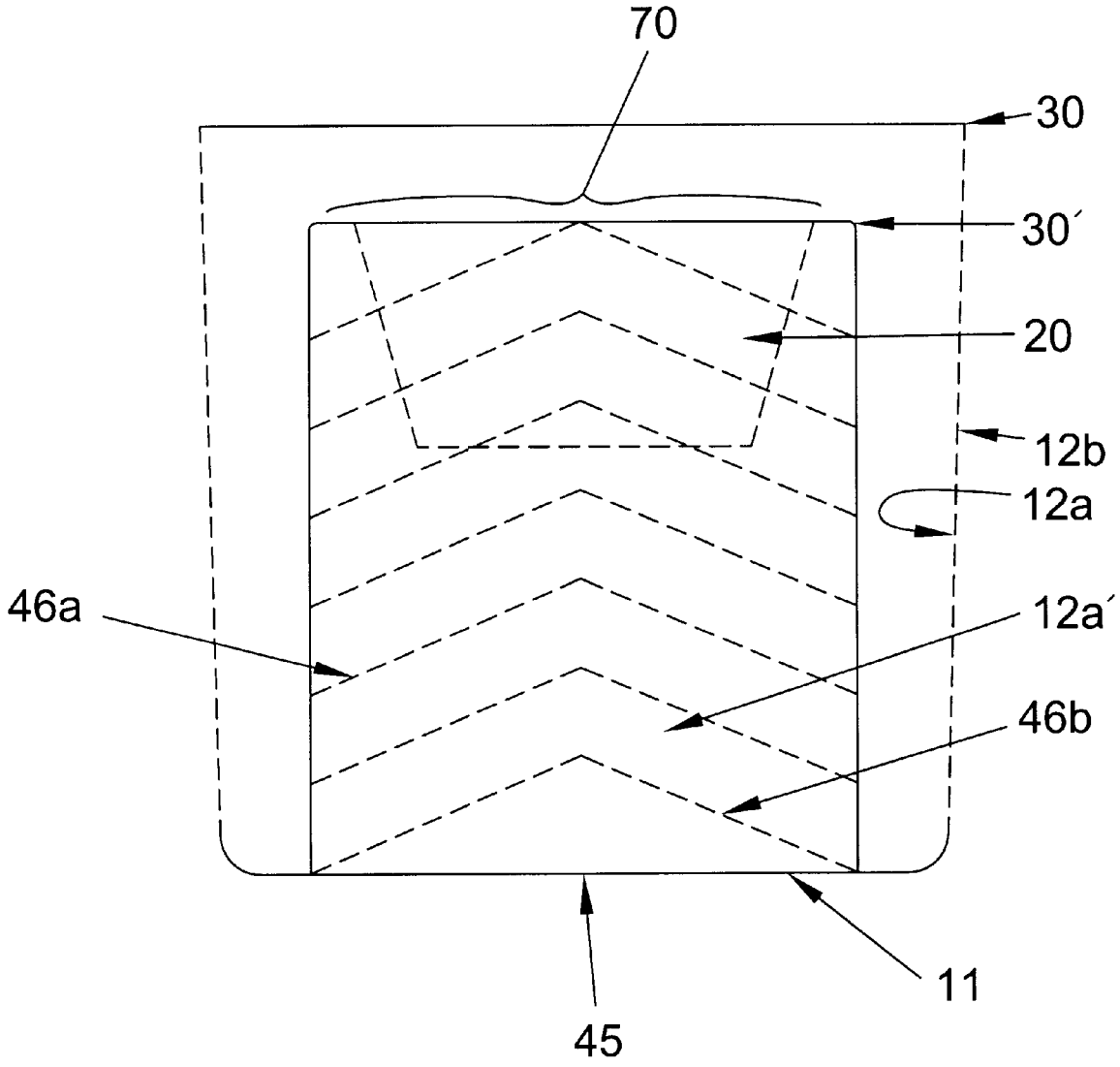
FIG. 1B is a sectional view taken along the section line 1B—1B of FIG. 1A.
Figure 1C:
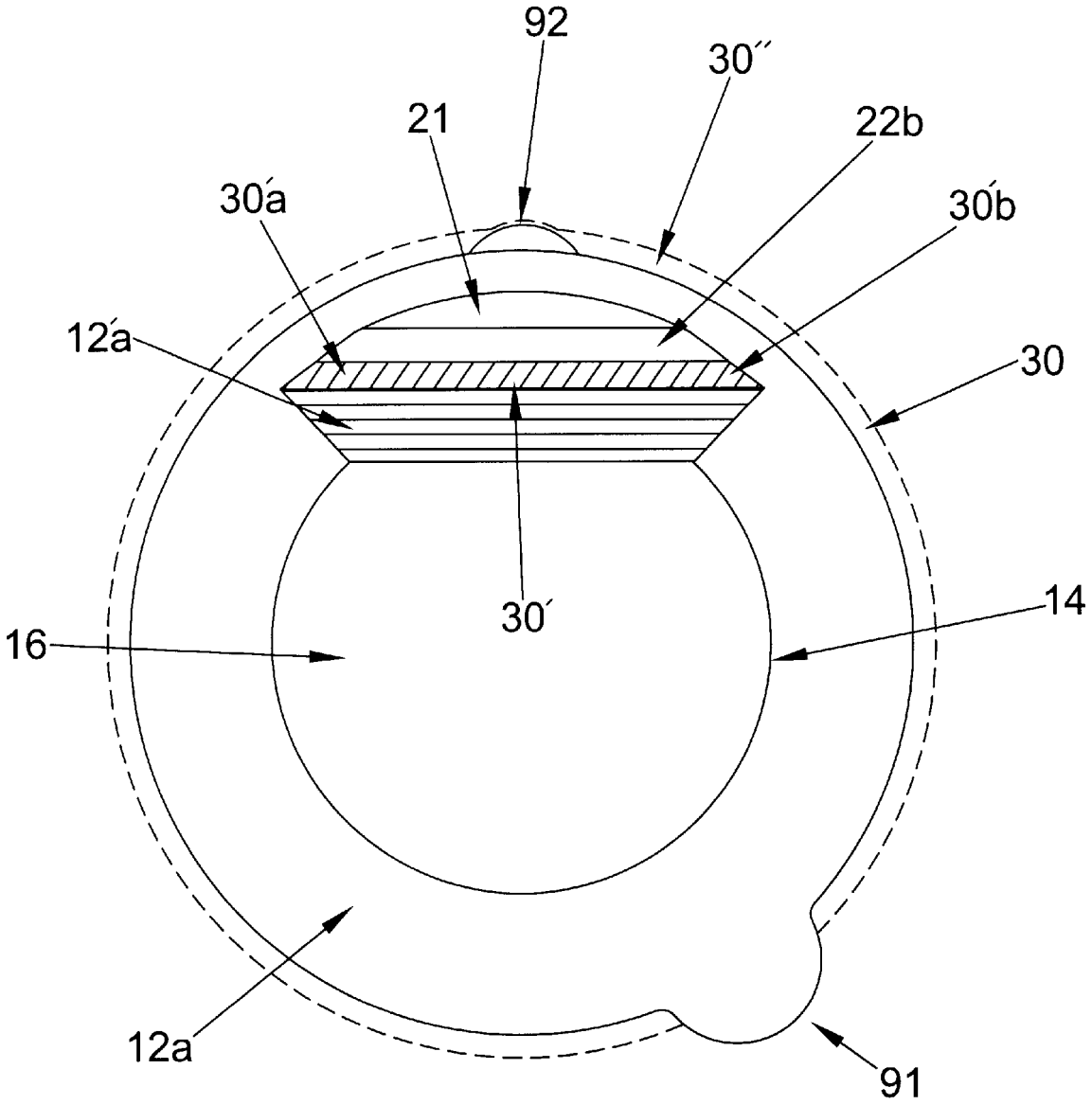
FIG. 1C is a plan view of the bucket illustrated in FIG. 1A.
Figure 1D:
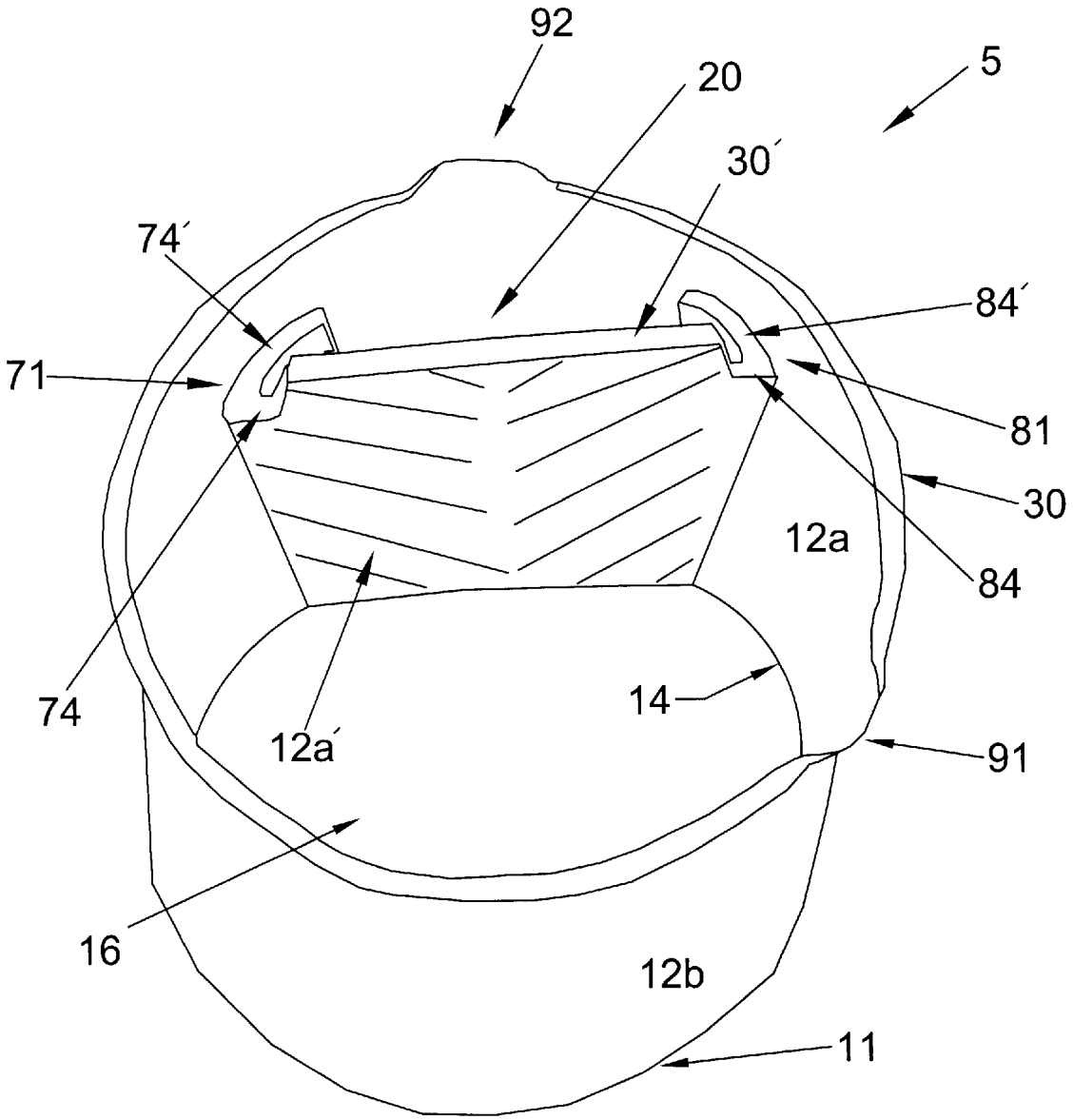
FIG. 1D is a first perspective view of a bucket according to another embodiment of the invention, in which the bucket has no internal walls, the cup compartment is external to the bucket outer side, and a pair of channels are located on the straight section rim.

FIG. 1B is a sectional view taken along the section line 1B—1B of FIG. 1A, and shows the relative position of the bucket inner side straight section 12*a*' with respect to the bucket inner side 12*a* and the bucket outer side 12*b*. FIG. 1B also shows the relative heights of the straight section rim 30' and the bucket rim 30. As shown in FIG. 1B, the channel 70 runs the entire length of the bucket inner side straight section 12*a*'. The relative position of the cup 20 with respect to the bucket inner side straight section 12*a*' is also shown. The bucket inner side straight section 12*a*' defines and provides a substantially planar or flat surface, and is of suitable size and shape for accommodating a paint roller. According to one embodiment of the invention, the bucket inner side straight section 12*a*' is approximately 10 to 11 inches wide and can accommodate a standard 9 inch paint roller.

A plurality of left indentations 46*a*, and right indentations 46*b* may be provided on the left and right sides, respectively, of the bucket inner side straight section 12*a*'. Each left indentation 46*a* converges with a corresponding right indentation 46*b* at the midpoint of the bucket inner side straight section 12*a*'. In FIG. 1B, the midpoint is indicated with line 45. The left indentations 46*a* are substantially parallel to each other, as are the right indentations 46*b*. Each left indentation 46*a* and each right indentation 46*b* slopes downward from the midpoint 45 towards the base 11. The angle at which the left and right indentations 46*a* and 46*b* slope downward may range from approximately 10° to approximately 16°, and more preferably from approximately 12° to approximately 15°, and most preferably at an angle approximately 13.5°.

The bucket inner side straight section 12*a*' may serve as a surface for applying and distributing a liquid, e.g., paint, contained in the main compartment 16, to a paint roller. Accordingly, the bucket inner side straight section 12*a*' may serve a dual role as a divider for dividing the body 10 into the main and cup compartment 16 and 20 and as a surface for applying/distributing paint or other materials to a paint roller or the like. In this case, the purpose of the left and right indentations 46*a* and 46*b* is to promote drainage of the liquid from the bucket inner side straight section 12*a*' to the main compartment 16.

In the embodiment shown in FIGS. 1A–1F, the bucket inner side straight section 12*a*' is, in part, functionally analogous to the main wall inner side 41 shown in FIG. 2B. The spacing between each of the left and right indentations 46*a* and 46*b* may range from several inches to a few millimeters. Preferably the spacing between each of left and right indentations 46*a* and 46*b* range from approximately 5 inches to approximately 0.5 inch, more preferably from approximately 3 inches to approximately 0.5 inch, and most preferably approximately 0.94 inch.

FIG. 1C is a plan view of the bucket or pail 5 of FIG. 1A. In describing the buckets according to various embodiments of the invention, the bucket as seen in plan view may be considered as being oriented such that a second pouring lip 92 faces the 12 o'clock position. In addition, the 9 o'clock and the 3 o'clock positions will be considered to represent the left hand side and the right hand side of the bucket, respectively. Throughout the description of the bucket 5, the term "inner" refers to that which is relatively close to the inside or center of the bucket, and the term "outer" refers to that which is relatively close to the outside of the bucket, as seen in plan view.

FIG. 1C shows the relative positions of the bucket components according to one embodiment of the invention. The main compartment 16 is bounded by the bucket inner side 12*a* and the bucket inner side straight section 12*a*'. The bucket 5 includes a bucket rim 30, a straight section rim 30', and a cup rim 30". The bucket rim 30 and the cup rim 30" are preferably substantially crescent-shaped, while the straight section rim 30' is preferably substantially straight. The straight section rim 30' includes a left edge of the straight section rim 30'*a* and a right edge of the straight section rim 30'*b*. The second pouring lip 92 is located at the 12 o'clock position and is used for pouring liquids from the cup compartment 20. The first pouring lip 91 is used for decanting or pouring liquids from the main compartment 16. Although the first pouring lip 91 is shown in FIG. 1C as being at approximately the 5 o'clock position, other locations for the first pouring lip 91 on the bucket rim 30 fall within the scope for the present invention.

FIG. 1D is a perspective view from above of a bucket according to the invention, in which the bucket 5 includes a main compartment 16, a cup or cup compartment 20, a bucket base 11, a bucket rim 30, a bucket inner side 12*a*, a bucket outer side 12*b*, and a bucket inner basal edge 14. The bucket 5 further includes a bucket inner side straight section 12*a*' and a corresponding bucket outer side straight section 12*b*'. The bucket inner side straight section 12*a*' includes a straight section rim 30'. The left and right channels 71 and 81 are formed in the straight section rim 30' at a left edge of the straight section rim 30'*a* and the right edge of the straight section rim 30'*b*,respectively, as shown in FIG. 1C. The left and right channels 71 and 81 have left and right channel bases 74 and 84, respectively. The left and right channel bases 74 and 84 may each extend, to a greater or lesser extent, along the bucket inner side 12*a* towards the cup 20, to form left and right channel base extensions 74' and 84'. The left and right channel bases 74 and 84 are each lower than the straight section rim 30', which in turn is lower than the bucket rim 30. This allows for the facile transfer of liquid from the main compartment 16 to the cup 20. The left and right channel base extensions 74' and 84' may be at the same height from bucket base 11 as the left and right channel bases 74 and 84. Alternatively, the left and right channel base extensions 74' and 84' may slope downward toward the bucket base 11 as they extend towards the cup 20. In the latter case, the drainage of liquids from the left and right channel base extensions 74' and 84' to the cup 20 is facilitated.

Figure 1E:
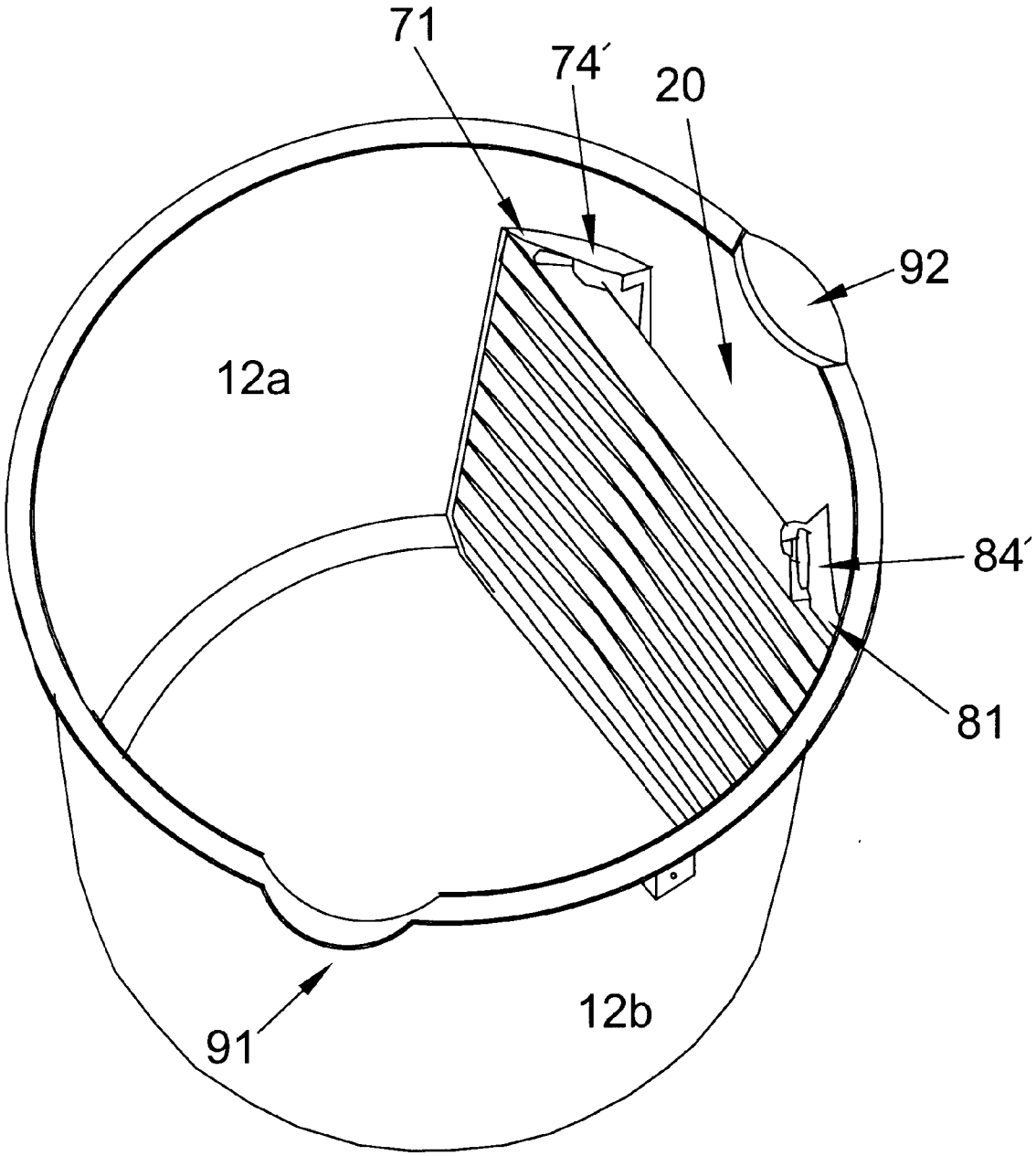
FIG. 1E is a second perspective view of the bucket shown in FIG. 1D.

FIG. 1E shows a different perspective view for the bucket described above in connection with FIG. 1D, and shows the relative locations of the left and right channels 71 and 81, as well as the first and second pouring lips 91 and 92 which are oriented approximately 120 degrees from each other.

Figure 1F:
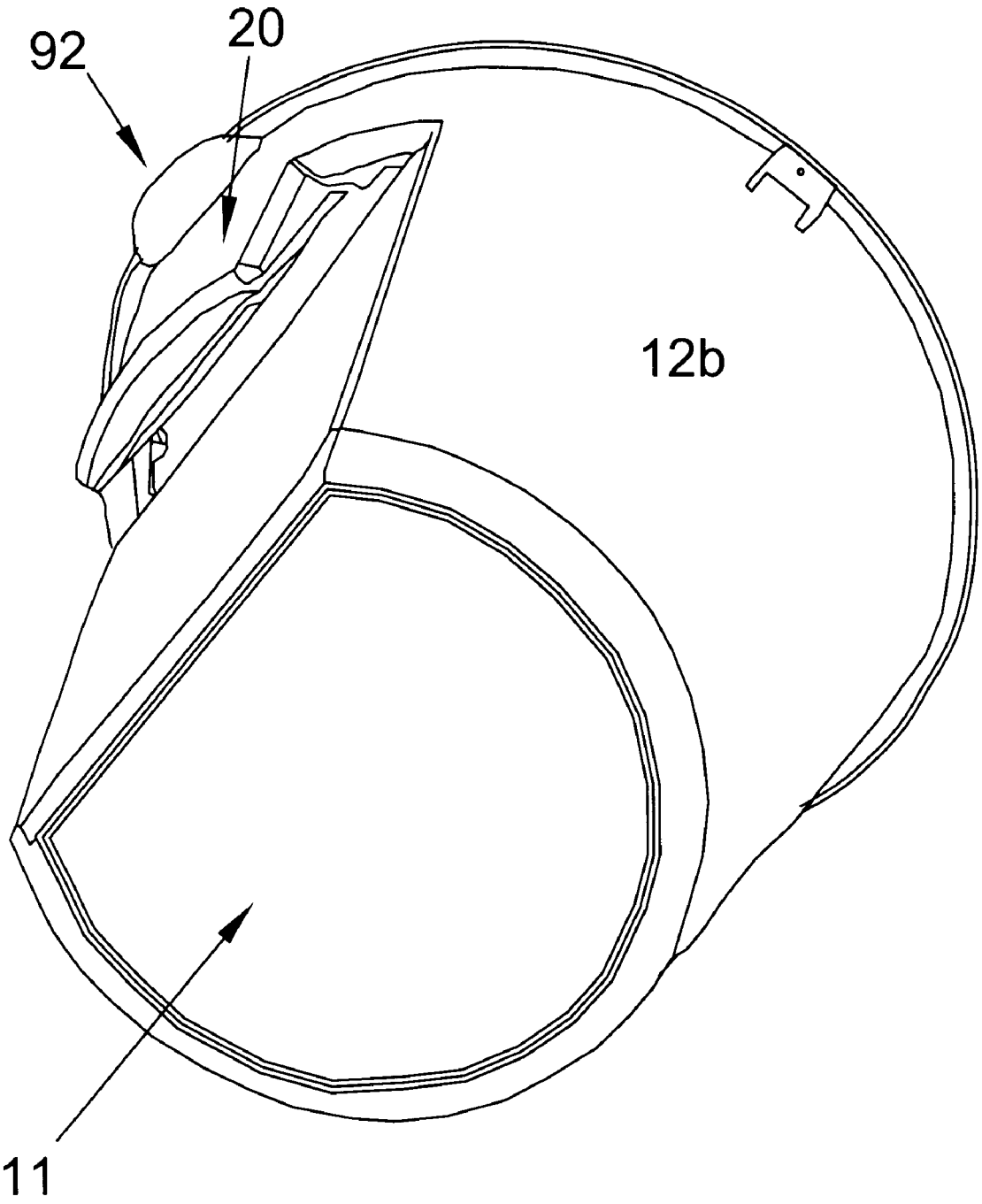
FIG. 1F is a third perspective view of the bucket shown in FIG. 1D.

FIG. 1F is a perspective view from below of the bucket shown in FIGS. 1D and 1E, and illustrates the shape of the bucket base 11 according to a preferred embodiment of the invention. The cup 20 is external to the bucket outer side 12*b* and abuts from the body 10 below the second pouring lip 92. Other than functioning to contain a relatively small volume of liquid and/or a paint brush or the like, the cup 20 may also function as a handle. For example, the cup 20 may be grasped by the hand of a user in order to hold or manipulate the bucket 5, or the bucket 5 may be suspended via the cup 20 from an object, e.g., a ladder rung.

Figure 1G:
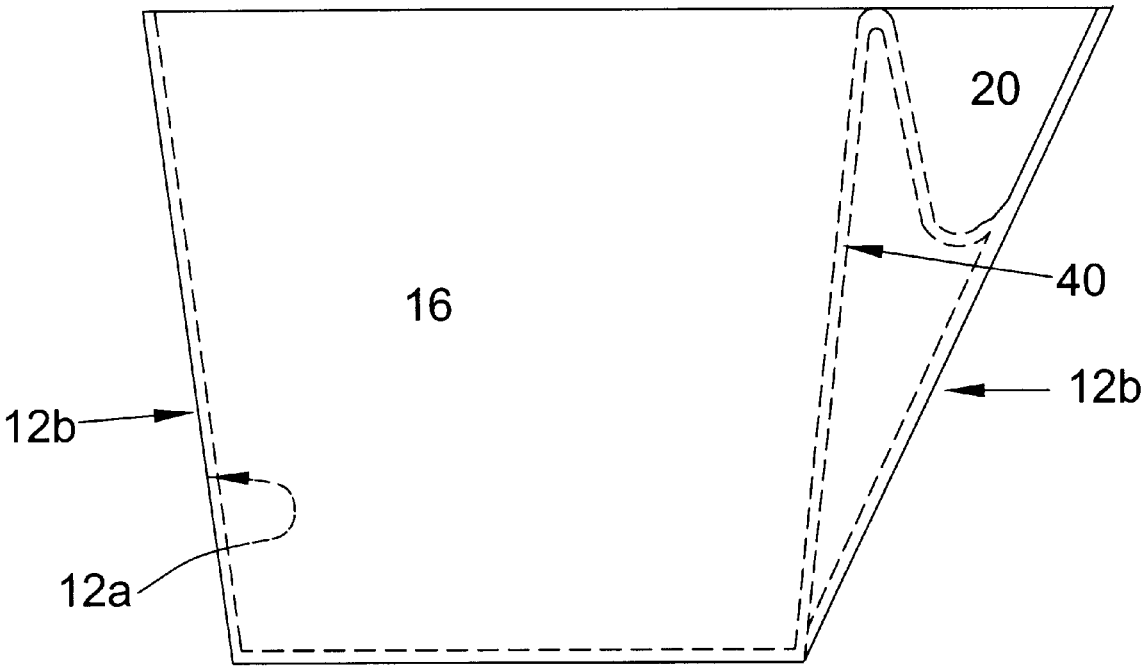
FIG. 1G is a sectional view of a bucket according to another embodiment of the invention, in which the bucket includes an internal wall and the cup compartment is internal to the bucket outer side.

FIG. 1G shows a sectional view of a bucket 5 according to another embodiment of the invention, in which the bucket 5 includes an internal wall, i.e., main wall 40, and the cup compartment 20 is internal to the bucket outer side 12*b*. The main compartment 16 is bounded by the bucket inner side 12*a* and the main wall 40. The main wall 40 provides a substantially planar surface suitable for distributing paint on a paint roller.

Figure 1H:
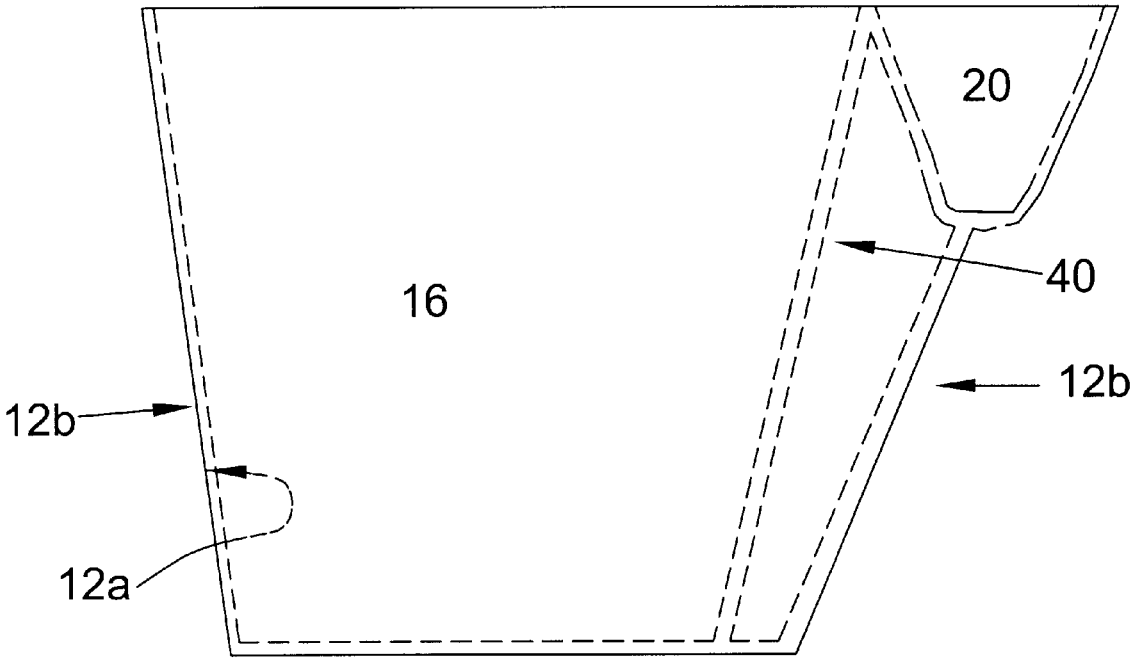
FIG. 1H is a sectional view of a bucket according to another embodiment of the invention, in which the bucket includes an internal wall and in which the cup compartment is partially internal and partially external to the bucket outer side.

FIG. 1H shows a sectional view of a bucket 5 according to another embodiment of the invention, in which the bucket 5 includes an internal divider, i.e., main wall 40, while the cup compartment 20 occupies a position somewhat intermediate between a position internal to the bucket outer side 12*b* (shown in FIG. 1G) and external to the bucket outer side 12*b* (shown in FIG. 1A), i.e., the cup compartment 20 may be partially internal to and partially external to the bucket outer side 12*b*. In the embodiment of FIG. 1H, the cup compartment 20 may protrude to a greater or lesser extent from the bucket outer side 12*b*. According to one embodiment, the cup 20 may protrude from the inner and outer sides 12*a* and 12*b* at a point below the second pouring spout 92, to a distance ranging from approximately 2 inches to approximately 4 inches. In the embodiment of FIG. 1H, the main wall 40 helps to define the main compartment 16, while providing a substantially planar surface suitable for distributing paint on a paint roller.

According to one embodiment of the invention, the bucket 5 includes at least one internal wall, i.e., a wall that is internal to the body 10 or within the bucket inner side 12*a*. The internal walls of the bucket 5 may be straight or variously curved.

Figure 2C:
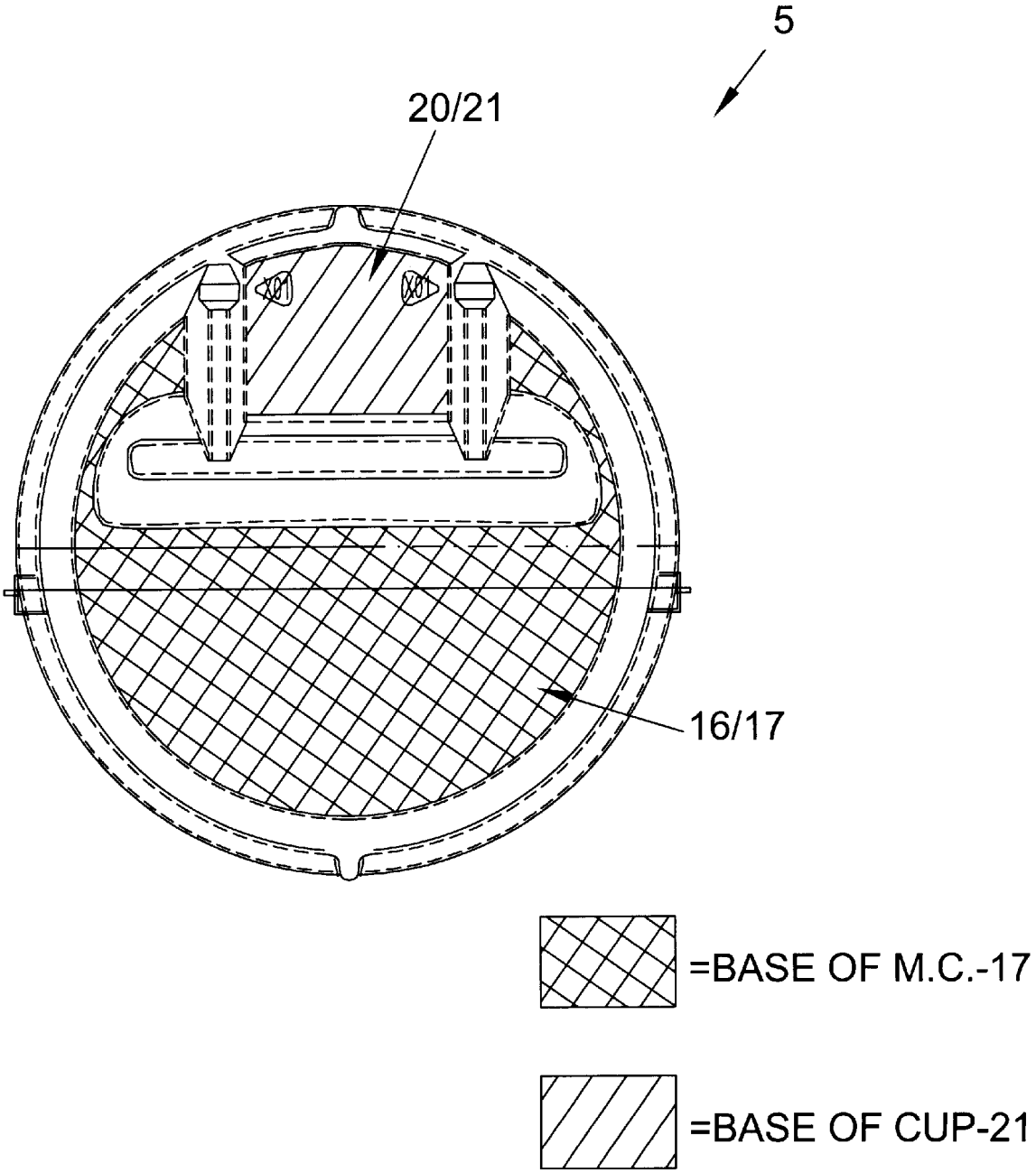
FIG. 2C is a second plan view of the bucket shown in FIG. 2A, in which the base of the main compartment is distinguished from the base of the cup compartment.
Figure 2D:
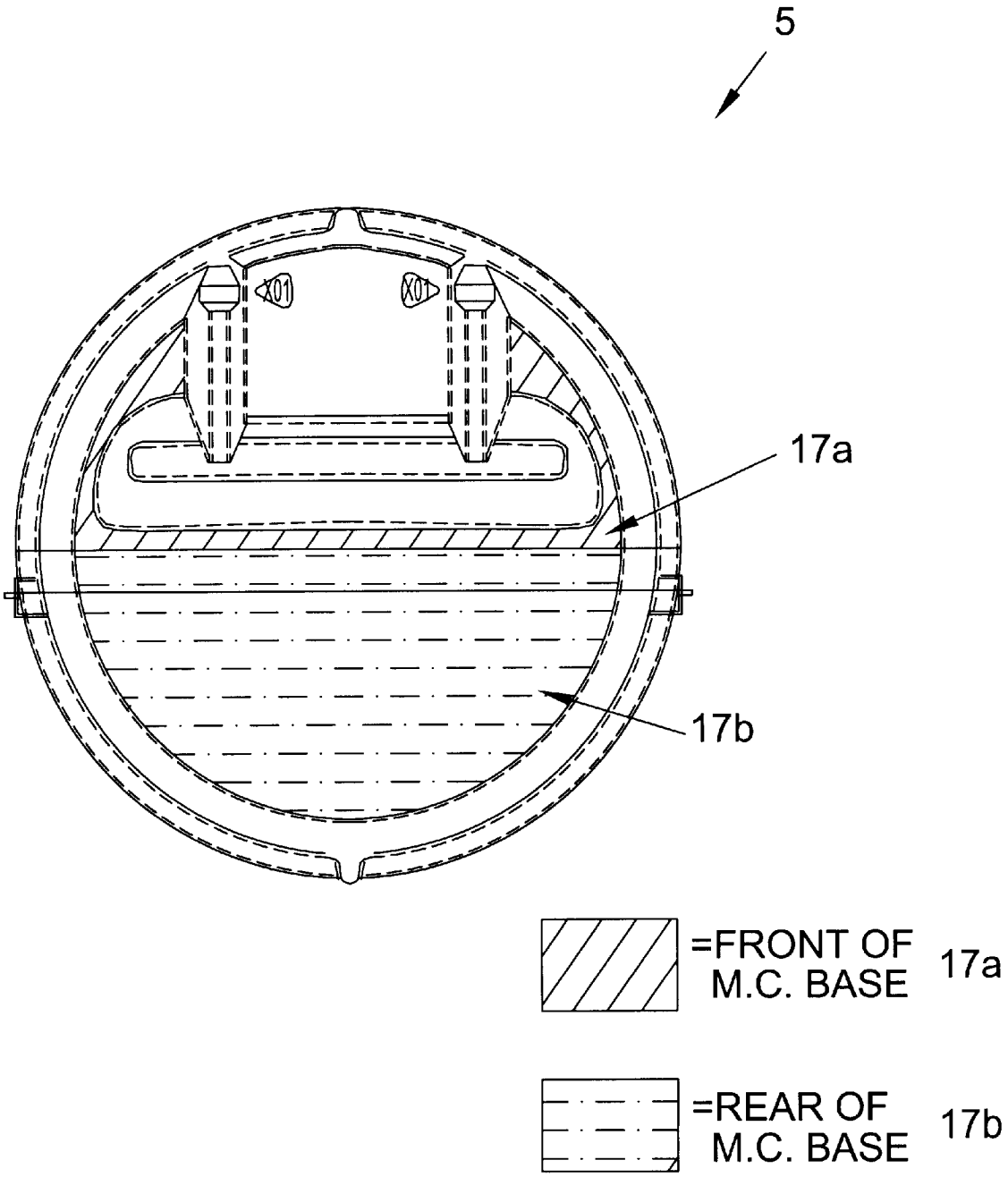
FIG. 2D is a third plan view of the bucket shown in FIG. 2A, which distinguishes the front portion of the main compartment base from the rear portion of the main compartment base.
Figure 2E:
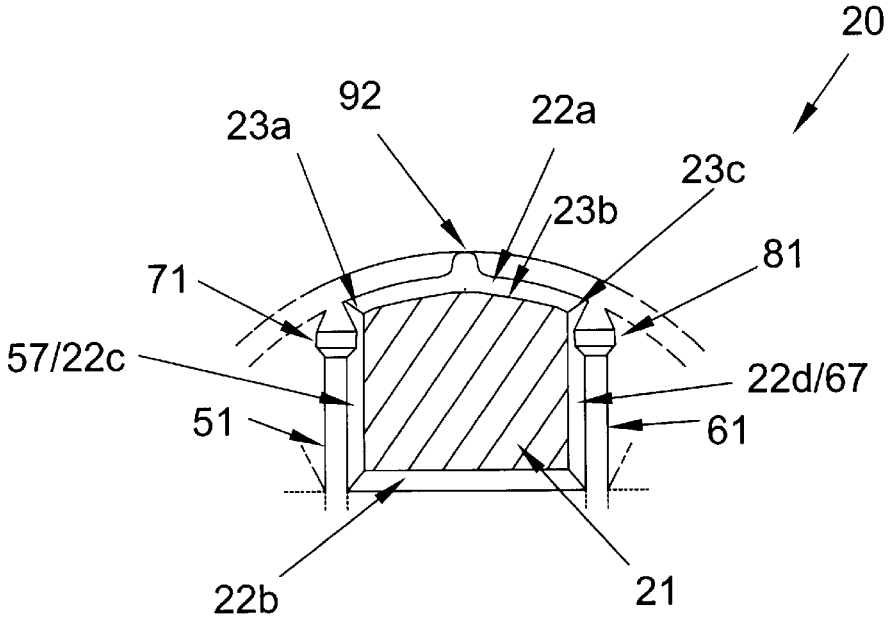
FIG. 2E is a fourth plan view of the bucket shown in FIG. 2A, showing details of the cup compartment.

FIG. 2A shows a bucket according to one embodiment of the invention, wherein the bucket 5 has, as internal walls, a main wall 40, and left (or first) and right (or second) tangential walls 51 and 61, respectively (shown in FIGS. 2A, 2E). The bucket 5, including the main compartment 16 and the cup compartment 20, may be made or formed as a unit from any suitable water-tight or liquid-proof material, such as various metallic materials that are formed or drawn, e.g., sheet metal or aluminum foil. Alternatively, the bucket 5 may be formed from various polymeric or plastic materials, e.g. polyurethane, polypropylene, or polyethylene (high density or low density). The bucket 5, including the integral cup compartment 20, is preferably made by a molding process from, for example, high density polyethylene (HDPE), as will be described herein below.

The relative positions of the bucket components internal to the bucket inner side 12*a*, according to one embodiment of the invention, can be seen in FIG. 2B. The bucket rim 30 is preferably approximately circular in shape, and includes outer rim 32 and inner rim 31. The inner rim 31 leads to the first pouring lip 91 and the second pouring lip 92, which are located diametrically opposite to each other at the 6 o'clock and the 12 o'clock positions of the bucket rim 30. According to the embodiments of the bucket 5, as described herein, the first pouring lip 91 is preferably used for decanting or pouring liquids from the main compartment 16, while the second pouring lip 92 is preferably used for pouring liquids from the cup compartment 20. The main compartment 16 may be defined as the internal part of the bucket 5 for containing a liquid apart from the cup 20. The upper part of the cup 20 on each side of the second pouring lip 92 terminates at the front part of the bucket rim 30.

A main wall 40 extends from the approximately 10 o'clock position to the approximately 2 o'clock position and includes a main wall top 48, the height of which may be flush with the bucket rim 30 of the bucket 5. The main wall 40, including a main wall outer side 42 and a main wall top 48, is preferably continuous, i.e., there are no channels or other types of interruptions within the main wall 40. The main wall 40 provides a substantially planar surface suitable for distributing paint on a paint roller.

The main wall 40 further includes a basal perimeter 47 having an inner basal perimeter 47*a* and an outer basal perimeter 47*b*. As shown in FIGS. 2A and 2B, left and right tangential, or joining, walls 51 and 61 each form a tangent with inner side 12*a* at approximately the 11 o'clock and 1 o'clock positions, respectively. Each of the left and right tangential walls 51 and 61 intersect the main wall 40 at approximately a right angle. Thus, the left and right tangential walls 51 and 61 are each contiguous with and abut against the inner side 12*a* and the main wall 40, and together with the bucket inner side 12*a* and the main wall outer side 42 form the cup compartment or the cup 20 adjacent to the second pouring lip 92. The cup 20 is therefore integral with the body 10 of the bucket 5. The exact point and angle of contact of the left and right tangential walls 51 and 61 with the main wall 40 and the bucket inner side 12*a* may vary depending on the particular position, size, and shape required of the cup compartment 20.

FIG. 2C is a plan view of a bucket showing the distinction between the main compartment base 17 and the cup compartment base 21, according to one embodiment of the invention. FIG. 2C also shows the location of the main compartment 16 relative to the cup compartment 20. The main compartment base 17 may be contiguous with, or represent the obverse side of the bucket base 11 (see, e.g., FIG. 3). The surface area of the main compartment base 17 is substantially greater than the surface area of the cup compartment base 21. The ratio of the surface area of the main compartment base 17 to the surface area of the cup compartment base 21 preferably ranges from approximately 10:1 to approximately 3:1, more preferably from approximately 9:1 to approximately 4:1, and most preferably is approximately 8:1.

FIG. 2D is a plan view of a bucket which shows the distinction between the front main compartment base 17*a* and the rear main compartment base 17*b*, according to one embodiment of the invention. For purposes of this discussion, the front main compartment base 17*a* is that part of the main compartment base 17 which extends above an imaginary diametric line drawn across the bucket between the approximately 3 o'clock and 9 o'clock positions, and the rear main compartment base 17*b* is the remaining portion of the main compartment base 17. It can be seen that, due to the presence of the main wall 40 and, in particular, due to the presence of the basal perimeter 47 of the main wall 40, the surface area of the front main compartment base 17*a* is substantially less than the surface area of the rear main compartment base 17*b*. As will be described fully below, the ratio of the surface area of the front main compartment base 17*a* to the surface area of the rear main compartment base 17*b* is an important parameter in determining the manner and relative ease with which a liquid may be transferred from the main compartment 16 to the cup 20. The ratio of the surface area of the front main compartment base 17*a* to the surface area of the rear main compartment base 17*b* preferably ranges from approximately 25:1 to approximately 4:1, and more preferably from approximately 20:1 to approximately 10:1.

FIG. 2E is a plan view of the bucket 5 showing the details of the cup compartment 20, which lies symmetrically about the second pouring spout 92. When the bucket 5 and its integral cup 20 are tilted to a sufficient extent towards the 12 o'clock position, the contents, if any, of the cup 20 may be conveniently poured from the pouring lip 92. The cup 20 has cup outer, inner, left and right sides 22*a*–22*d*, respectively, as well as a cup base 21. The cup outer side 22*a* may be formed by the bucket inner side 12*a* or, alternatively, the cup outer side 22*a* may protrude from the bucket inner and outer sides 12*a* and 12*b* at left, lower, and right cup outer edges 23*a*–23*c*, respectively. The cup inner side 22*b* is formed by the main wall outer side 42 (shown in FIG. 2F). The cup left side 22*c* is formed by the right side 57 of the first tangential wall 51, and the cup right side 22*d* is formed by the right side 67 of the second tangential wall 61.

The height of the bucket rim 30 from the cup base 21 may be considerably less than the height of the bucket rim 30 from the main compartment base 17. Indeed, the ratio of the height of the bucket rim 30 from the main compartment base 17 to the height of the bucket rim 30 from the cup base 21 may range from approximately 10:9 to approximately 10:1. According to one embodiment of the invention, the preferred ratio of the height of the bucket rim 30 from the main compartment base 17 to the height of the bucket rim 30 from the cup base 21 is approximately 10:6.

One feature of the bucket 5, in accordance with the invention, is that the surface area of the cup base 21 may be considerably less than the surface area of the main compartment base 17. According to the invention, the ratio of the surface area of the main compartment base 17 to the surface area of the cup base 21 may range from approximately 10:8 to approximately 25:1. According to one embodiment of the invention, the preferred ratio of the surface area of the main compartment base 17 to the surface area of the cup base 21 is approximately 12:1.

Figure 2F:
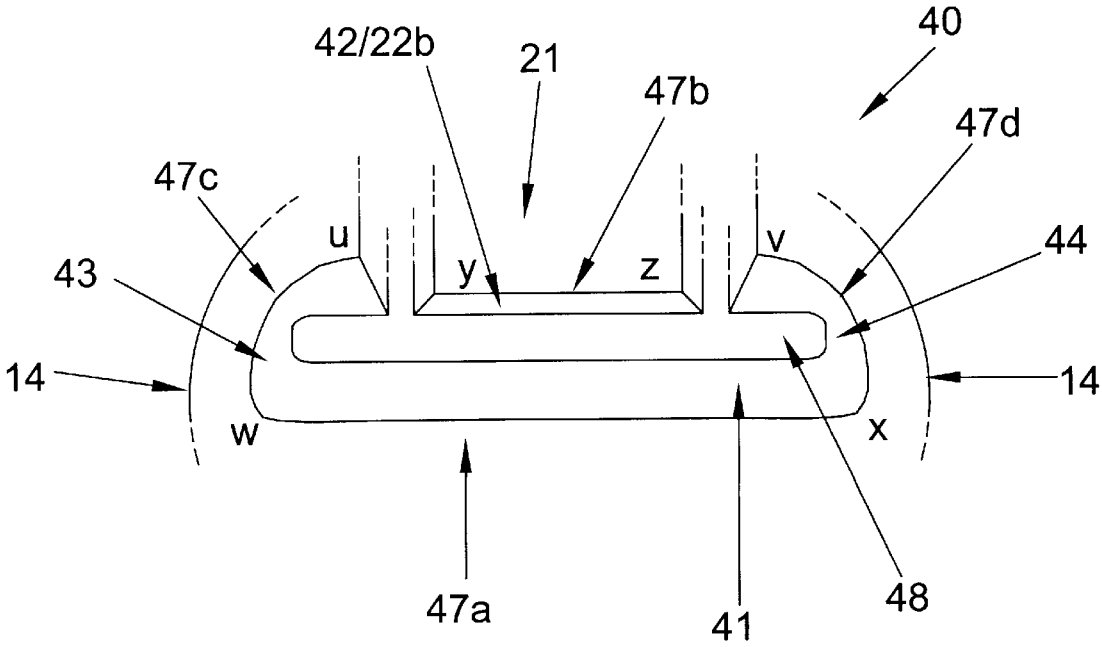
FIG. 2F is a fifth plan view of the bucket shown in FIG. 2A, showing details of the main wall.

FIG. 2F is a plan view of the bucket 5 showing details of the main wall 40, according to one embodiment of the invention. The main wall 40 includes a main wall inner side 41, a main wall outer side 42, a left rounded edge 43, a right rounded edge 44, a main wall top 48, and a main wall basal perimeter 47. The main wall outer side 42 includes a cup inner side 22*b*. The main wall basal perimeter 47 includes an inner basal perimeter 47*a*, an outer basal perimeter 47*b*, a left basal perimeter 47*c*, and a right basal perimeter 47*d*. The inner basal perimeter 47*a* and the outer basal perimeter 47*b* are shown as substantially parallel lines W-X and Y-Z, respectively, in FIG. 2F. The left basal perimeter 47*c*, and the right basal perimeter 47*d* are shown as curved or arcuate lines W-U and X-V, respectively, in FIG. 2F. The main wall basal perimeter 47 is contiguous with the main compartment base 17. The main wall top 48 has a main wall top perimeter 49 which is substantially rectangular in shape. The main wall top perimeter 49 is substantially less than the main wall basal perimeter 47, and the main wall 40 may assume an overall wedge-like shape. The relatively large size of the main wall basal perimeter 47 accounts for the relatively small surface area of the front main compartment base 17*a*, as compared with the surface area of the rear main compartment base 17*b*. As discussed above, the ratio of the surface area of the front main compartment base 17*a* to the surface area of the rear main compartment base 17*b* is an important parameter of the bucket 5, according to certain embodiments of the invention.

Specifically, the ratio of the surface area of the front main compartment base 17*a* to the surface area of the rear main compartment base 17*b* is an important parameter in determining the manner in which a liquid may be transferred between the main compartment 16 and the cup compartment 20. Thus, for a bucket having a main compartment base of a given surface area, the size of the main wall basal perimeter 47 is itself an important parameter of the bucket 5, according to the invention. Preferably, the ratio of the surface area occupied within the main wall basal perimeter 47 to the surface area of the front main compartment base 17*a* is from approximately 10:1 to approximately 1:1, more preferably from approximately 7:1 to approximately 2:1, and most preferably approximately 4:1.

Figure 3:
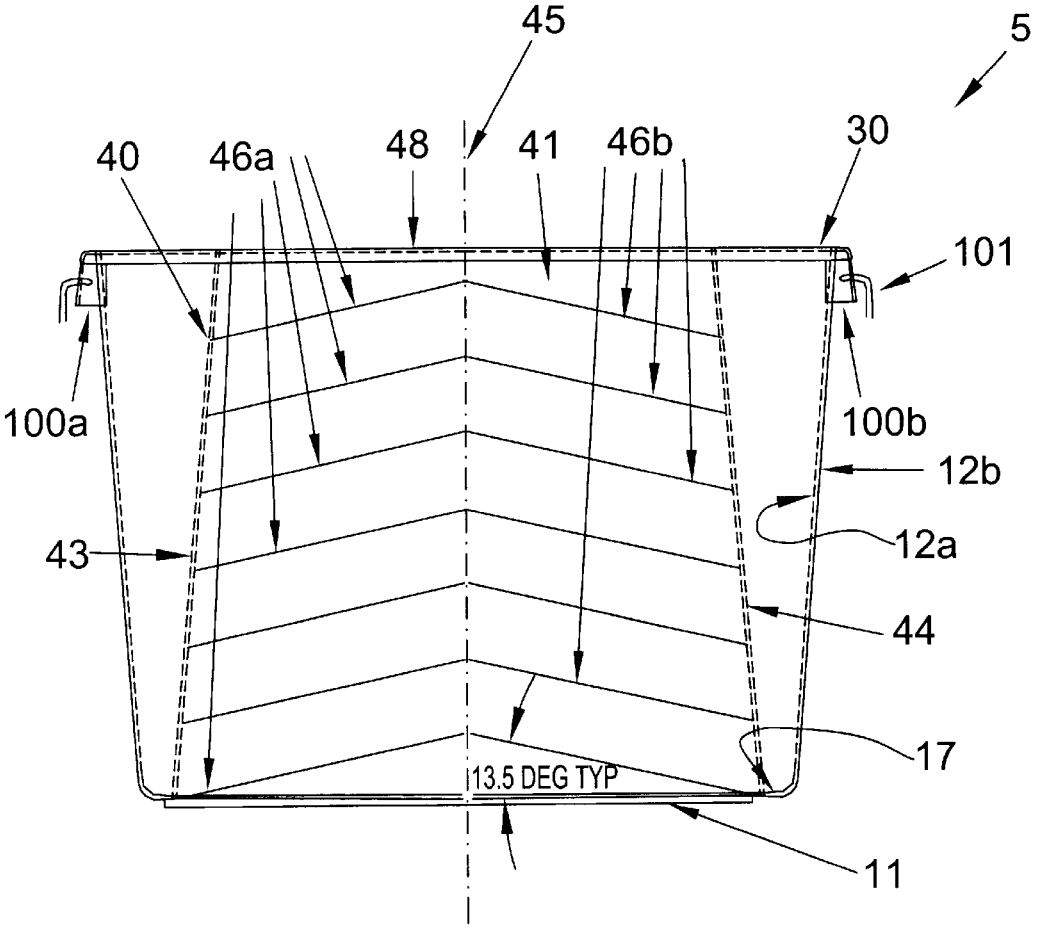
FIG. 3 is a sectional view taken along the section line 3—3 of FIG. 2B.

FIG. 3 is a vertical sectional view of the bucket 5, taken along the section line 3—3 of FIG. 2B, showing the relative location of the main wall 40, and a frontal view of the main wall inner side 41, according to one embodiment of the invention. Left and right rounded edges 43 and 44 each taper away from the inner and outer bucket sides 12*a* and 12*b* towards the main wall top 48. The bucket rim 30 is flush with the main wall top 48 in the vertical plane, i.e., the bucket rim 30 and the main wall top 48 are of the same height or of substantially the same height. The main wall inner side 41 includes a plurality of left indentations 46*a* and a plurality of right indentations 46*b* on its left and right sides, respectively. Each left indentation 46*a* converges with a corresponding right indentation 46*b* at the main wall inner side mid-point, shown as line 45 in FIG. 3. The left indentations 46*a* are substantially parallel to each other, as are the right indentations 46*b*. Each left indentation 46*a* and each right indentation 46*b* slopes downward from the midpoint 45 towards the left and right rounded edges 43 and 44, respectively. The angle at which the left and right indentations 46*a* and 46*b* slope downward may range from approximately 10° to approximately 16°, more preferably from approximately 12° to approximately 15°, and most preferably at an angle of approximately 13.5°.

The main wall inner side 41 may serve as a surface for applying and distributing a liquid, such as paint contained in the main compartment 16, to a paint roller. In this regard, the main wall inner side 41 is functionally analogous to the bucket inner side straight section 12*a*' (shown in FIG. 1B). In this case, the purpose of the left and right indentations 46*a* and 46*b* is to promote drainage of the liquid from the main wall inner side 41 to the main compartment 16. The spacing between each of the left and right indentations 46*a* and 46*b* may range from several inches to a few millimeters. The spacing between each of the left and right indentations 46*a* and 46*b* preferably ranges from approximately 5 inches to approximately 0.5 inch, more preferably from approximately 3 inches to approximately 1 inch, and most preferably approximately 0.94 inch.

Figure 4:
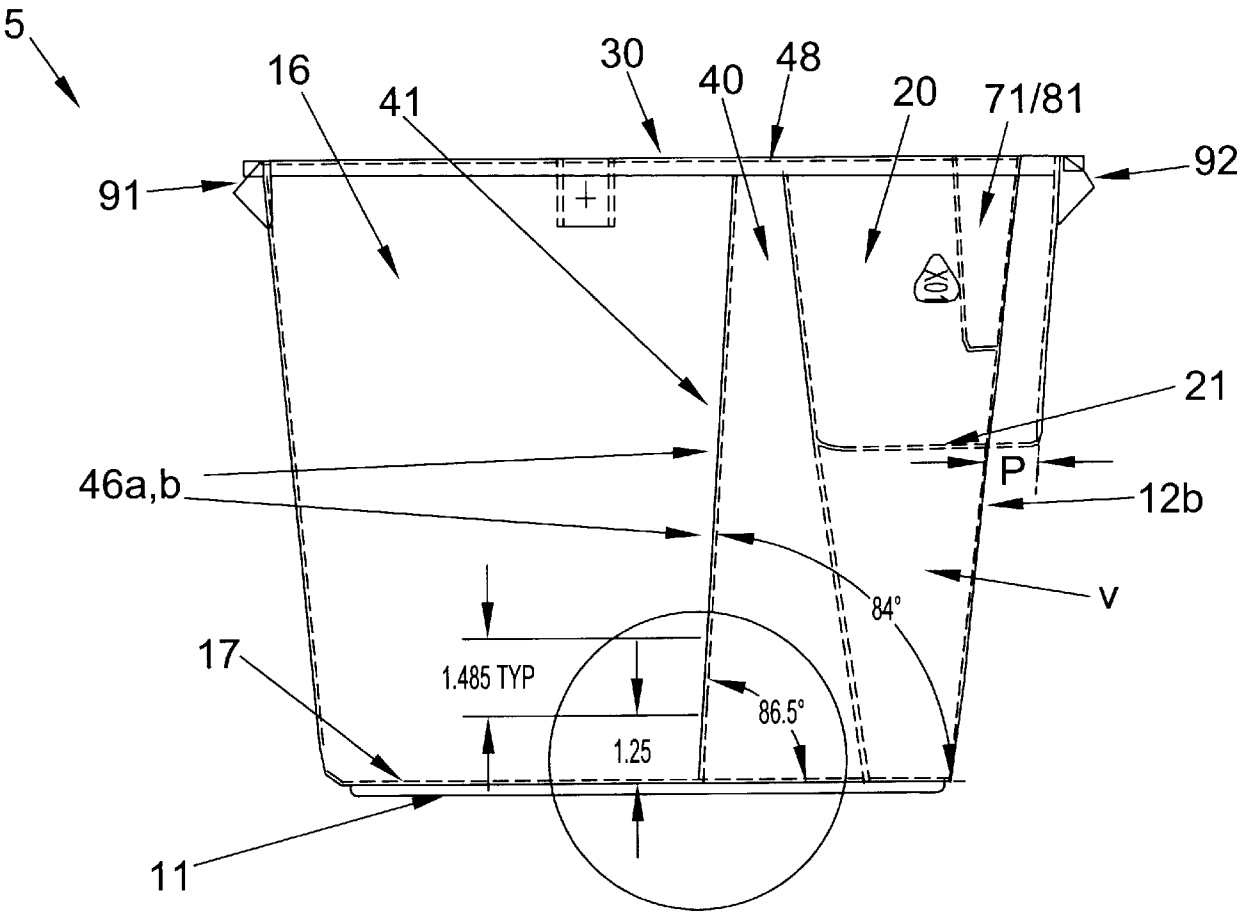
FIG. 4 is a sectional view taken along the section line 4—4 of FIG. 2B.

FIG. 4 is a sectional view of the bucket 5 taken along the section line 4—4 of FIG. 2B. FIG. 4 shows the first pouring lip 91, the main compartment 16, the main wall 40, the cup compartment 20, the left and right channels 71 and 81, and the second pouring lip 92 in cross-section. Beneath the cup 20 there is a void or dead space, labeled as V in FIG. 4, which is formed jointly by the bucket inner side 12*a*, the underside of the cup base 21, the lower part of the main wall outer side 42, and the lower parts of the left and right tangential walls 51 and 61. The main wall inner side 41 may slope towards the cup 20 to form an angle with the bucket base 11 preferably ranging from approximately 79° to approximately 89°, more preferably the main wall inner side 41 forms an angle with the bucket base 11 ranging from approximately 82° to approximately 86°, and most preferably the main wall inner side 41 forms an angle with the bucket base 11 of approximately 84°.

The front part of the cup base 21, and the left and right tangential walls 51 and 61, may protrude from the bucket inner and outer sides 12*a* and 12*b* to a distance P, as shown in FIG. 4. According to various embodiments of the invention, the distance P may vary to a greater or lesser extent. Generally, the distance P ranges from 0 to approximately 6 inches, more preferably from approximately 0.25 inch to 2 inches, and most preferably the distance P is approximately 1.75 inches.

The left and right indentations 46*a* and 46*b* are shown in FIG. 4 as step-like indentations. However, other types of indentations or topographical patterns on the main wall inner side 41 fall within the scope of the present invention, provided that such indentations promote the drainage of liquid from the main wall inner side 41 to the main compartment 16.

Figure 5:
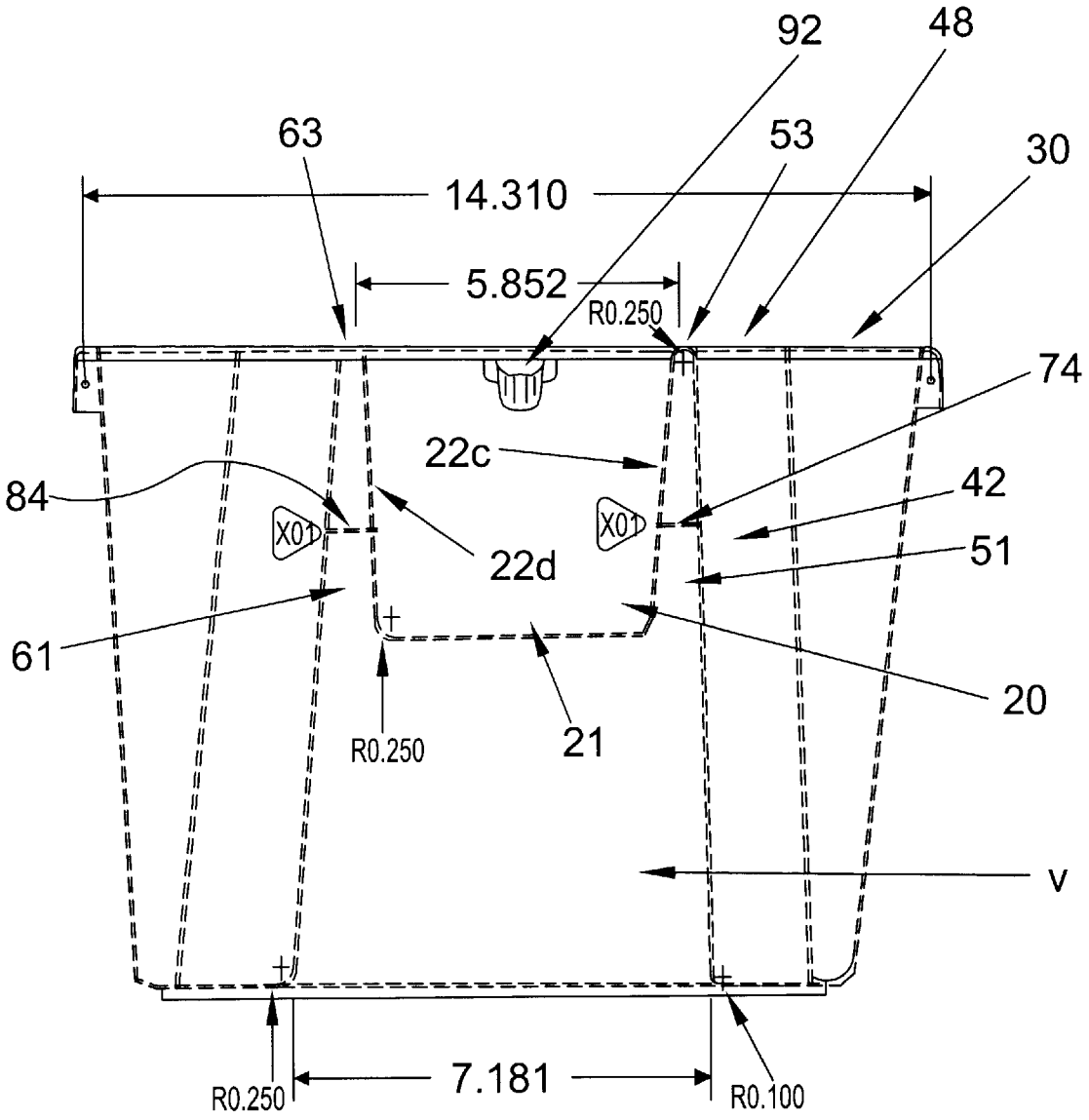
FIG. 5 is a sectional view taken along the section line 5—5 of FIG. 2B.

FIG. 5 is a sectional view taken along the section line 5—5 of FIG. 2B, according to one embodiment of the invention. FIG. 5 shows a frontal view of a vertical section of the bucket 5, including the second pouring lip 92, the cup 20, the main wall outer side 42, the left and right tangential walls 51 and 61, and the left and right channel bases 74 and 84. As viewed from the front, the left and right tangential walls 51 and 61 appear to the right and left of FIG. 5, respectively. The cup 20 includes the cup base 21, and the left and right sides 22*c* and 22*d*, respectively. FIG. 5 also shows the bucket rim 30, the main wall top 48, the left tangential wall top 53 and the right tangential wall top 63. In the particular embodiment shown in FIG. 5, the bucket rim 30, the main wall top 48, the left tangential wall top 53 and the right tangential wall top 63 all have the same or substantially the same height.

Figure 6:
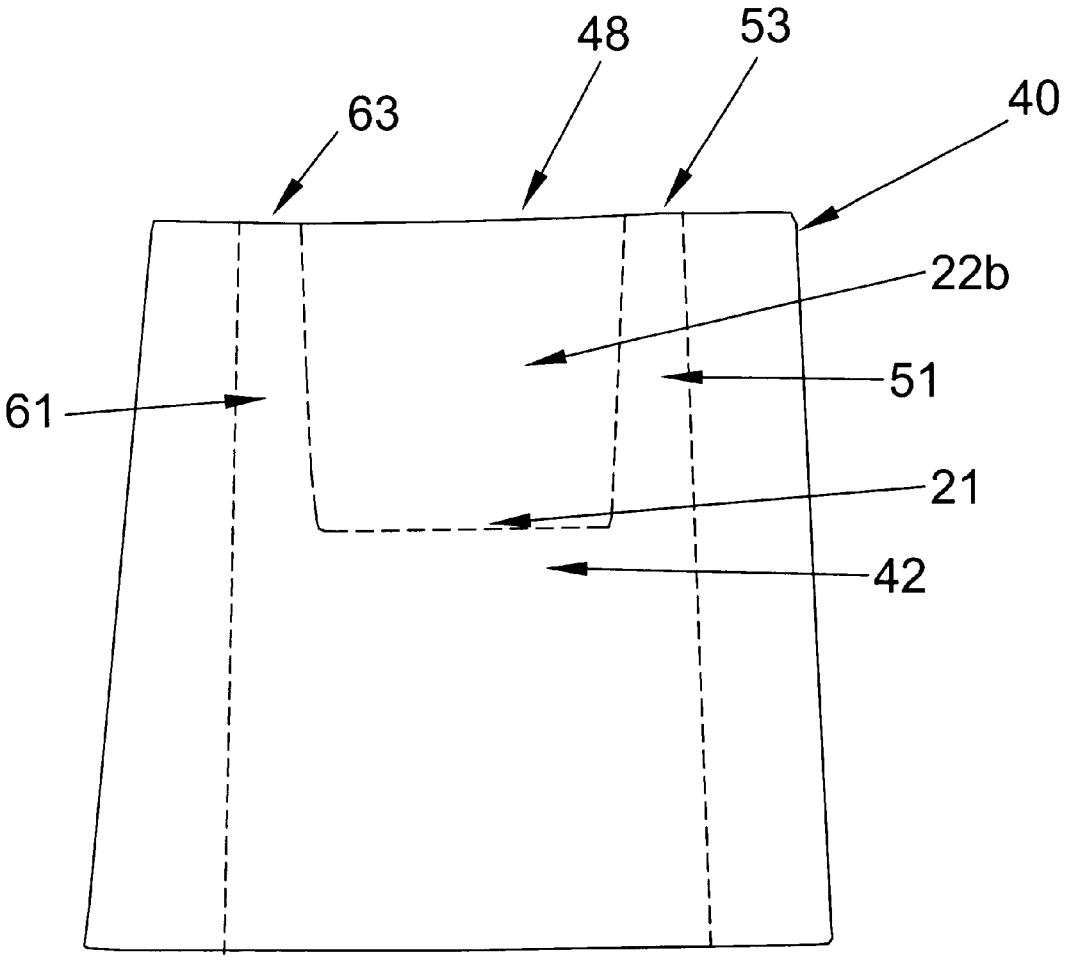
FIG. 6 is a frontal view of the main wall of a bucket showing the relative position of first and second tangential walls, and the cup compartment, according to one embodiment of the invention.

FIG. 6 is a frontal view of the bucket 5 according to one embodiment of the invention, with the body 10 of the bucket 5 removed for the sake of clarity, and showing the main wall outer side 42. The position of the left and right tangential walls 51 and 61, with respect to the main wall 40 and the cup compartment 20 are clearly illustrated in FIG. 6.

Figure 7:
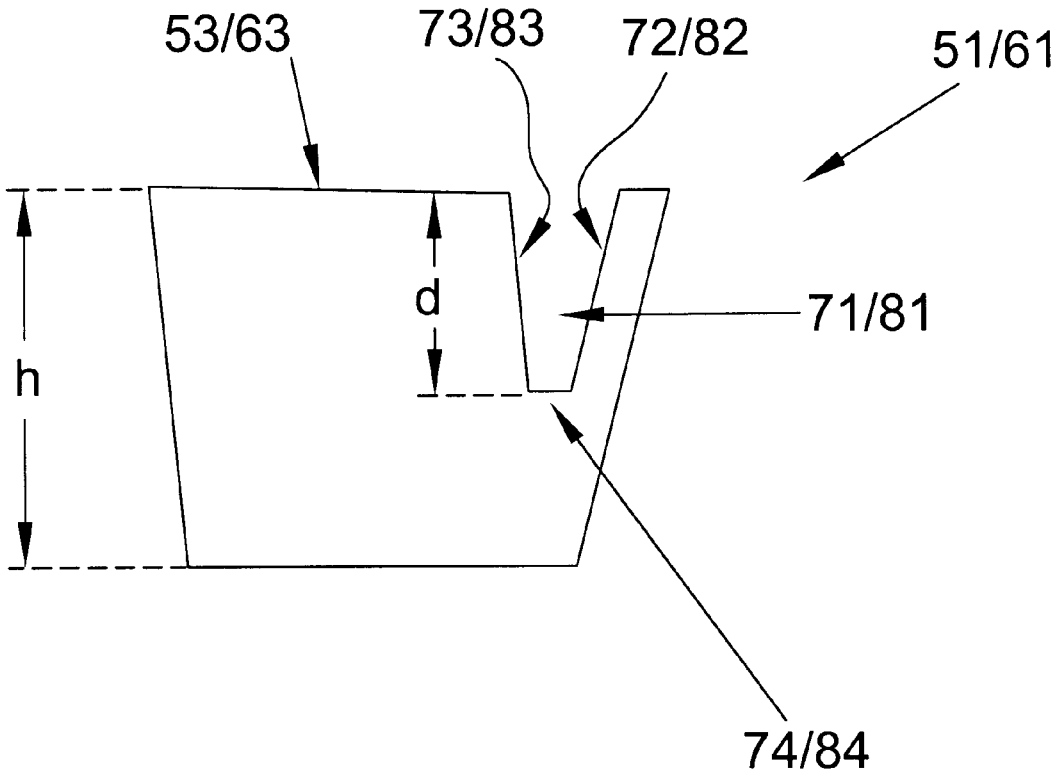
FIG. 7 is a side view of a tangential wall of a bucket showing a channel in the tangential wall, according to one embodiment of the invention.

FIG. 7 is a side view of the tangential walls 51 or 61 of the bucket 5, according to one embodiment of the invention. The tangential walls 51 or 61, shown in FIG. 7, may represent either the left tangential wall 51, as seen from within the cup 20, or may represent the right tangential wall 61 as seen from outside the cup 20. The left and right channels 71 and 81 in the tangential walls 51 and 61 are formed by the outer faces 72 and 82 and inner faces 73 and 83 which taper together towards the bases 74 and 84. The depth d of the left and right channels 71 and 81 may vary according to the height h of the tangential walls 51 and 61. The ratio of the height h to the depth d preferably falls in the range of approximately 10:2 to approximately 10:8, more preferably the ratio of the height h to the depth d falls in the range of approximately 10:4 to approximately 10:7, and most preferably the ratio of the height h to depth d is approximately 10:6.

The left and right channels 71 and 81 may be located at various positions in the left and right tangential walls 51 and 61. However, the channel outer faces 72 and 82 are preferably located from approximately 55% to approximately 100% of the distance from the main wall 40 to the bucket inner side 12*a*. Thus, in the extreme case where the left and right channels 71 and 81 are located at 100% of the distance from the main wall 40 to the bucket inner side 12*a*, the channel outer faces 72 and 82 become, or are replaced by, the bucket inner side 12*a*. More preferably, the channel outer faces 72 and 82 are located at approximately 75% to approximately 95% of the distance from the main wall 40 to the bucket inner side 12*a*.

The distance between the channel inner faces 73 and 83 and the channel outer faces 72 and 82, i.e., the distance corresponding to the width of the left or right channel 71 and 81, may vary depending on the viscosity of a liquid to be contained and/or transferred within the bucket 5. Generally, the distance between the channel inner faces 73 and 83, and the channel outer faces 72 and 82 will be from approximately 1/25 to approximately 1/3 of the total distance between the main wall 40 and the bucket inner side 12*a*.

Whereas the left and right channels 71 and 81 shown in FIG. 5 are generally wedge-shaped, with the outer faces 72 and 82 and the inner faces 74 and 84 tapering downward, other shapes for the channels fall within the scope of the present invention. Similarly, while a single left or right channel 71 and 81 is shown in each tangential wall 51 and 61, two or more channels or perforations in each of the tangential walls 51 and 61 may be used according to other embodiments of the invention.

Figure 8:
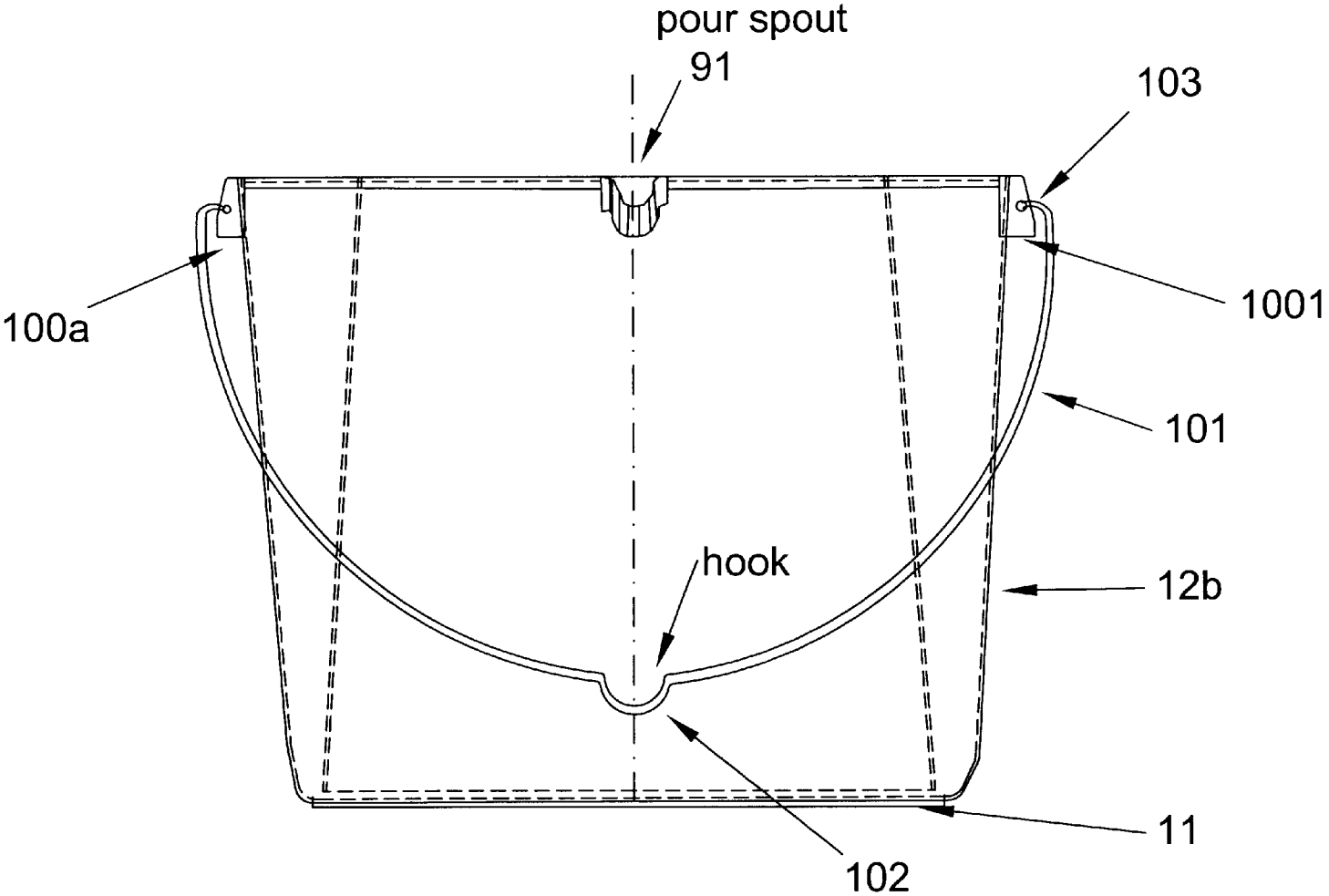
FIG. 8 is a side view of a bucket from the rear showing a first pouring lip and a handle, according to one embodiment of the invention.

The bucket 5 in its various embodiments may optionally include a handle 101. FIG. 8 is a side view of the bucket 5 showing the first pouring lip 91 and a handle 101 draped or leaning against the bucket outer side 12*b*. According to one embodiment of the invention, the handle 101 is composed of a wire having a cylindrical cross-section, and of a sufficient gauge to adequately support the weight of the bucket 5, including its component parts and any contents contained in the bucket 5. The handle 101 is attached to the left and right handle brackets 100*a* and 100*b*. A handle hook 102 may be included in the handle 101 at a point equidistant or substantially equidistant from the left and right handle brackets 100*a* and 100*b*. The handle hook 102 may conveniently serve to hang the bucket 5 from a crook, a paint hook, or a horizontal support via the handle 101. The handle 101 is attached to the left and right handle brackets 100*a* and 100*b* via the left and right handle sockets 103*a* and 103*b*, respectively. The left and right handle brackets 100*a* and 100*b* are, in turn, attached to the body 10 of the bucket 5 near the bucket rim 30, at approximately the 8 o'clock and approximately the 4 o'clock positions, respectively, as shown in FIG. 2B. Other locations for the left and right handle brackets 100*a* and 100*b* also fall within the scope of the present invention, e.g., 9 o'clock and 3 o'clock, 8 o'clock and 3 o'clock, and 9 o'clock and 4 o'clock.

Figure 9A:
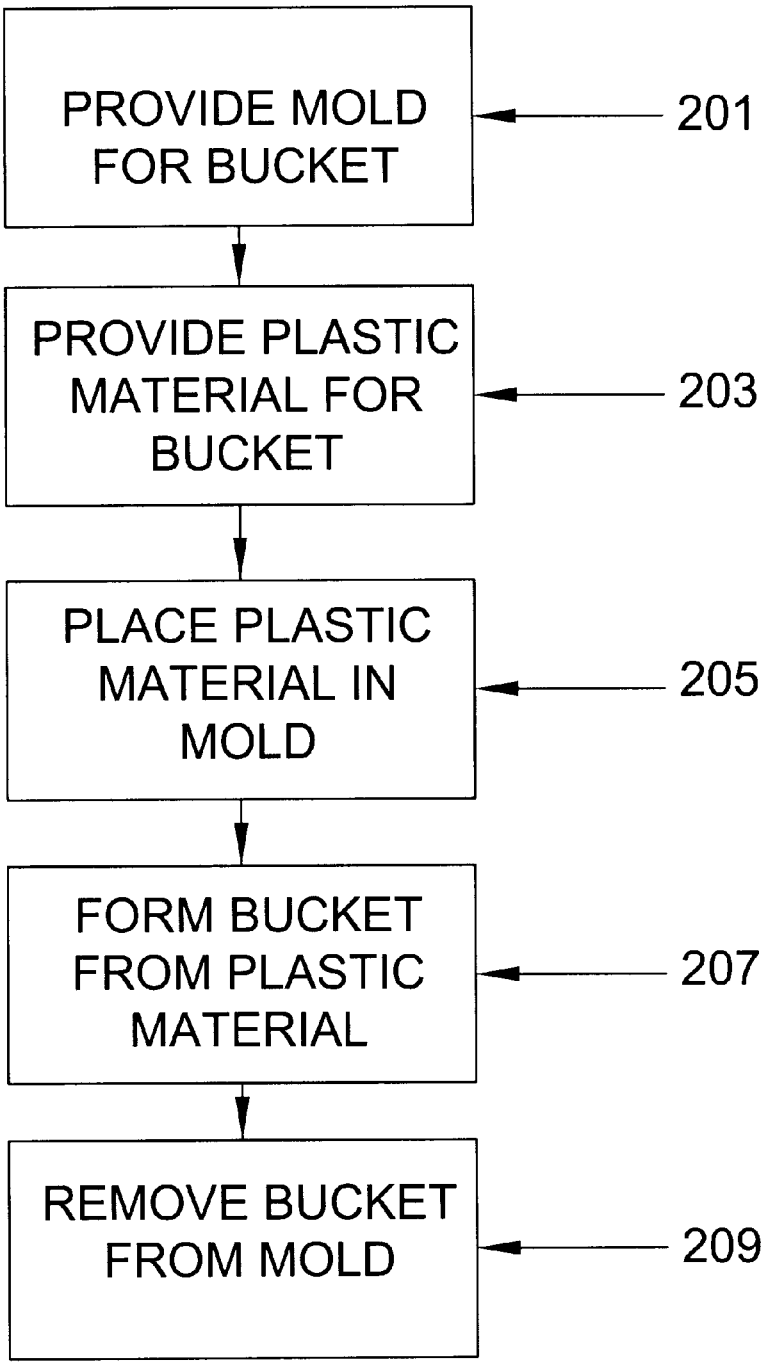
FIG. 9A is a flow chart of steps involved in a method of making a plastic bucket, according to another embodiment of the invention.

FIG. 9A is a flow chart of steps involved in a preferred method of making a plastic bucket, according to another embodiment of the invention, in which step 201 involves providing a bucket mold for the bucket 5. The bucket mold provided in step 201 may be either male or female, as is well known in the art. By definition a mold for the bucket 5 will have certain features, elements, or portions which correspond to the features and elements of the bucket 5 described above in connection with FIGS. 1–8. Thus, step 201 involves providing a bucket mold which may include a body portion, a bucket base portion, a bucket outer side portion, a main compartment portion, a cup compartment portion, and a channel portion disposed between the main compartment portion and the cup compartment portion. The bucket mold provided in step 201 may further include an internal wall portion or a bucket inner side straight section portion. Further, a bucket rim portion of the bucket mold may include at least one pouring lip portion. According to different embodiments of the invention, the cup compartment portion of the bucket mold may be internal, external, or partially external to the bucket outer side portion of the bucket mold.

According to a preferred embodiment of the invention, the bucket body 10, including the main compartment 16 and the integral cup 20, are formed as a unit by molding them from a single type of plastic material and, consequently, the body 10, the cup 20, as well as the other internal components of the bucket 5 will preferably share a common composition.

Step 203 involves providing plastic or other suitable material from which the bucket 5 is to be formed. The plastic or other material provided in step 203 will be referred to hereinafter as the bucket material or the first material, in order to distinguish it from a liner or second material provided for forming a liner (shown in FIGS. 17 and 18). A preferred bucket material provided in step 203, and from which the bucket 5 is to be formed, is plastic material, e.g., polyethylene, preferably high density polyethylene. Step 205 involves placing the bucket material provided in step 203 into the bucket mold provided in step 201. Next, at step 207, the bucket 5 is formed from the bucket material provided in step 203. Finally, in step 209, the bucket 5 is removed from the bucket mold provided in step 201.

Figure 9B:
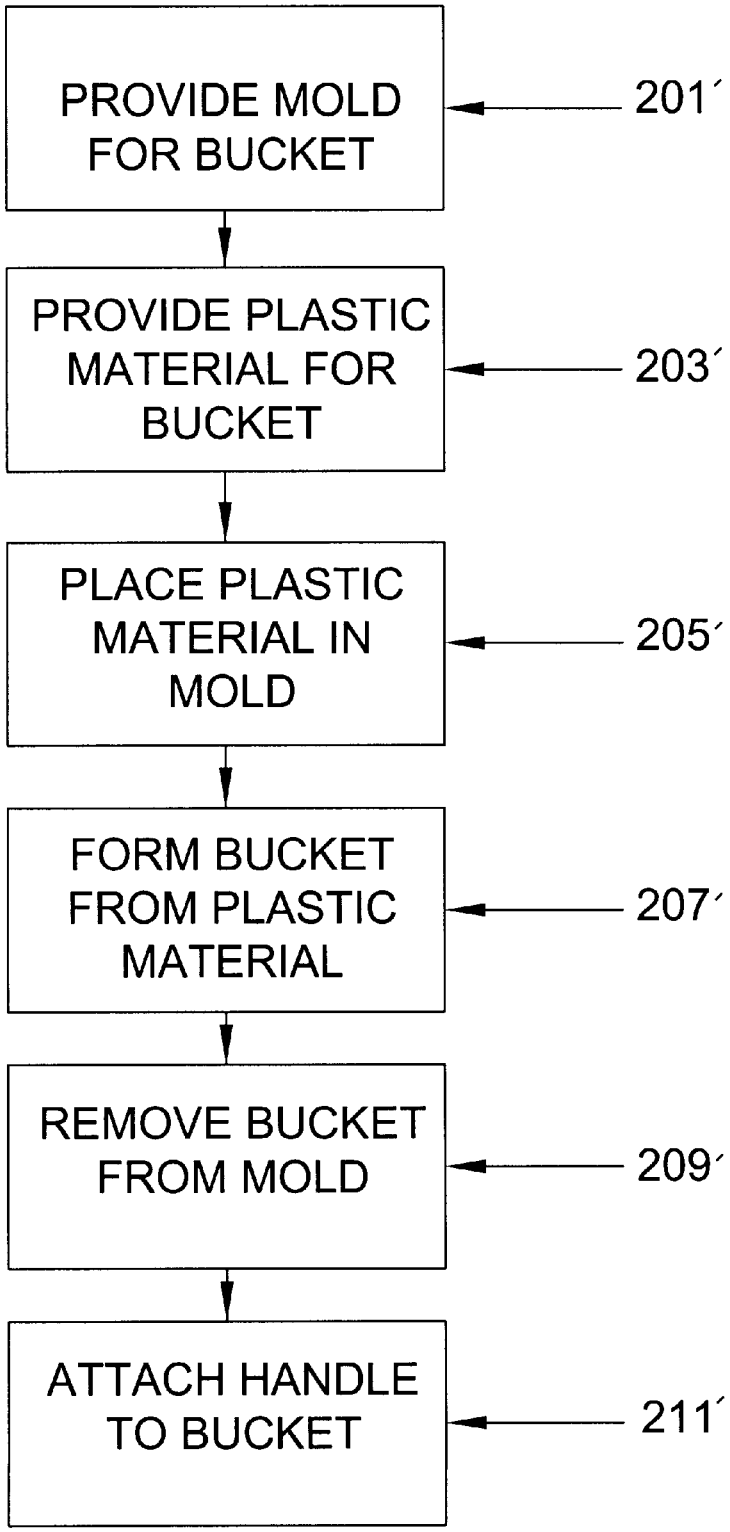
FIG. 9B is a flow chart of steps involved in a method of making a plastic bucket, according to another embodiment of the invention.

FIG. 9B is a flow chart of steps involved in another preferred embodiment of making a plastic bucket. Steps 201' through 209' of FIG. 9B are analogous to steps 201 through 209 of FIG. 9A and will not be explained again. At step 211', the handle 101 is attached to the bucket 5 at the left and right handle brackets 100*a* and 100*b*. The handle 101 may comprise a plastic material or a material other than plastic, e.g. various metals or metal alloys. A preferred material for the handle 101 is a length of wire, such as aluminum wire, steel wire, or similar material. The handle 101 may include a handle hook 102, from which the bucket 5 may be suspended.

Figure 10A:
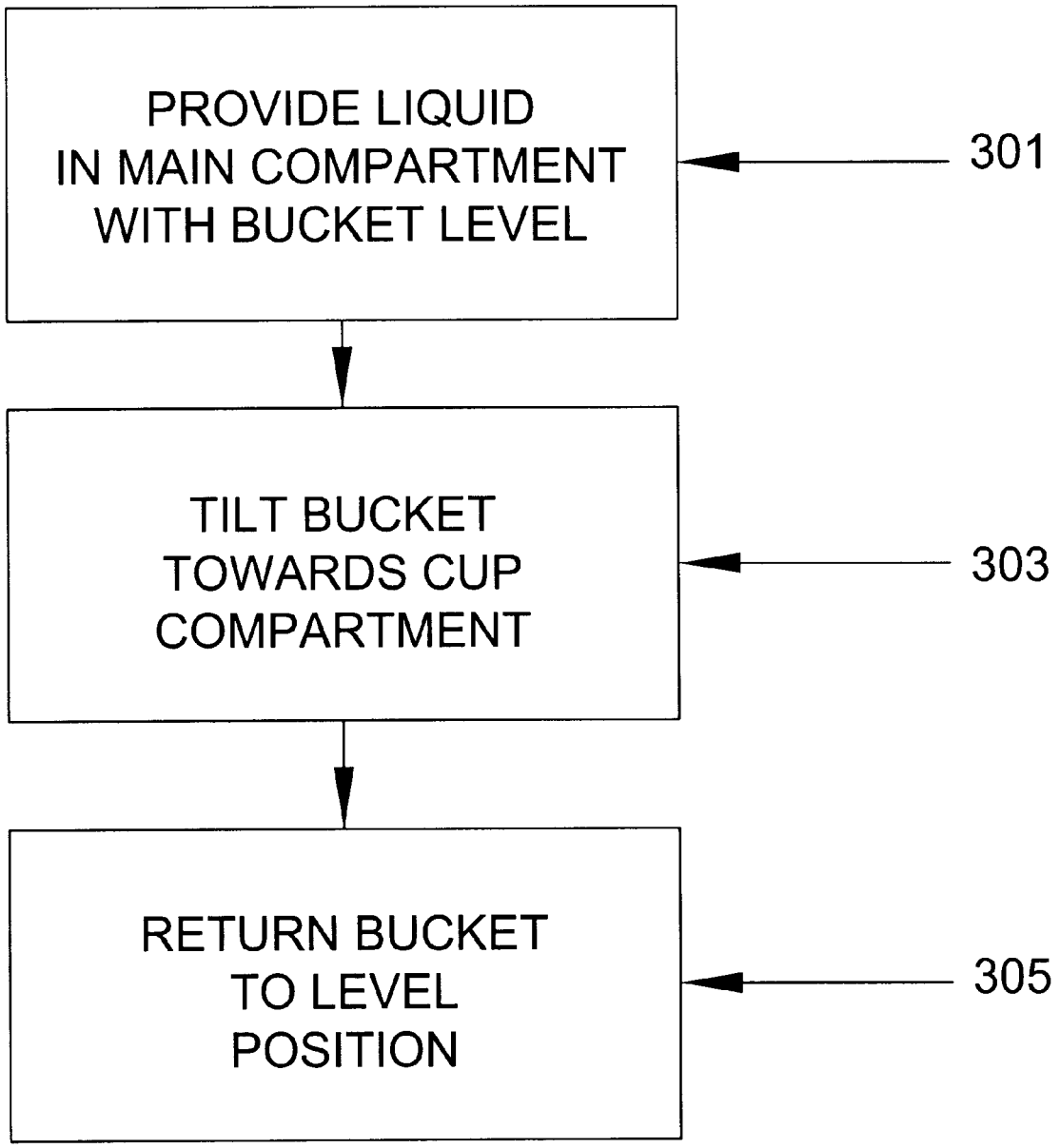
FIG. 10A is a flow chart of steps involved in a method of transferring liquid between the main compartment and the cup compartment of a plastic bucket, according to another embodiment of the invention.

FIG. 10A is a flow chart of steps involved in a method of transferring liquid from the main compartment 16 to the cup compartment 20 of a bucket having no internal walls therein, according to one embodiment of the invention. In step 301, a quantity of liquid is provided in the main compartment 16 while the bucket 5 is in a substantially level or horizontal position. In step 303, the bucket 5 is tilted towards the cup compartment 20 by an amount sufficient to allow a desired amount of liquid to flow, through at least one channel, from the main compartment 16 to the cup compartment 20. In the case of a bucket with a single channel, e.g., channel 70, that extends the complete length of the straight section rim 30', step 303 may involve tilting the bucket directly towards the second pouring lip 92. When left and right channels 71 and 81 are present in the straight section rim 30', step 303 may involve tilting the bucket 5 towards either the left channel 71 or the right channel 81. A quantity of liquid so transferred to the cup 20 is retained therein, even if the bucket 5 is subsequently tilted in the opposite direction, i.e., away from the second pouring lip 92.

In step 305, the bucket 5, and therefore the cup 20, are returned to a level or horizontal position. A quantity of liquid may then be retained within the cup 20. If the liquid is paint, the paint can be easily accessed for transferring to a paint brush or the like for painting trim, corners, etc. A quantity of liquid retained within the cup 20 may also be conveniently poured therefrom via the second pouring lip 92 by tilting the bucket 5 by a sufficient amount in a direction towards the second pouring lip 92.

Figure 10B:
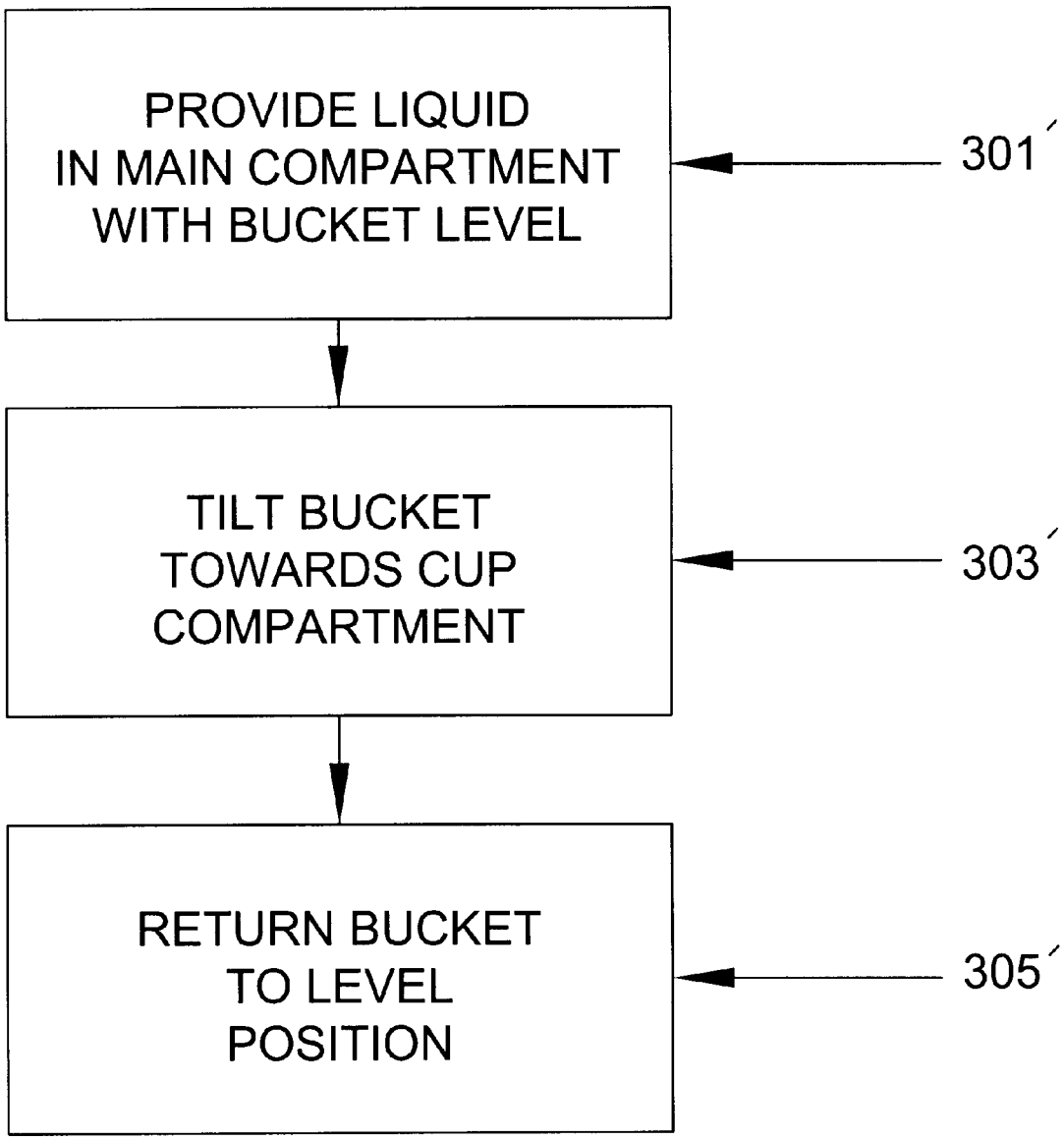
FIG. 10B is a flow chart of steps involved in a method of transferring liquid between the main compartment and the cup compartment of a plastic bucket, according to another embodiment of the invention.

FIG. 10B is a flow chart of steps involved in a method of transferring liquid from the main compartment 16 to the cup compartment 20, according to another embodiment of the invention, in which the bucket 5 includes, as internal walls, a main wall and left and right tangential walls, the latter having left and right channels 71 and 81 therein. In step 301' a quantity of liquid is provided in the main compartment 16, with the bucket 5 in a substantially level or horizontal position. Next, in step 303', the bucket 5 is tilted towards the cup compartment 20. As the bucket 5 is tilted towards the cup compartment 20, liquid flows preferentially from the rear main compartment base 17*b* into the front main compartment base 17*a*.

Since the volume of a liquid in a vessel is a function of the height or depth of the liquid and the surface area of the base of the vessel, and because the front main compartment base 17*a* has a smaller surface area than the rear main compartment base 17*b*, a given volume of liquid in the front main compartment base 17*a* has a substantially greater height, or depth, than the same volume of liquid in the main compartment base 17 as a whole, or in the rear main compartment base 17*b*. The substantially greater depth of the liquid in the front main compartment base 17*a*, when the bucket 5 is tilted by a sufficient amount towards the cup 20, allows the liquid to flow through the left and right channels 71 and 81 and into the cup 20. A quantity of liquid so transferred to the cup 20 is retained therein, even if the bucket 5 is tilted to a similar or greater extent in the opposite direction, i.e., away from the cup compartment 20. In step 305', the bucket 5, and therefore the cup 20, are returned to a level or horizontal position. A quantity of liquid may then be retained within the cup 20.

Figure 11:
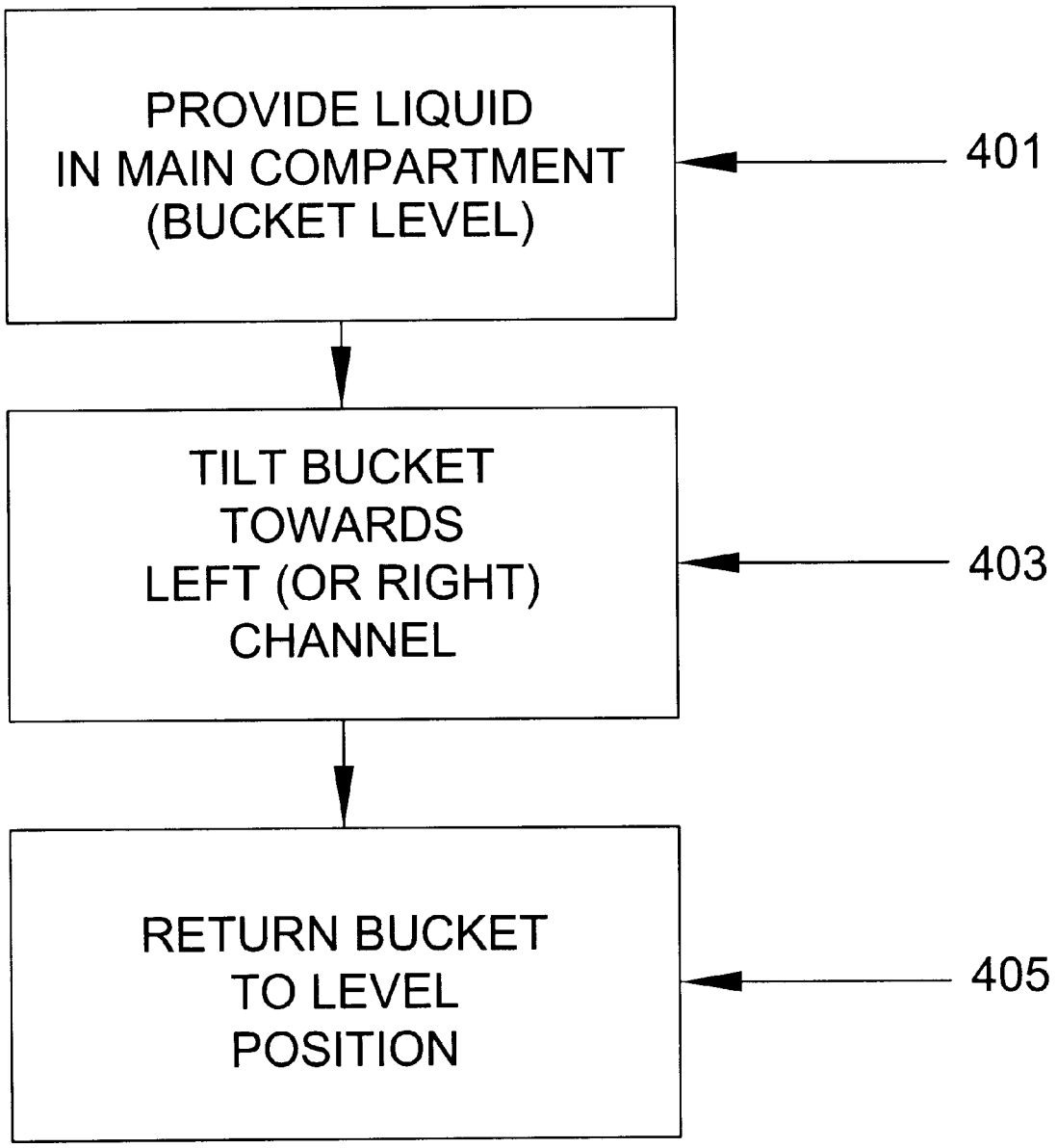
FIG. 11 is a flow chart of steps involved in a method of transferring liquid between the main compartment and the cup compartment of a plastic bucket, according to another embodiment of the invention.

FIG. 11 is a flow chart of steps involved in a method of transferring liquid from the main compartment 16 to the cup compartment 20 of the bucket 5, according to another embodiment of the invention, wherein the bucket 5 has left and right tangential walls having left and right channels therein, respectively. In step 401, at least a relatively small quantity of liquid is provided in the main compartment 16 of the bucket 5, while the bucket 5 is in a substantially level or horizontal position, so that the liquid is evenly distributed over the main compartment base 17 to a depth of from approximately 1/20th to approximately 1/5th of the height of the main compartment 16.

Next, at step 403, the bucket 5 is tilted towards, for example, the left channel 71. As a result, the liquid flows preferentially towards the left channel 71 and accumulates between the left rounded edge 43, the left side 55 of the left tangential wall 51, and the bucket inner side 12*a* (shown in FIGS. 2B, 2E, and 2F).

Since the volume of a liquid in a vessel is a function of the height or depth of the liquid and the surface area of the base of the vessel, and because the region of the main compartment base 17 bounded by the left rounded edge 43, the left side 55 of the left tangential wall 51, and the bucket inner side 12*a* has a much smaller surface area than the main compartment base 17 as a whole, a given volume of liquid in the region of the main compartment base 17 bounded by the left rounded edge 43, the left side 55 of the left tangential wall 51, and the bucket inner side 12*a* has a substantially greater height or depth than the same volume of liquid in the main compartment base 17 as a whole. Consequently, as the bucket 5 is tilted towards the left channel 71 by a sufficient amount, the depth of the liquid increases by an amount sufficient to cause the liquid to flow through the left channel 71 into the cup 20. The tilting of the bucket 5 towards the left channel 71 may be continued until a sufficient quantity of the liquid has been transferred from the main compartment 16 to the cup compartment 20.

At step 405, the bucket 5 is returned to the horizontal position, thereby retaining the transferred liquid in the cup 20. The liquid retained within the cup 20 may be conveniently poured from the cup 20 via the second pouring lip 92 by tilting the bucket 5 by a sufficient amount towards the second pouring lip 92.

FIG. 12 is a plan view of bucket or receptacle 5, according to another embodiment of the invention. The bucket shown in FIG. 12 is similar to the bucket depicted in FIGS. 1A–1C, including the main compartment 16, the cup compartment 20, the bucket rim 30, the bucket inner side 12*a*, and the bucket inner side straight section 12*a*'. The cup compartment 20 has a smaller capacity, is narrower, and is shallower than the main compartment 16. The bucket rim 30 may include an outer rim 31, an inner rim 32, and a bucket flange 33 located there between. However, the bucket 5 shown in FIG. 12 includes a bucket inner side straight section 12*a*' having a substantially planar surface which lacks the left and right indentations 46*a* and 46*b* described above. The bucket 5 may be used in combination with a liner 105 which is rigid and which includes left and right indentations 146*a* and 146*b*, and which is shown in FIG. 13B.

A multi-compartment receptacle or bucket 5 having a main compartment and a cup compartment, according to the present invention, may include one or more liners or inserts 105 (shown in FIGS. 13A–16) for inserting within the bucket 5 in order to provide a lining for at least one of the inner surfaces of the bucket 5. Such liners are normally of one-piece or integral construction, and are liquid-proof with respect to the liquids to be placed within the bucket/bucket liner combination, i.e. the material constituting the liner 105 will contain a liquid and this should be at least substantially resistant to such liquid. One or more liners 105 may be included with the bucket or receptacle 5 at the time of purchase of the bucket 5, and/or one or more liners 105 may also be provided separately for use in conjunction with the bucket 5.

The liners 105 for the bucket 5, according to the invention, make contact with paint or other liquid contained within the bucket 5, and prevent the paint or the other liquid from making contact with at least the inner surfaces of the bucket 5. The liners 105 to be used in combination with the bucket 5 will also preferably prevent the paint or other liquid from coming in contact with the components of the bucket rim 30.

The liners 105 for lining the bucket 5 may be disposable, and may be discarded after a single use. By inserting such a disposable liner 105 within the bucket 5 prior to each use, cleanup of the bucket 5 is greatly facilitated and the longevity of the bucket 5 may be extended considerably. The liners 105 may be flexible or rigid. A flexible liner 105 may, for example, comprise a relatively thin film of plastic material, e.g., polyethylene sheets, preferably with a thickness falling in the range of from approximately 10 micrometers to approximately 40 micrometers (0.4–1.6 MIL). The flexible liners otherwise have dimensions suitable for insertion within the bucket 5. The shape of a flexible liner 105 may be the same as, or substantially the same as, that of the bucket 5 can or other receptacle to be lined or used in conjunction with the liner. Such a flexible liner 105 will normally rely on external support, e.g. the structure of the bucket 5, in order to retain its form. A flexible liner 105 made of a relatively thin film of polyethylene or other plastic material, and which is inserted within the bucket 5, may be retained therein by the weight of liquid placed within the liner 105/bucket 5 combination, as well as by electrostatic attractive forces between the juxtaposed surfaces of the liner 105 and the bucket 5.

According to a currently preferred embodiment of the invention, the liner 105 is substantially rigid, and will normally retain its form in the absence of external support. Such a rigid liner 105 will in general be thinner than the bucket 5, but will otherwise have substantially the same dimensions and shape as the bucket 5 or other receptacle with which it is to be combined. Thus, a rigid liner 105 may have a substantially cylindrical or frusto-conical-shaped liner body 110 including a liner main compartment base 117 and a liner base 111. According to certain embodiments of the invention, the liner main compartment base 117 may correspond to the interior part of the liner base 111. Preferably, a plurality of rigid liners 105 may be stacked together or nested. Similarly, one or more rigid liners 105 may be stacked or nested within the bucket 5.

A rigid liner 105 may be formed from plastic or other material having sufficient rigidity and thickness to provide a rigid liner 105 which retains its form in the absence of any external support. As an example, the liner 105 may be formed from paper-based products to form a rigid structural support to which a relatively thin liquid-proof coating or layer is applied. A currently preferred liquid-proof coating for the liner is a layer of a plastic material or the like which may be applied to a layer of paper to form a paper-plastic laminate. The liner 105 may also be made or formed from other suitable water-tight or liquid-proof materials, including various metallic materials such as sheet metal or aluminum foil which is formed or drawn. The paper-based, plastic, aluminum, or other materials which may be used to form the liner 105 may be derived from recycled products or substances.

Alternatively, according to a currently preferred embodiment of the invention, a rigid liner 105 may be formed solely or predominantly from various plastic materials. Plastic materials which may be used in the manufacture of the liner 105 include, but are not limited to: polyethylene (both high density and low density, polypropylene, polystyrene, etc.

A rigid disposable liner 105 may be formed from plastic material by thermoforming using various techniques that are well known in the art. See, for example, D. Handrow & J. Kallenbach, "The Evolution of Thermoforming for Medical Packaging", MEDICAL PLASTICS & BIOMATERIALS, September/October, 1997. For example, the liner 105 may be formed by vacuum forming using either a female or a male mold, or by pressure forming with or without plug-assist processing, as described by the D. Handrow & J. Kallenbach reference. In the vacuum forming process, plastic sheeting is heated beyond its deflection temperature and then positioned over a mold. The sheeting is then pulled into or over the mold by the application of a vacuum. The process of pressure forming is performed within a hermetically sealed vessel. In this process, the plastic sheeting is prestretched by the application of positive air pressure on the side of the sheeting away from the mold. Once prestretching is complete, the sheeting is pulled against the mold by the application of a vacuum. In plug-assist processing, a hob, which is shaped as the negative image of the mold, is used to prestretch and preshape the plastic sheeting on the pressure side of the sheeting prior to the application of a vacuum. A thermoformed rigid plastic liner 105 according to the present invention preferably has a thickness that falls in a range of from approximately 0.2 mm to approximately 1.5 mm, and more preferably falls in a range of from approximately 0.25 mm to approximately 0.75 mm.

The liner 105 may be provided in a range of colors appropriate to the liquid to be contained. For example, a black or dark colored liner 105 would facilitate visualization of white or light-colored paints or other liquids, while a white or light-colored liner 105 would facilitate visualization of a black or dark-colored paint or other liquid. In this manner, visualization of any type of liquid may be facilitated by selecting an appropriate liner 105 for use in conjunction with the bucket 105.

Figure 13A:
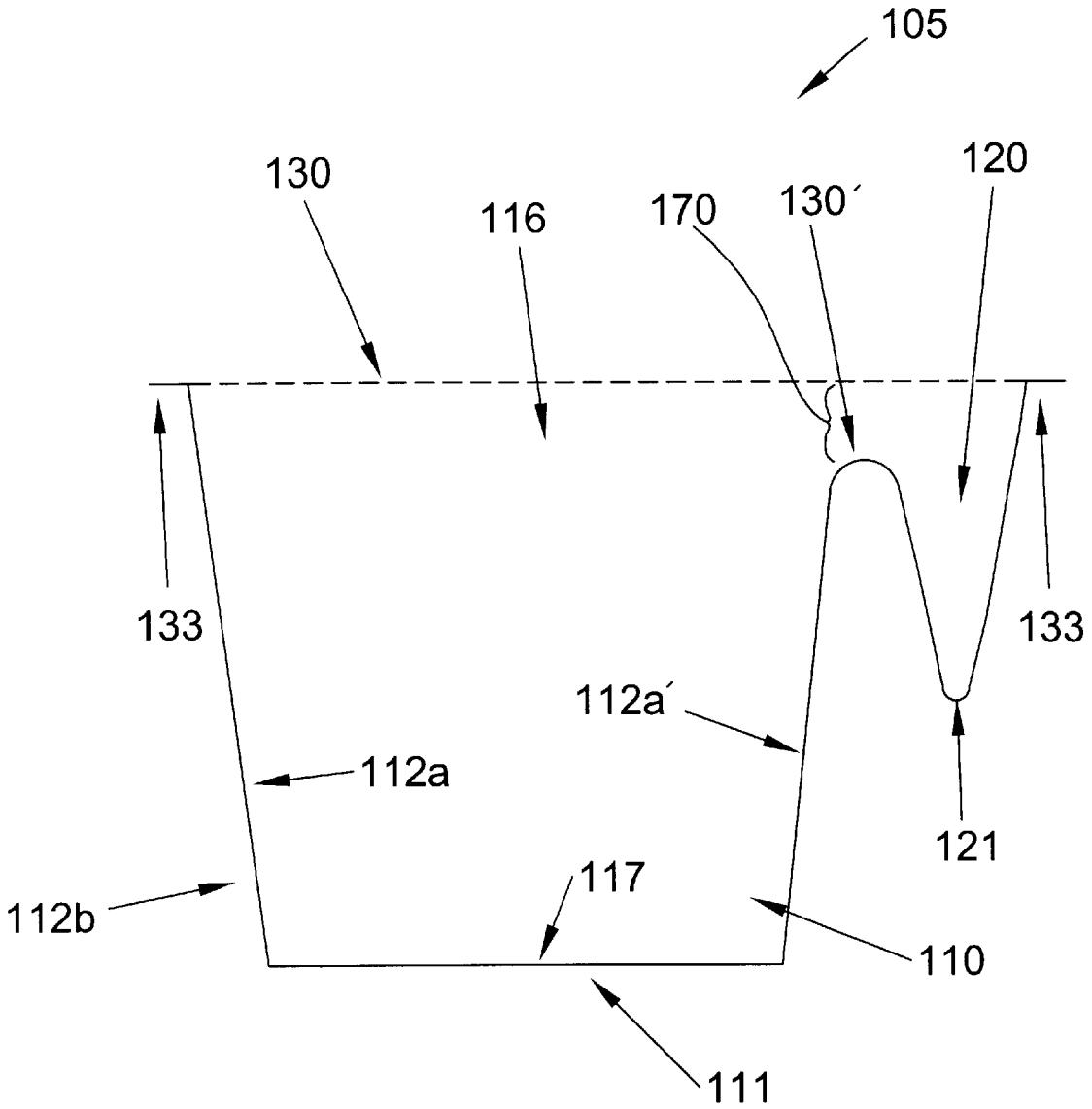
FIG. 13A is a sectional view of a bucket liner, according to one embodiment of the invention.
Figure 13B:
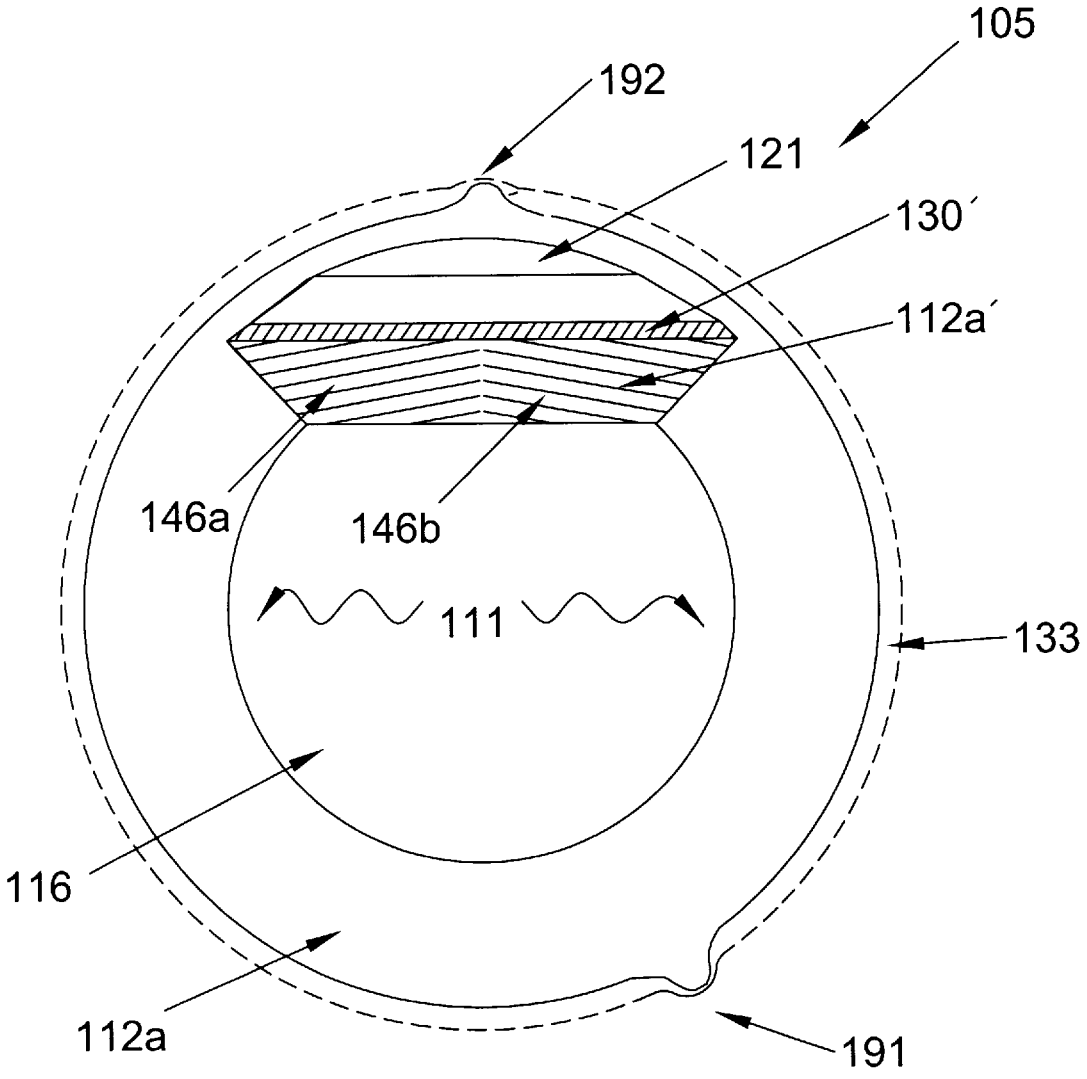
FIG. 13B is a plan view of the bucket liner of FIG. 13A.

FIG. 13A is a sectional view of bucket liner or insert 105 according to one embodiment of the invention. The bucket liner or insert 105 is for inserting within and lining the inner surfaces, e.g. bucket inner side 12*a*, of multi-compartment receptacle 5. The liner 105 may have the same features and shape as the bucket 5, or the liner 105 may have at least some of the features of the bucket 5. Thus, the liner 105 may include a liner main compartment 116, a liner cup compartment 120, a liner base 111, a cup compartment base 121, a liner inner side 112*a*, a liner outer side 112*b*, a liner inner side straight section 112*a*', a liner rim 130, a liner flange 133, a liner straight section rim 130' for forming liner channel 170, and a liner body 110 which may be substantially cylindrical or frusto-conical in shape.

The liner 105 may be the same size or substantially the same size as the receptacle or bucket 5, such that the liner 105 fits closely, or "nests", within the bucket 5. Alternatively, the liner 105 may be somewhat smaller than the bucket 5, such that the liner 105 fits more loosely within the bucket 5.

FIG. 13B is a plan view of the bucket liner 105 shown in FIG. 13A. The liner 105 may include first and second pouring lips 191 and 192, respectively. The liner 105 further includes a liner flange 133. The width of the liner flange 133 may vary according to the overall dimensions of the liner 105 and the bucket 5 which is to receive the liner 105, or according to other factors. However, the width of the liner flange 133 is preferably sufficient to prevent spillage, entrapment, or other loss of liquid between the bucket inner side 12*a* and the liner outer side 112*b*. The liner inner side straight section 112*a*' may include left and right indentations 146*a* and 146*b* which serve to promote drainage of paint or other liquid from the inner side straight section 112*a*' towards liner base 111. When the liner 105, having left and right indentations 146*a* and 146*b*, is used in conjunction with a bucket having left and right indentations 46*a* and 46*b*, the left and right indentations 146*a* and 146*b* of the liner 105 may be located on the liner 105 so as to be aligned with the corresponding left and right indentations 46*a* and 46*b* of the bucket 5.

Figure 14:
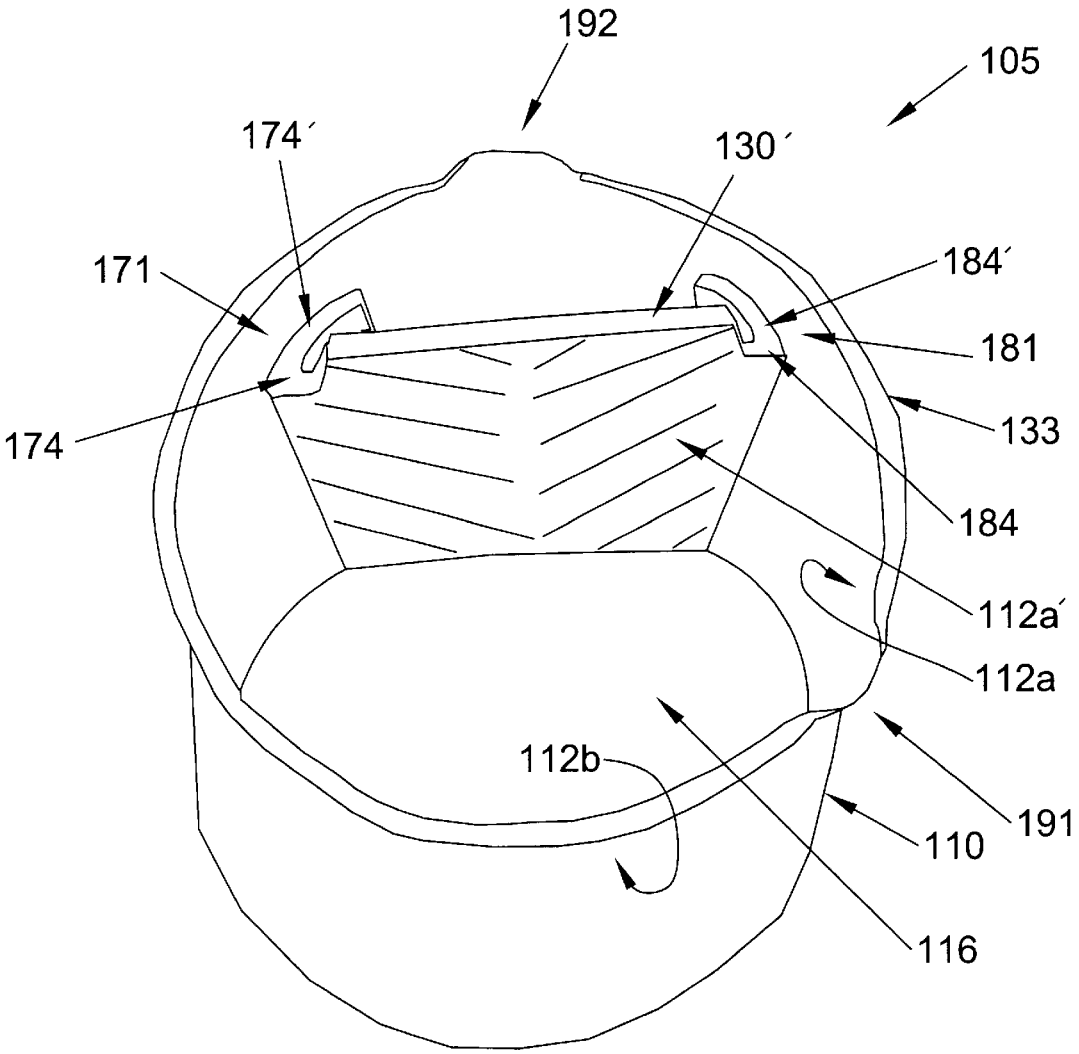
FIG. 14 is a perspective view of a bucket liner, according to another embodiment of the invention.

FIG. 14 shows a perspective view of a bucket liner 105, according to another embodiment of the invention. The liner 105 of FIG. 14 may include elements and features which correspond to the elements and features of the bucket 5, as described above in connection with Figure ID. Thus, the liner 105 may include liner left and right channels 171 and 181, which are formed in liner straight section rim 130', as well as liner left channel base and liner right channel base 174 and 184, and liner left and right channel base extensions 174' and 184'. The depth of the liner left and right channels 171 and 181 may vary over a fairly broad range, but the channel depth is preferably substantially less than the height of the straight section rim 130' from liner main compartment base 117.

Figure 15:
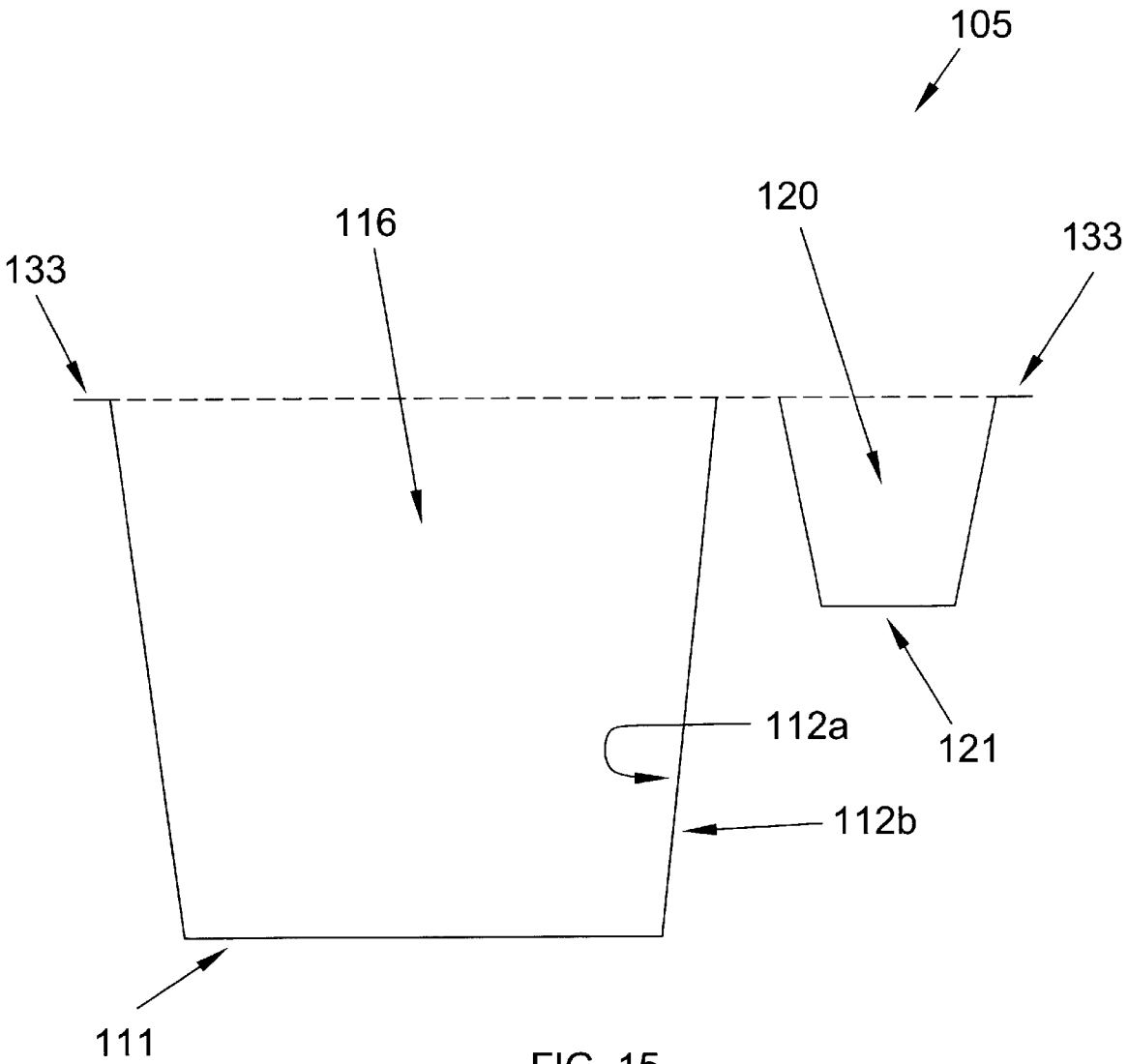
FIG. 15 is a sectional view of a bucket liner, according to another embodiment of the invention.

FIG. 15 is a sectional view of a bucket liner 105, according to another embodiment of the invention, wherein the liner 105 includes a liner cup compartment 120 having a liner cup compartment base 121 which is relatively large and relatively flat, as compared with that depicted in FIG. 13A. The overall shape and dimensions of the liner 105 are determined by, and generally correspond to, those of the bucket 105 which is to be lined by the liner or insert 105.

Figure 16:
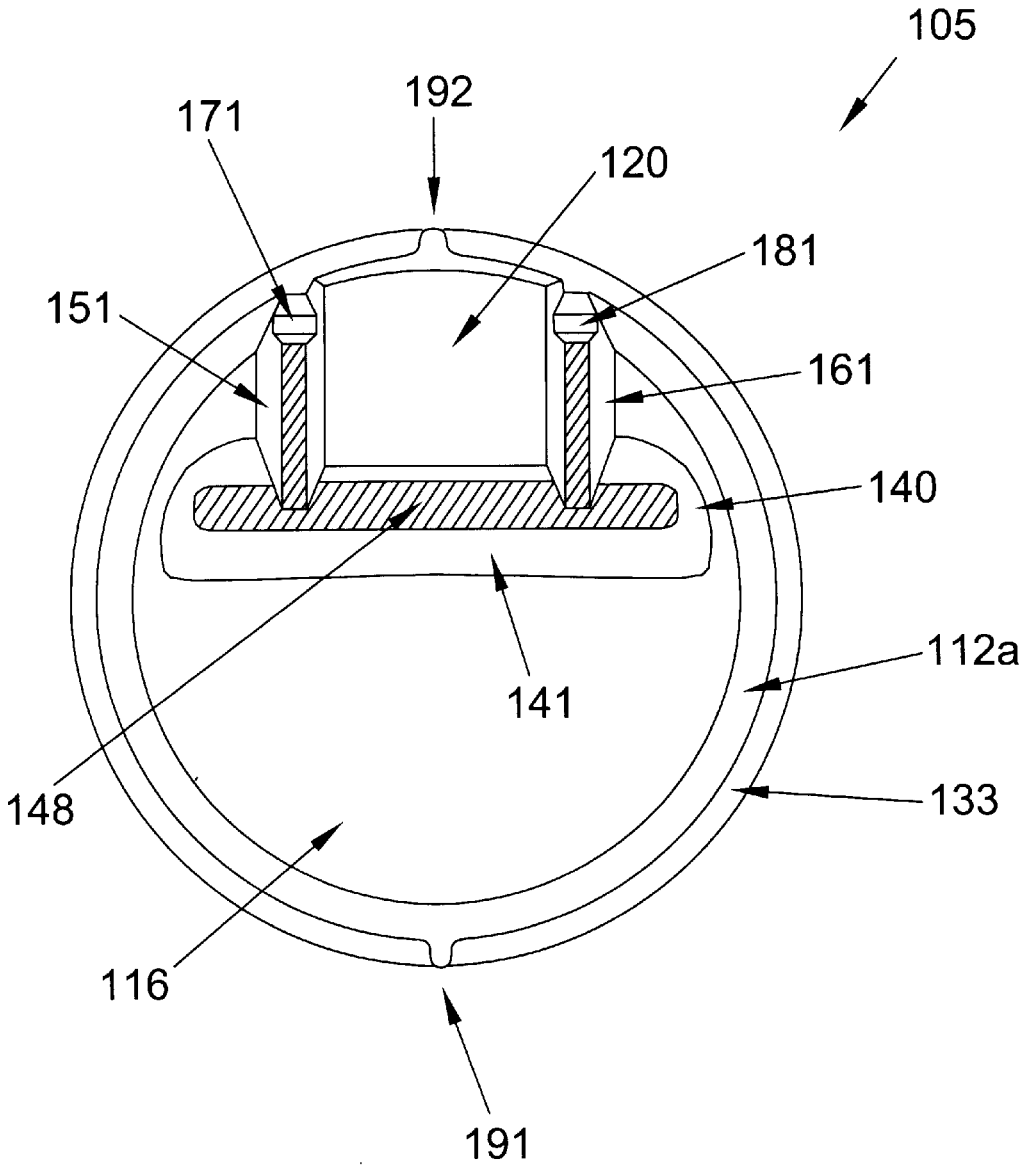
FIG. 16 is a plan view of a bucket liner, according to another embodiment of the invention.

FIG. 16 shows a plan view of a bucket liner 105, according to another embodiment of the invention. The liner 105 of FIG. 16 may include elements and features which correspond to the elements and features of the bucket 5 as described above in connection with FIGS. 2A–2D. Thus, the liner 105 of FIG. 16 may include a liner main wall 140, left and right liner tangential walls 151 and 161, liner left and right channels 171 and 181, and first and second pouring lips 191 and 192. The liner main wall 140 includes a liner main wall inner side 141 and a liner main wall top 148. The liner main wall inner side 141 provides a substantially planar surface suitable for distributing paint on a paint roller, and the inner side 141 may include left and right indentations or chevrons (not shown) to promote drainage of liquid from the inner side 141.

According to the invention, a liner having the general characteristics and features as described above in connection with FIGS. 13A–16, may also be provided for paint buckets having shapes and sizes different from those disclosed herein while still following within the scope of the present invention. For example, according to the invention, a rigid liner 105' comprised of molded plastic material and having the general characteristics and features described above may be provided for a standard paint bucket which lacks a cup compartment, and which may also lack an internal channel. Thus, according to the invention, a rigid liner 105' comprised of molded plastic material may be provided for a paint bucket which lacks a cup compartment, and which includes either a partial internal cross wall or an entire internal cross wall, and having one compartment or more than one compartment, respectively, as shown in FIGS. 17A–17K. In this case, the liner 105' may be positioned in the bucket so that the liner flange 133 engages the rim of the bucket, thereby supporting the liner 105' inside the bucket. A molded plastic liner 105' may be constructed from the same or similar materials as those described above for the liner 105 in connection with FIGS. 13A–16.

Figure 17A:
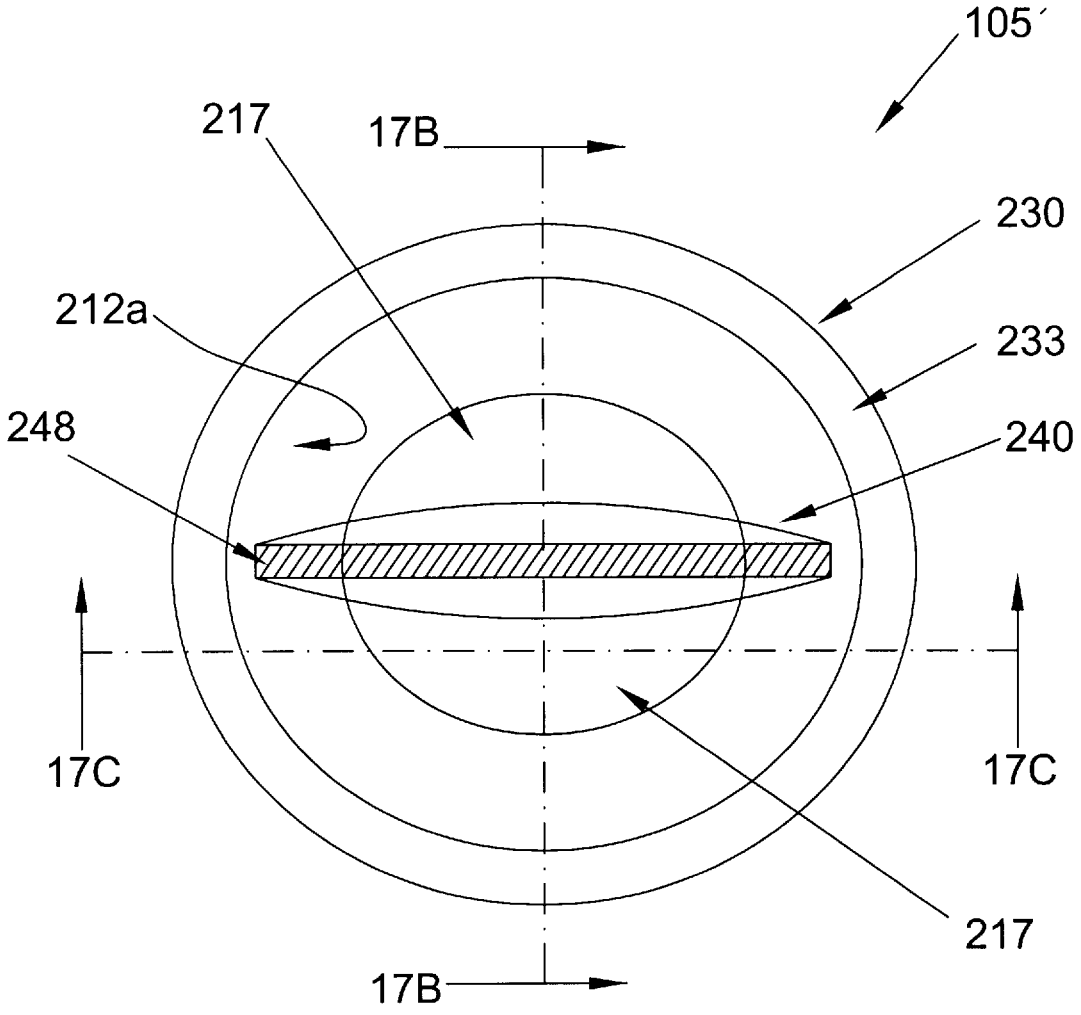
FIG. 17A is a plan view of a bucket liner having an entire internal wall which partitions the liner into two compartments of equal depth, according to another embodiment of the invention.

FIG. 17A is a plan view of a bucket liner 105' according to one embodiment of the invention. The liner 105' includes a liner base 217, a liner inner side 212*a*, a liner rim 230, and a liner flange 233. The liner 105' further includes a liner internal wall 240 which is entire, i.e., each edge of the internal wall 240 is in contact with the liner inner side 212*a*. Therefore the internal wall 240 partitions the liner 105' into two self-contained compartments of equal depth. Unlike the liner 105 of FIGS. 13A–16, the liner 105' lacks a liner cup compartment 120, i.e., a compartment having a narrower width, a shallower depth, and a smaller capacity relative to the liner main compartment 116 (see FIGS. 13A–16). The liner base 217, the liner inner side 212*a*, and the liner flange 233 preferably comprise molded plastic material. The liner base 217, the liner inner side 212*a*, and the liner flange 233 are preferably constructed of molded plastic material having a thickness that falls in a range of from approximately 0.2 mm to approximately 1.5 mm, and more preferably falls in the range of from approximately 0.25 to about 0.75 mm.

Figure 17B:
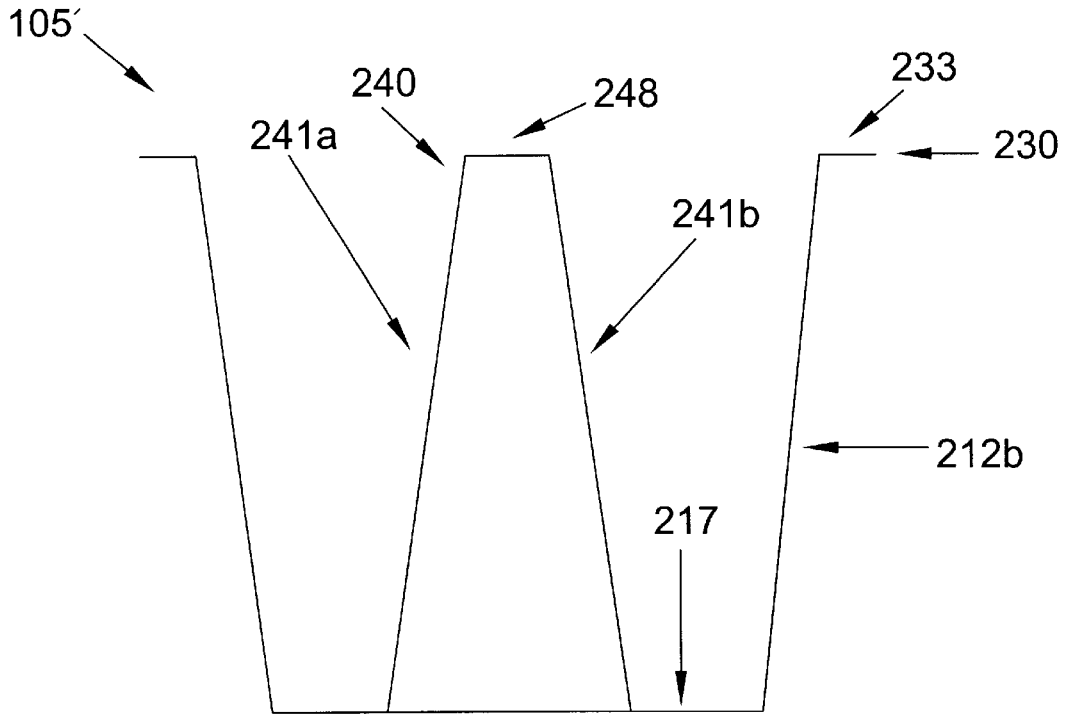
FIG. 17B is a sectional view taken along the section line 17B—17B of FIG. 17A.

FIG. 17B is a sectional view of the bucket liner 105' taken along the section line 17B-17B of FIG. 17A The liner internal wall 240 arises from the liner base 217 and includes liner first and the second internal wall sides 241*a* and 241*b*, which taper to the liner wall top 248. Each of the liner first and second internal wall sides 241*a* and 241*b* provide a substantially planar surface suitable for applying paint or other liquid to a roller. The overall height of the liner internal wall 240, i.e., the height of the liner internal wall top 248 from the liner base 217, may vary according to the height of the liner 105' and other factors. The height of the liner internal wall 240 is preferably between approximately 99% and approximately 20% of the overall height of the liner 105', i.e., the vertical distance between the liner rim 230 and the liner base 217. More preferably, the height of the liner internal wall 240 is between approximately 97% and approximately 40% of the overall height of the liner 105'. Preferably, the overall height of the liner 105' is between 8 inches and 16 inches, and more preferably between 10 inches and 14 inches. The liner internal wall top 248 preferably has a length ranging from approximately 4 inches to approximately 12 inches, and more preferably a length ranging from approximately 9.5 inches to approximately 12 inches. The liner flange 233 preferably has a width that falls in a range of from approximately 0.2 inch to approximately 1 inch, and more preferably that falls in a range of from approximately 0.25 inch to approximately 0.75 inches.

Figure 17C:
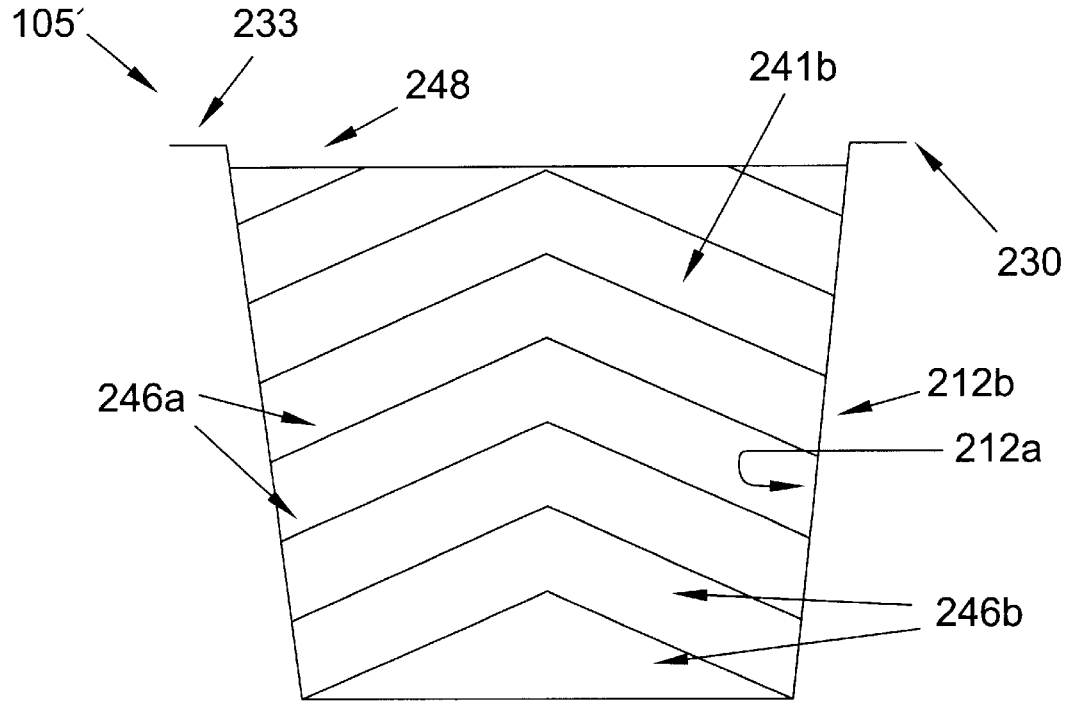
FIG. 17C is a sectional view taken along the section line 17C—17C of FIG. 17A.

FIG. 17C is a sectional view taken along the section line 17C—17C of FIG. 17A. The liner internal wall 240 may include left and right indentations 246*a* and 246*b*, or similar features to promote drainage of paint or other liquids from the liner first and second internal wall sides 241*a* and 241*a*.

Figure 17D:
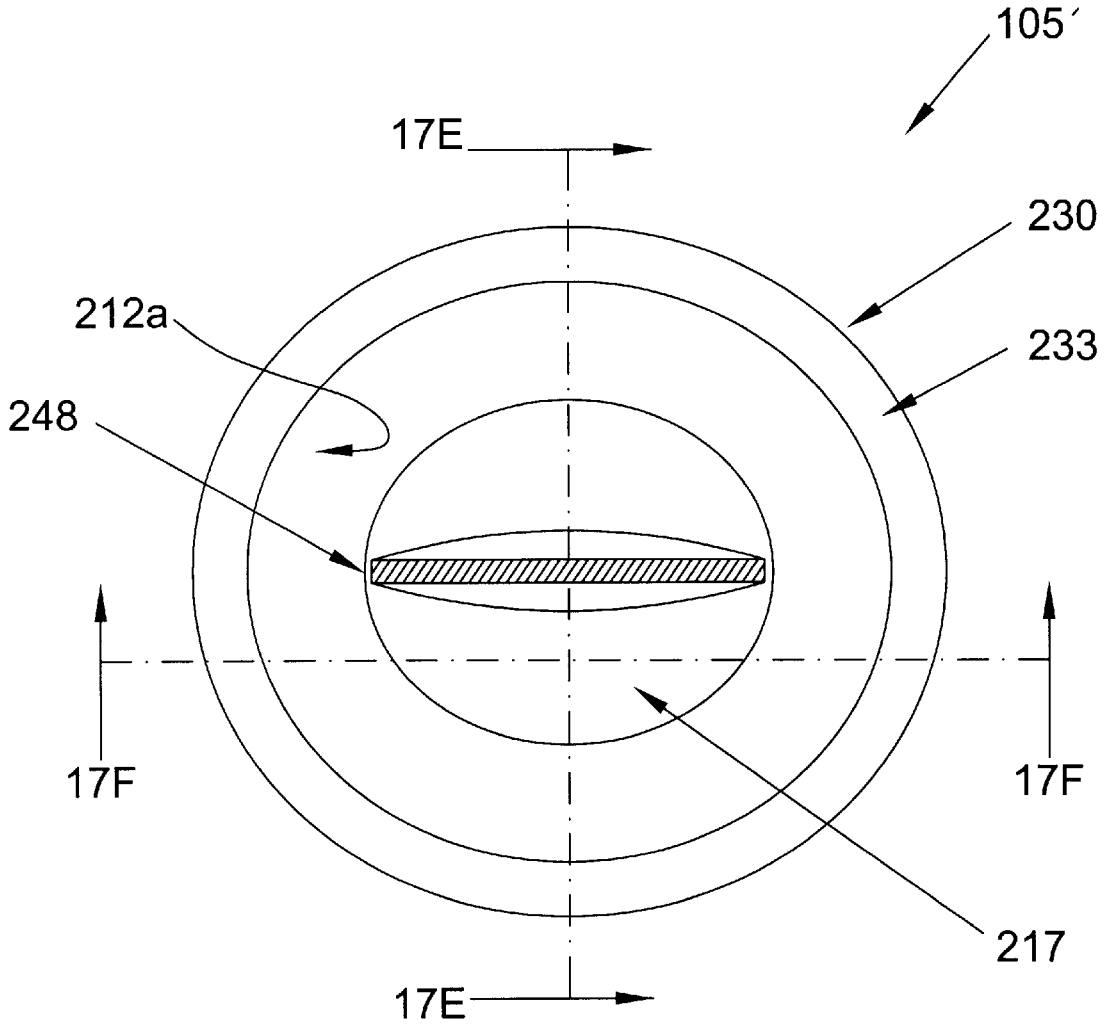
FIG. 17D is a plan view of a bucket liner having a partial internal wall and a single compartment, according to another embodiment of the invention.

FIG. 17D is a plan view of a bucket liner 105' according to another embodiment of the invention. The liner 105' includes a liner base 217, a liner inner side 212*a*, a liner rim 230, and a liner flange 233. The liner 105' further includes a liner internal wall 240 which is partial and does not make contact with the liner inner side 212*a*. Liquid can flow freely through the gap between each edge of the liner internal wall 240 and the liner inner side 212*a*, and therefore the liner 105' comprises a single compartment.

Figure 17E:
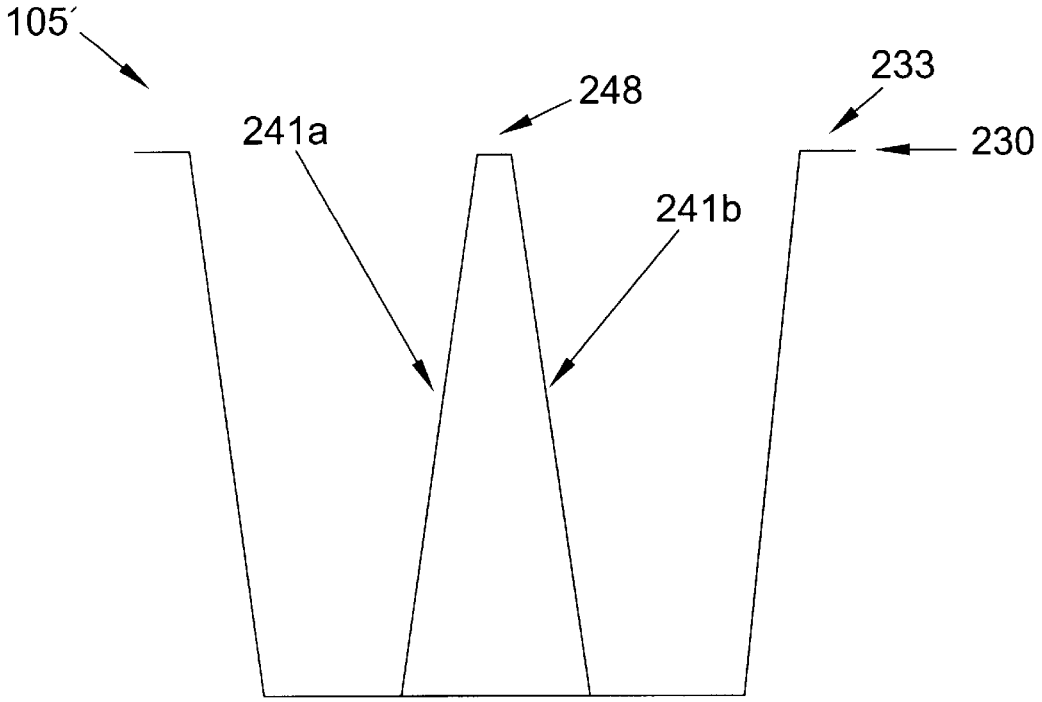
FIG. 17E is a sectional view taken along the section line 17E—17E of FIG. 17D.

FIG. 17E is a sectional view taken along the section line 17E—17E of FIG. 17D. The liner internal wall 240 arises from the liner base 217 and includes first and second internal wall sides 241*a* and 241*b*, which taper to liner wall top 248. The overall height of the liner internal wall 240 may vary according to the height of the liner 105' and other factors, essentially as described above with in connection with FIG. 17B.

Figure 17F:
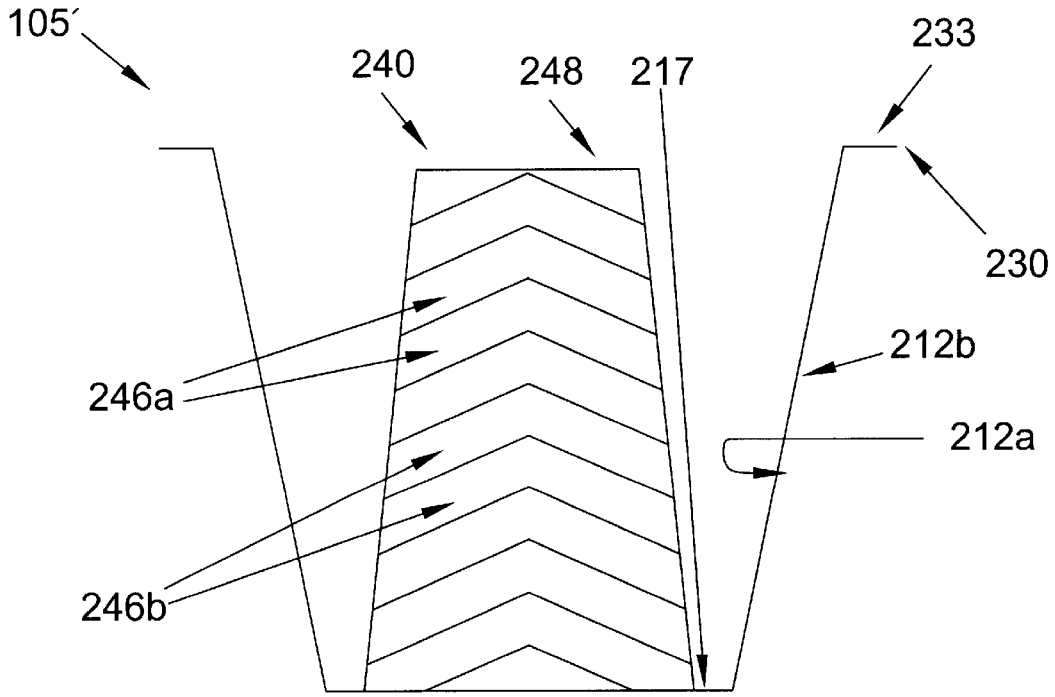
FIG. 17F is a sectional view taken along the section line 17F—17F of FIG. 17D.

FIG. 17F is a sectional view taken along the section line 17F—17F of FIG. 1D. The liner internal wall 240 arises from the liner base 217. A gap exists between each edge of the internal wall 240 and the liner inner side 212*a*. The liner internal wall 240 may include left and right indentations 246*a* and 246*b*, or similar features designed to promote drainage of paint or other liquids from the liner first and second internal wall sides 241*a* and 241*b*, as described above in connection to FIG. 17F.

Figure 17G:
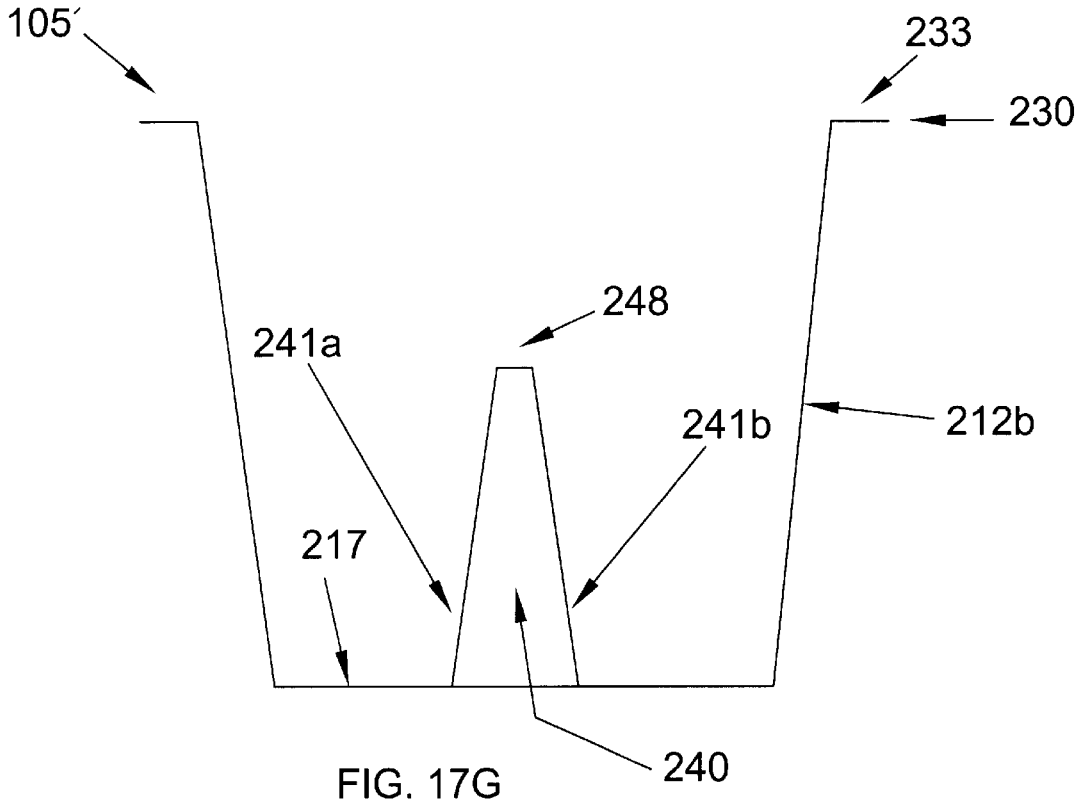
FIGS. 17G and 17H each show sectional views of a bucket liner having a partial internal wall and a single compartment, in which the depth of the internal wall is substantially less than the depth of the bucket liner, according to other embodiments of the invention.
Figure 17H:
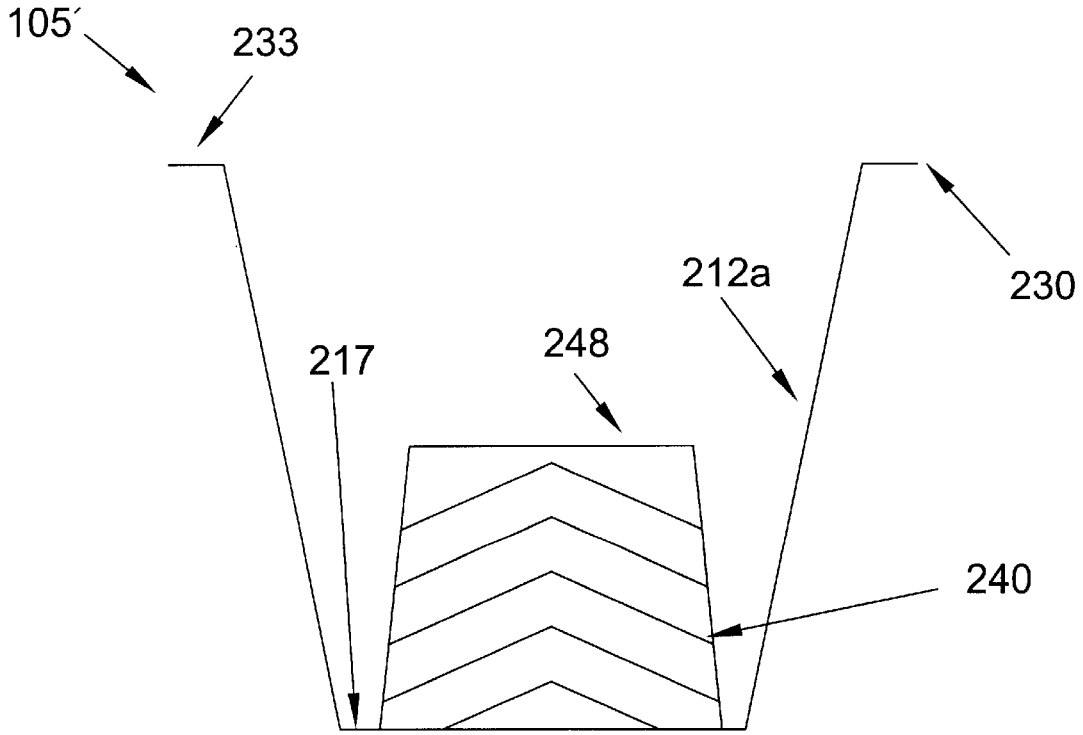

FIGS. 17G and 17H are each a sectional view of a bucket liner having a partial liner internal wall 240 and a single compartment within the liner 105', essentially as described above in connection with FIGS. 17D–17F. FIGS. 17E and 17F show a liner internal wall 240 having a depth substantially less than the overall depth of the liner 105', according to another embodiment of the invention.

Figure 17I:
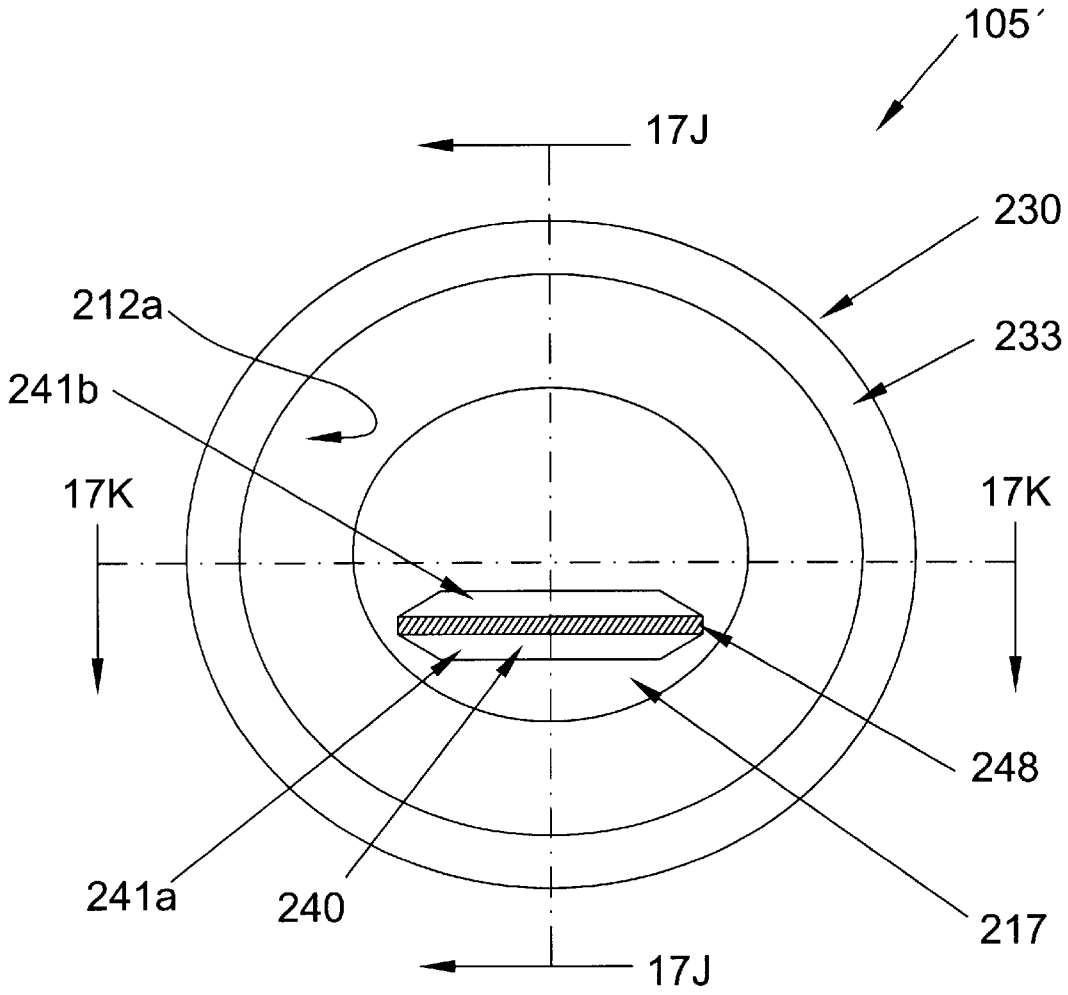
FIG. 17I is a plan view of a bucket liner having a partial internal wall and a single compartment, in which the partial internal wall is off-set from the center of the bucket liner, according to another embodiment of the invention.

FIG. 17I is a plan view of a bucket liner 105' according to the present invention, with the liner 105' having a partial liner internal wall 240 and a single compartment, substantially as described above on connection with FIG. 17D. However, in FIG. 17I, the internal wall 240 is shown in an offset position away from the center of the liner base 217.

Figure 17J:
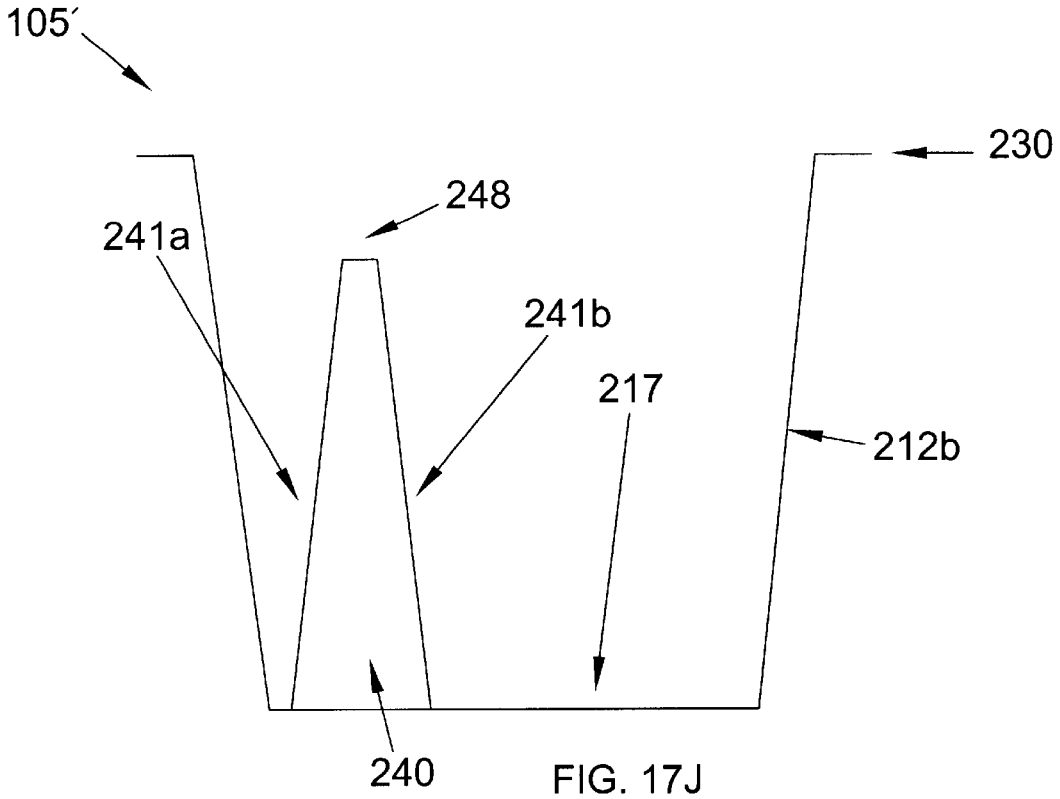
FIG. 17J is a sectional view taken along the section line 17J—17J of FIG. 17I.
Figure 17K:
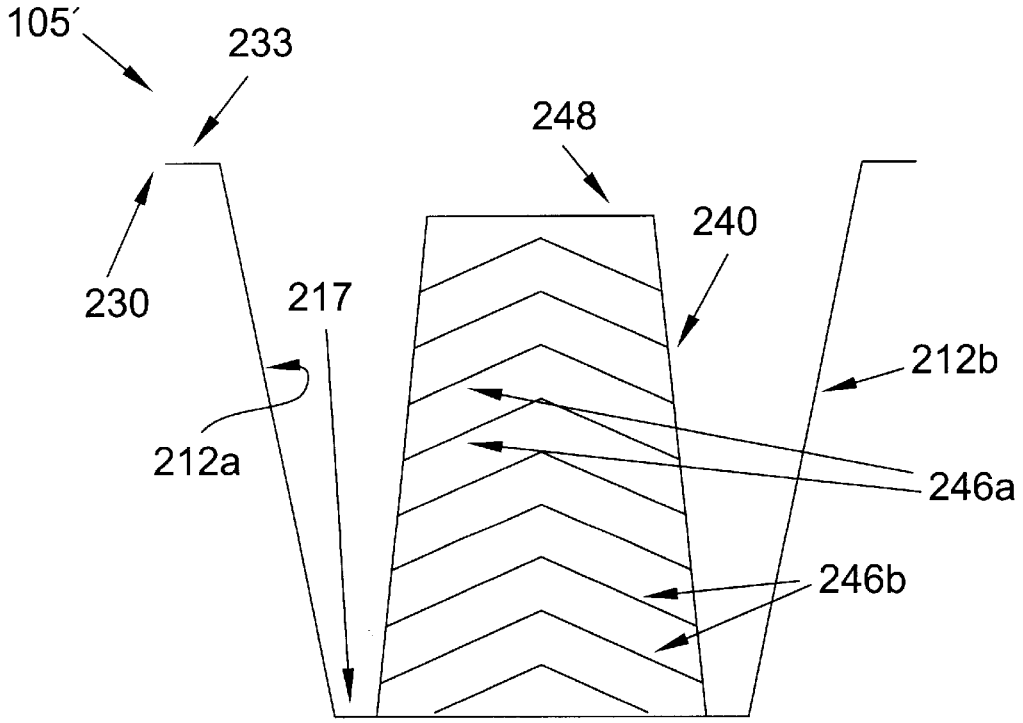
FIG. 17K is a sectional view taken along the section line 17K—17K of FIG. 17I.

FIGS. 17J and 17K are each a sectional view of the bucket liner 105' of FIG. 17I, according to the present invention. The liner 105' of FIGS. 17J and 17K is substantially as described above in connection with FIGS. 17E and 17F, but with the internal wall 240 arising from a position offset from the center of the liner base 217.

A disposable liner for a receptacle having the same general shape as the liner 105' of FIGS. 17A–17K may also be flexible. A flexible liner may comprise of, for example, a relatively thin film of plastic material, e.g., polyethylene sheets, preferably with a thickness that falls in the range of from approximately 10 micrometers to approximately 40 micrometers (0.4–1.6 MIL). The flexible liners otherwise have dimensions suitable for insertion within a receptacle to be lined. A flexible liner may have the same or substantially the same features or elements, and have the same or substantially the same size and shape as that of a bucket or other receptacle to be lined.

Figure 18:
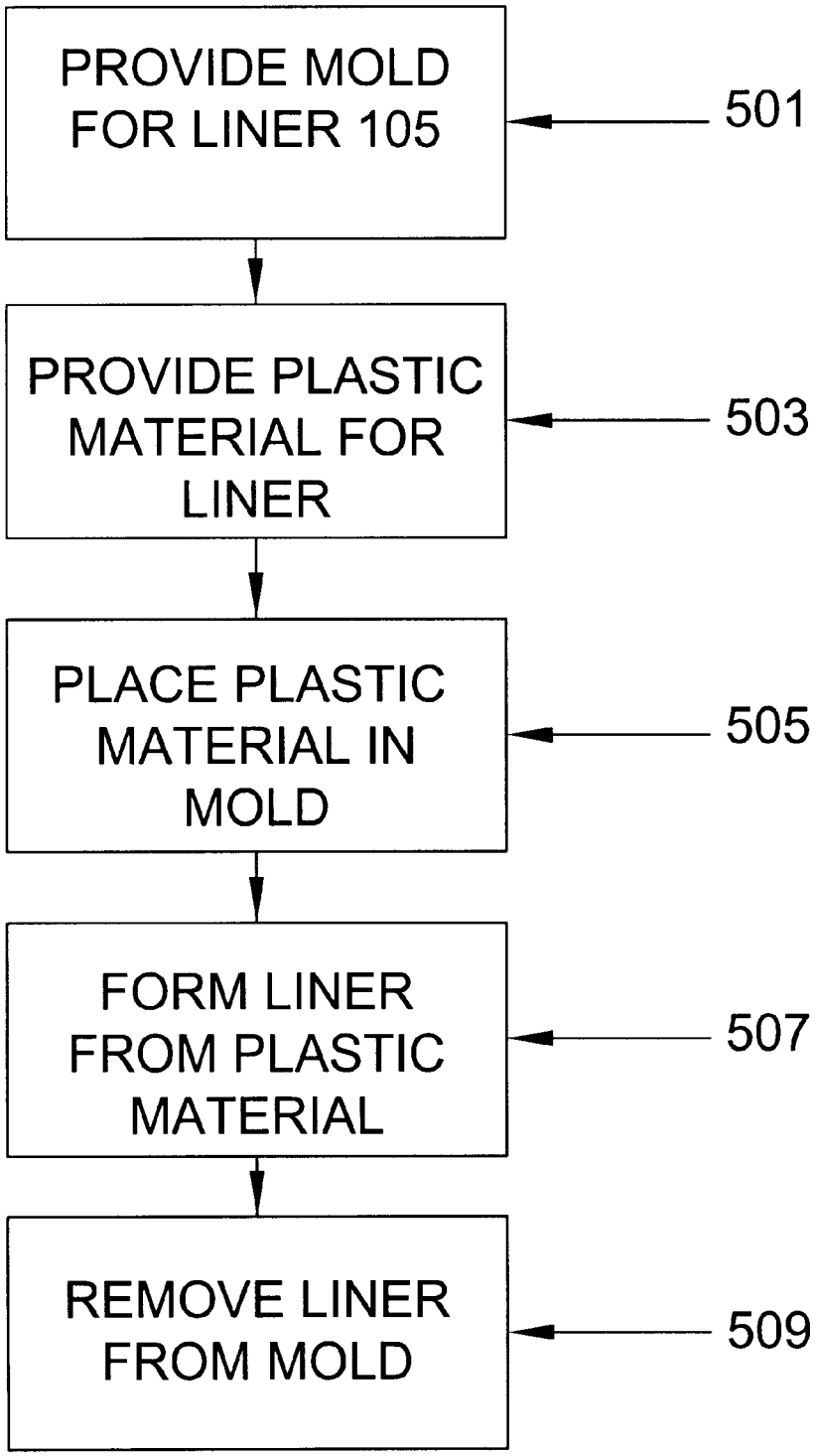
FIG. 18 is a flow chart of steps involved in a method of forming a disposable liner for a plastic bucket, according to another embodiment of the invention.

FIG. 18 is a flow chart of steps involved in a method of forming a disposable liner for a plastic bucket, according to another embodiment of the invention. In step 501, a liner mold for liner 105 is provided. The mold for liner 105 will have certain features, elements, or portions which correspond to the features and elements of the various liners 105 as described above in connection with FIGS. 13A–16. Thus, step 501 involves providing a liner mold, either male or female, which may include a liner main compartment portion, a liner cup compartment portion, and a liner channel portion disposed between the liner main compartment portion and the liner cup compartment portion. The liner mold provided in step 501 may further include a liner internal wall portion or a liner inner side straight section portion. Further, a liner rim portion of the liner mold may include at least one pouring lip portion, and a liner flange portion.

Next, at step 503, a plastic or other suitable material from which liner 105 is to be formed is provided. The plastic or other material provided in step 503 will be hereinafter referred to as liner or second material, in order to distinguish it from bucket or first material provided for forming a bucket. A preferred liner material to be provided in step 503, and from which the liner 105 is to be formed is plastic material, such as polyethylene (low or high density), polystyrene, or polypropylene. At step 505, the liner material provided in step 503 is placed into the liner mold provided in step 501. Then at step 507, the liner 105 is formed from the liner material. Finally at step 509, the liner 105 is removed from the liner mold provided in step 501.

Figure 19:
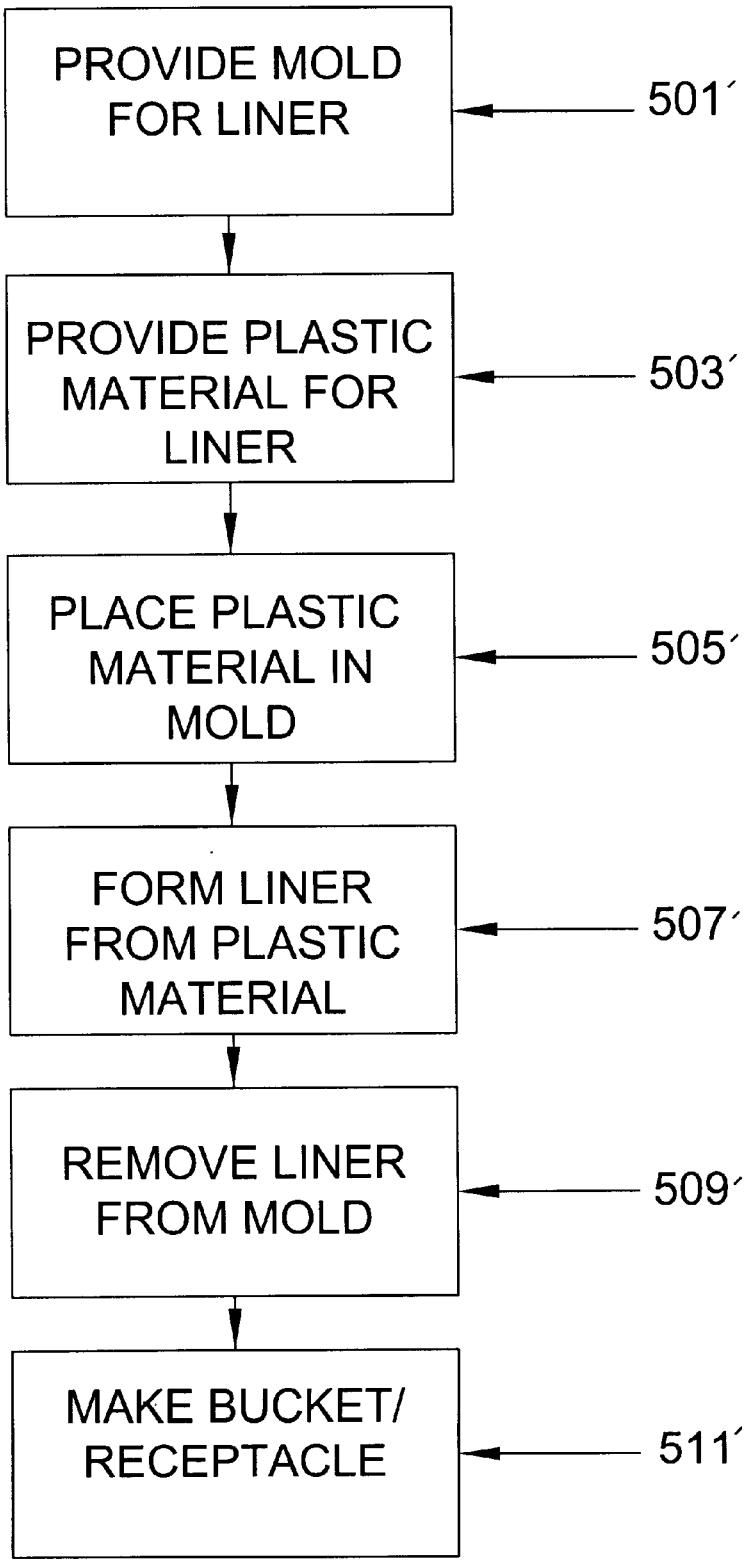
FIG. 19 is a flow chart of steps involved in a method of making a disposable liner/multi-compartment receptacle combination, according to another embodiment of the invention.

FIG. 19 is a flow chart of steps involved in a method of making a multi-compartment receptacle including a bucket/bucket liner combination, according to another embodiment of the invention. The method of FIG. 19 includes steps 501' through 509' which are analogous to steps 501 through 509 described above in connection with FIG. 18, and will not be explained again. After step 509' has been completed, a multi-compartment bucket is made at step 511' according to the methods described above in connection with FIGS. 9A or 9B.

Figure 20:
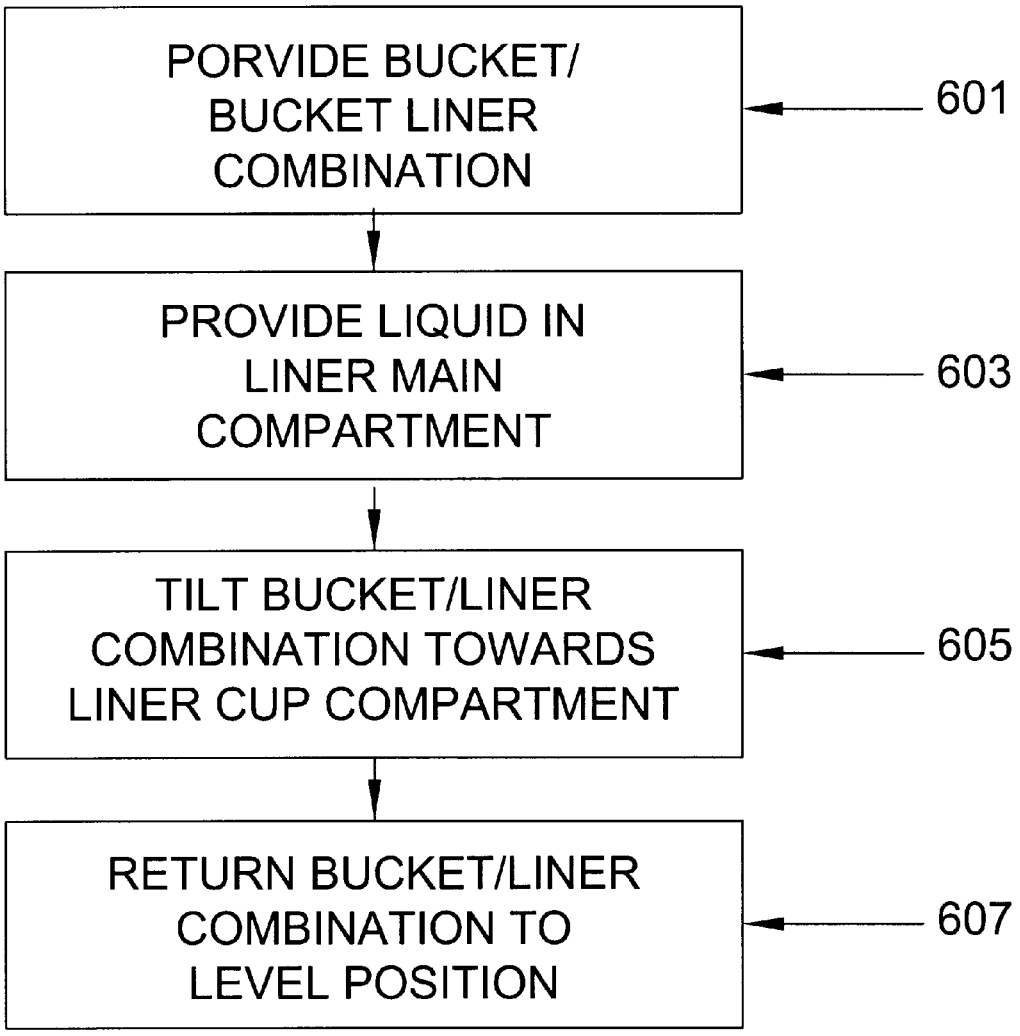
FIG. 20 is a flow chart of steps involved in a method of transferring liquid between a liner main compartment and a liner cup compartment, according to another embodiment of the invention.

FIG. 20 is a flow chart of steps involved in a method of transferring liquid through a channel disposed between a liner main compartment of a bucket liner and a liner cup compartment of the bucket liner. At step 601, the bucket liner is inserted in a bucket to provide a bucket/bucket liner combination, wherein the bucket liner lines the inner surfaces of the bucket, and the bucket liner includes at least one liner channel disposed between a liner main compartment and a liner cup compartment. The at least one liner channel allows liquid to flow between the liner main compartment and the liner cup compartment when the bucket/bucket liner combination is tilted from a substantially level position by a sufficient amount in a direction generally towards the liner cup compartment.

Next, at step 603, a liquid is provided in the liner main compartment, while the bucket/bucket liner combination is in a substantially level position. At step 605, the bucket/bucket liner combination is tilted from the substantially level position by a sufficient amount in a direction generally towards the liner cup compartment until a desired amount of liquid has flowed from the liner main compartment through the at least one liner channel to the liner cup compartment. Finally, at step 607, the bucket/bucket liner combination is returned to the substantially level or horizontal position.

Figure 21:
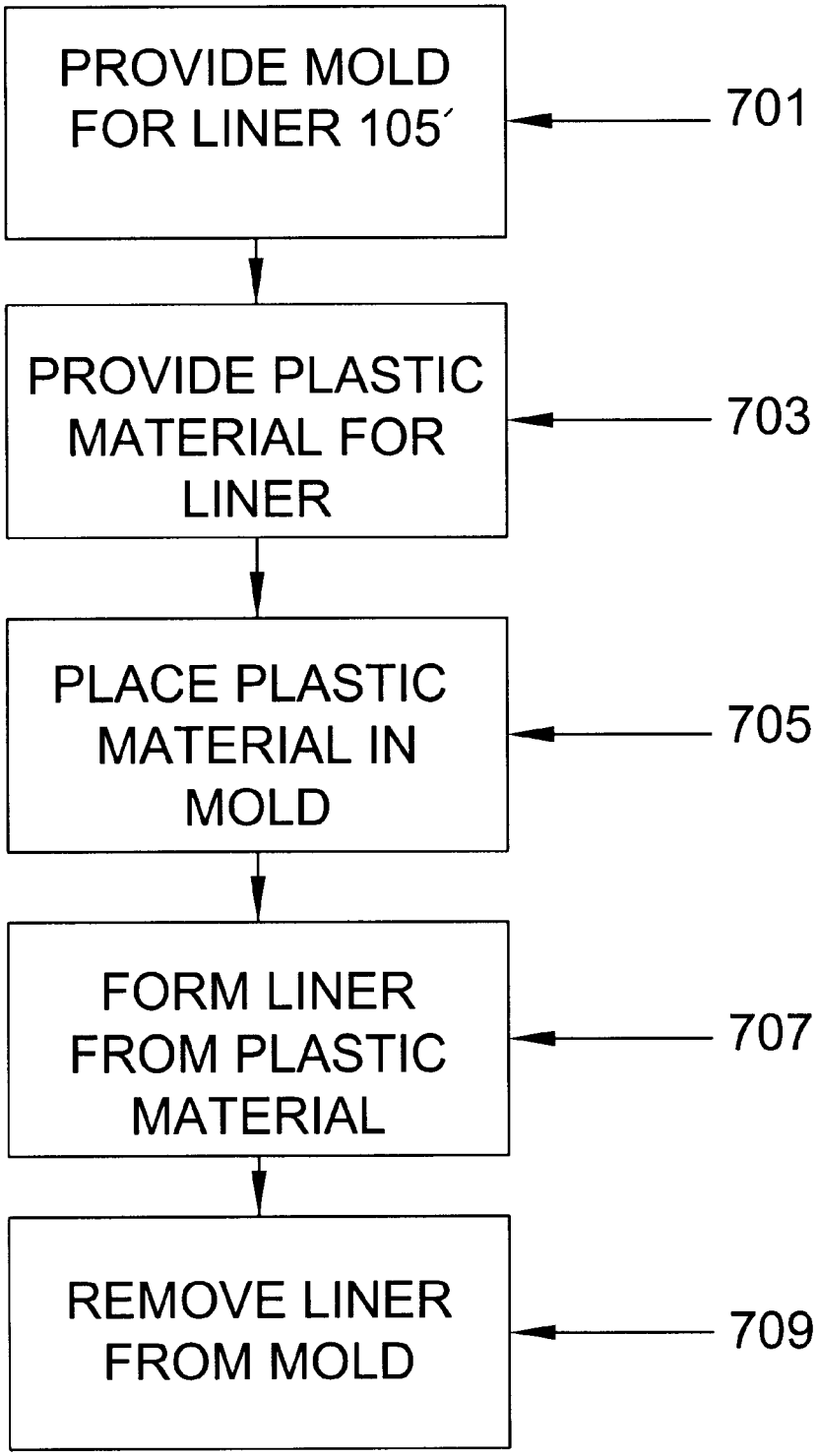
FIG. 21 is a flow chart of steps involved in a method of forming a disposable liner for a paint bucket, according to another embodiment of the invention

FIG. 21 is a flow chart of steps involved in a method of forming a disposable liner 105' for a paint bucket, according to another embodiment of the invention. At step 701, a liner mold for the liner 105' is provided. The mold for the liner 105' will have certain features, elements, or portions which correspond to the features and elements of the various liners 105' described above in connection with FIGS. 17A–17K. Thus, step 701 involves providing a liner mold, either male or female, which may include a liner base portion, an outer or inner side portion, a liner flange portion, and a liner internal wall portion (either partial or entire). Steps 703 through 709 may be performed in a manner substantially analogous to steps 503 through 509 described above in connection with FIG. 18.

While the bucket-like receptacle and the disposable bucket liners for use in combination with the bucket-like receptacle have been described herein primarily with respect to a paint bucket and paint bucket liners, it is to be understood that certain embodiments of the instant invention may also be applicable to containing other liquids as well as non-liquid materials, for example, various powders, granular materials, etc.

The foregoing embodiments are merely exemplary and are not to be construed as limiting the present invention. The methods of the present invention can be readily applied to other types of apparatuses. The description of the present invention is intended to be illustrative, and not to limit the scope of the claims. Many alternatives, modifications, and variations will be apparent to those skilled in the art.

What is claimed is:

1. A liner for lining a multi-compartment receptacle, comprising:

a liner body having a base, a rim and an exterior surface that extends between the base and the rim, the rim being substantially round;

a divider having an upper edge, the divider defining at least a part of a chord of the rim and dividing an interior of the liner body into a first compartment having a first bottom at a first elevation and a second compartment having a second bottom at a second elevation; and at least one channel in the divider located adjacent an end of the divider, wherein the divider is adapted to allow an amount of a substance contained in the first compartment to be transferred to the second compartment when the liner body is tilted from an untilted position by a predetermined amount and such that the amount of the substance remains in the second compartment after the liner body is returned to the untilted position, the second elevation is above the first elevation, a lower surface of the channel is below the upper edge of the divider and above both the first elevation and the second elevation, and the channel follows a contour of a side wall of the liner.

2. The liner of claim 1, wherein the second compartment has a smaller substance capacity than the first compartment.

3. The liner of claim 1, wherein the liner is disposable.

4. The liner of claim 1, wherein the divider has a substantially planar surface facing the first compartment.

5. The liner of claim 4, further comprising a plurality of indentations on the substantially planar surface.

6. The liner of claim 1, wherein the liner body and the divider are formed of the same material.

7. The liner of claim 6, wherein the liner body and the divider comprise a monolithic piece of material.

8. A multi-compartment liner for lining a receptacle, comprising:

a liner body having a base, a flange and an exterior surface that extends between the base and the flange, the flange being substantially round;

a divider having an upper edge, the divider defining at least a part of a chord of the flange and dividing an interior of the liner body into a first compartment having a first bottom at a first elevation and a second compartment having a second bottom at a second elevation; and at least one channel in the divider located adjacent an end of the divider, wherein the divider is adapted to allow an amount of a substance contained in the first compartment to be transferred to the second compartment when the liner body is tilted from an untilted position by at least a predetermined amount and such that the amount of the substance remains in the second compartment after the liner body is returned to the untilted position, the second elevation is above the first elevation, a lower surface of the channel is below the upper edge of the divider and above both the first elevation and the second elevation, and the channel follows a contour of a side wall of the liner.

9. The liner of claim 8, wherein the second compartment has a smaller substance capacity than the first compartment.

10. The liner of claim 8, wherein the liner body is disposable.

11. The liner of claim 8, wherein the divider has a substantially planar surface facing the first compartment.

12. The liner of claim 11, further comprising a plurality of indentations on the substantially planar surface.

13. The liner of claim 8, wherein the liner body and the divider are formed of the same material.

14. The liner of claim 13, wherein the liner body and the divider comprise a monolithic piece of material.

15. The liner of claim 8, wherein the flange is adapted to engage a rim of the receptacle.

16. The liner of claim 1, wherein the liner body and the divider are made of a flexible material.

17. The liner of claims 16, wherein the flexible material comprises a plastic material.

18. The liner of claim 17, wherein the plastic material has a thickness of between approximately 10 micrometers and approximately 40 micrometers.

19. The liner of claim 1, wherein the liner body and the divider are made of a disposable material.

20. The liner of claim 1, wherein the liner body and the divider are made of a substantially rigid material.

21. The liner of claim 20, wherein the liner body and the divider have a predetermined shape that is maintained in the absence of external support.

22. The liner of claim 20, wherein the substantially rigid material comprises one of a plastic material and an aluminum material.

23. The liner of claim 20, wherein the substantially rigid material comprises a paper-based material.

24. The liner of claim 23, further comprising a liquid-proof coating on interior surfaces of the liner body and divider.

25. The multi-compartment liner of claim 8, wherein the liner body and the divider are made of a flexible material.

26. The multi-compartment liner of claim 25, wherein the flexible material comprises a plastic material.

27. The multi-compartment liner of claim 26, wherein the plastic material has a thickness of between approximately 10 micrometers and approximately 40 micrometers.

28. The multi-compartment liner of claim 8, wherein the liner body and the divider are made of a disposable material.

29. The multi-compartment liner of claim 8, wherein the liner body and the divider are made of a substantially rigid material.

30. The multi-compartment liner of claim 29, wherein the liner body and the divider have a predetermined shape that is maintained in the absence of external support.

31. The multi-compartment liner of claim 29, wherein the substantially rigid material comprises one of a plastic material and an aluminum material.

32. The multi-compartment liner of claim 29, wherein the substantially rigid material comprises a paper-based material.

33. The multi-compartment liner of claim 32, further comprising a liquid-proof coating on interior surfaces of the liner body and divider.

* * * * *